US008534826B2

(12) United States Patent
Kobayashi et al.

(10) Patent No.: US 8,534,826 B2
(45) Date of Patent: Sep. 17, 2013

(54) INKJET RECORDING APPARATUS AND METHOD

(75) Inventors: Masaru Kobayashi, Kanagawa-ken (JP); Tsutomu Takatsuka, Kanagawa-ken (JP); Hiroaki Houjou, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 188 days.

(21) Appl. No.: 13/030,845

(22) Filed: Feb. 18, 2011

(65) Prior Publication Data

US 2011/0205321 A1 Aug. 25, 2011

(30) Foreign Application Priority Data

Feb. 22, 2010 (JP) ..... 2010-036279
Feb. 22, 2010 (JP) ..... 2010-036281
Feb. 22, 2010 (JP) ..... 2010-036283
Mar. 3, 2010 (JP) ..... 2010-046893

(51) Int. Cl.
*B41J 2/01* (2006.01)

(52) U.S. Cl.
USPC ..... 347/102; 347/101; 347/104

(58) Field of Classification Search
USPC ..... 347/101, 102, 104
See application file for complete search history.

(56) References Cited

U.S. PATENT DOCUMENTS 2,998,325 A * 8/1961 Camras ..... 428/329
2007/0165088 A1* 7/2007 Maeno et al. ..... 347/100
2008/0006176 A1* 1/2008 Houjou ..... 106/31.13
2009/0224459 A1* 9/2009 Fukui ..... 271/8.1
2009/0291215 A1* 11/2009 Makuta et al. ..... 427/256
2009/0311426 A1* 12/2009 Nakazawa et al. ..... 427/256
2010/0025920 A1* 2/2010 Williams ..... 271/112
2010/0188469 A1* 7/2010 Ikegami ..... 347/102

FOREIGN PATENT DOCUMENTS

JP 2002-144528 A 5/2002
JP 2003-211749 A 7/2003
JP 2005-22398 A 1/2005
JP 2007-144773 A 6/2007
JP 2007-144848 A 6/2007
JP 2007-245653 A 9/2007
JP 2007-246197 A 9/2007
JP 2008-179012 A 8/2008
JP 2009-241501 A 10/2009

* cited by examiner

*Primary Examiner* — Manish S Shah
*Assistant Examiner* — Yaovi Ameh
(74) *Attorney, Agent, or Firm* — Birch, Stewart, Kolasch & Birch, LLP

(57) ABSTRACT

An inkjet recording apparatus includes: a liquid ejection head which ejects an aqueous ultraviolet-curable ink toward a recording surface of a recording medium; a holding and drying unit including: a suction holding drum which conveys the recording medium while holding a back surface side of the recording medium by suction through suction holes formed in an outer circumferential surface of the drum; and a hot air flow drying device disposed to face the outer circumferential surface of the drum; a transfer conveyance device which is arranged at a downstream side of the holding and drying unit and conveys the recording medium while holding a leading end of the recording medium and curving the back surface side in a convex shape; and a fixing unit including an ultraviolet light irradiation device which is arranged at a downstream side of the transfer conveyance device and irradiates ultraviolet light onto the image.

40 Claims, 25 Drawing Sheets

FIG.22

| | OPENING RATIO (%) | AVERAGE OPENING RATIO (%) | HOLE DIAMETER d (mm) | HOLE INTERVAL (mm) | DISTRIBUTION PATTERN OF OPENING RATIO | HOLE DEPRESSIONS (VISUAL EVALUATION) | IMAGE STRENGTH (ADHERENCE) IN HOLE REGIONS | COCKLING (VISUAL EVALUATION) |
|---|---|---|---|---|---|---|---|---|
| COMPARATIVE EXAMPLE 1 | 4% (UNIFORM) | — | 0.8 | 2.8 | — | GOOD | GOOD | POOR |
| COMPARATIVE EXAMPLE 2 | 23% (UNIFORM) | — | 0.8 | 0.8 | — | GOOD | GOOD | FAIR |
| COMPARATIVE EXAMPLE 3 | 58% (UNIFORM) | — | 0.8 | 0.2 | — | GOOD | GOOD | FAIR |
| PRACTICAL EXAMPLE 1 | CENTRAL PORTION: LARGE (40%) → END PORTIONS IN AXIAL DIRECTION: SMALL (3%) | 23 | 0.8 | 500% TO 50% OF AVERAGE HOLE INTERVAL (4.0 mm TO 0.4 mm) | FIG. 10B | GOOD | GOOD | GOOD |
| COMPARATIVE EXAMPLE 4 | CENTRAL PORTION: SMALL (3%) → END PORTIONS IN AXIAL DIRECTION: LARGE (40%) | 23 | 0.8 | 500% TO 50% OF AVERAGE HOLE INTERVAL (4.0 mm TO 0.4 mm) | PATTERN INVERSE TO FIG. 10B | GOOD | GOOD | POOR |
| COMPARATIVE EXAMPLE 5 | CENTRAL PORTION: LARGE (40%) → END PORTIONS IN AXIAL DIRECTION: SMALL (3%) | 23 | 200% TO 50% OF AVERAGE HOLE DIAMETER (1.6 mm TO 0.4 mm) | 0.8 | — | VERY POOR (LARGE DIAMETER PORTION) | FAIR | GOOD |
| COMPARATIVE EXAMPLE 6 | CENTRAL PORTION: SMALL (3%) → END PORTIONS IN AXIAL DIRECTION: LARGE (40%) | 23 | 200% TO 50% OF AVERAGE HOLE DIAMETER (1.6 mm TO 0.4 mm) | 0.8 | — | VERY POOR (LARGE DIAMETER PORTION) | FAIR | POOR |
| PRACTICAL EXAMPLE 2 | CENTRAL PORTION: LARGE (40%) → END PORTIONS IN CIRCUMFERENTIAL DIRECTION: SMALL (3%) | 23 | 0.8 | 500% TO 50% OF AVERAGE HOLE INTERVAL (4.0 mm TO 0.4 mm) | FIG. 10C | GOOD | GOOD | GOOD |
| COMPARATIVE EXAMPLE 7 | CENTRAL PORTION: SMALL (3%) → END PORTIONS IN CIRCUMFERENTIAL DIRECTION: LARGE (40%) | 23 | 0.8 | 500% TO 50% OF AVERAGE HOLE INTERVAL (4.0 mm TO 0.4 mm) | PATTERN INVERSE TO FIG. 10C | GOOD | GOOD | POOR |
| COMPARATIVE EXAMPLE 8 | CENTRAL PORTION: LARGE (40%) → END PORTIONS IN CIRCUMFERENTIAL DIRECTION: SMALL (3%) | 23 | 200% TO 50% OF AVERAGE HOLE DIAMETER (1.6 mm TO 0.4 mm) | 0.8 | — | VERY POOR (LARGE DIAMETER PORTION) | FAIR | GOOD |
| COMPARATIVE EXAMPLE 9 | CENTRAL PORTION: SMALL (3%) → END PORTIONS IN CIRCUMFERENTIAL DIRECTION: LARGE (40%) | 23 | 200% TO 50% OF AVERAGE HOLE DIAMETER (1.6 mm TO 0.4 mm) | 0.8 | — | VERY POOR (LARGE DIAMETER PORTION) | FAIR | POOR |

FIG.23

| EXPERIMENT NUMBER | HOLE DIAMETER d (mm) | OPENING RATIO (%) | BASIS WEIGHT (gsm) | | |
|---|---|---|---|---|---|
| | | | 73.3 | 104.7 | 127 |
| 1 | 0.4 | 10 | GOOD | GOOD | GOOD |
| 2 | 0.6 | 17 | GOOD | GOOD | GOOD |
| 3 | 0.8 | 23 | GOOD | GOOD | GOOD |
| 4 | 1 | 28 | GOOD | GOOD | GOOD |
| 5 | 1.2 | 33 | GOOD | GOOD | GOOD |
| 6 | 1.4 | 37 | POOR | GOOD | GOOD |
| 7 | 1.6 | 40 | VERY POOR | POOR | GOOD |
| 8 | 1.8 | 43 | VERY POOR | VERY POOR | GOOD |
| 9 | 2 | 46 | VERY POOR | VERY POOR | POOR |

FIG.24

| EXPERIMENT NUMBER | SHAPE OF EDGE PART | D1= 1.2mm a=0.2mm h=0.2mm | D1= 1.6mm a=0.2mm h=0.2mm |
|---|---|---|---|
| 10 | NO SHAPING OF EDGES (FIG. 21A) | GOOD | VERY POOR |
| 11 | ROUNDED SHAPING (FIG. 21B) | GOOD | FAIR |
| 12 | TWO-STEP SHAPING (FIG. 21E) | GOOD | FAIR |

INKJET RECORDING APPARATUS AND METHOD

BACKGROUND OF THE INVENTION

1. Field of the Invention

The present invention relates to an inkjet recording apparatus and an inkjet recording method, and more particularly to an inkjet recording apparatus and an inkjet recording method by which printing is carried out with an aqueous ultraviolet-curable ink ejected from an inkjet head, onto a recording medium which is conveyed through a plurality of drums, and the recording medium is dried after printing, whereby the ink is fixed.

2. Description of the Related Art

In an inkjet recording method in the related art which uses an aqueous ultraviolet-curable ink, the water in the ink bleeds into the recording medium, such as paper, the recording medium swells and deforms due to the water being absorbed by the recording medium, and wrinkles known as "cockling" arise. After drying, the paper retains wrinkles and curl, thus leading to decline in the image quality. With the increased image resolution and increased recording speeds in inkjet printers, it is necessary to achieve efficient drying at high speed and to suppress cockling.

Furthermore, if there is moisture in the ink when ultraviolet light is irradiated, then problems arise in that ink curing does not progress efficiently and high-speed fixing cannot be achieved.

Japanese Patent Application Publication No. 2002-144528, for example, does not use an aqueous ultraviolet-curable ink in particular, but describes a drying apparatus in which, in order to suppress the occurrence of wrinkles or curl, cut sheet printing paper is held by suction through a plurality of suction holes arranged on the outer circumferential surface of a cylindrical printing paper suction roller, the printing paper is rotated while tightly held on the surface of the round cylindrical printing paper suction roller, a hot air flow drying region and a cold air flow drying region for drying the printing paper are arranged at suitable positions on the outer perimeter of the printing paper suction roller, and the printing paper is dried by passing through these drying regions.

Japanese Patent Application Publication No. 2007-144773, for example, discloses an inkjet recording apparatus which records an image by applying heat energy to a recording medium which is held on the outer circumferential surface of a drum by electrostatic attraction or suction by a holding mechanism, and then releasing the holding of the recording medium at least partially and leveling the surface of the recording medium by a pressing roller, subsequently holding the recording medium again with a holding mechanism, depositing ultraviolet-curable ink by a recording head, and curing and fixing the ink by irradiating ultraviolet light onto same.

Japanese Patent Application Publication No. 2007-245653, for example, discloses an image forming method using an aqueous ultraviolet-curable ink, in which in order to achieve high-speed fixing on a recording medium, a hot air flow is blown onto an image by an image hot air flow blowing device to evaporate off water and volatile components, whereupon the image is cured and fixed by irradiating ultraviolet light of maximum intensity by an ultraviolet light irradiation device.

However, in an inkjet recording apparatus using aqueous ultraviolet-curable ink, if fixing by irradiation of ultraviolet light is performed after a recording medium has been held by suction on a drum and dried and while the recording medium is still held by suction on the same drum, then there is a problem in that curl in a convex shape arises due to the recording surface side of the recording medium adopting the shape of the drum. Furthermore, due to the suction holes of the drum through which the recording medium is still held by suction, the corresponding portions of the recording medium become slightly depressed, and the recording medium is fixed while including these depressions, thus giving rise to problems of fixing non-uniformities, drying non-uniformities or luster non-uniformities.

Moreover, if the ink is cured by ultraviolet light after the ink has been dried while the recording medium is still held by suction on the conveyance device, there is a problem in that curing non-uniformities arise due to drying non-uniformities caused by the suction holes, as well as fixing wrinkles due to curing and contraction of the ink upon fixing between the held areas and the unheld areas. Furthermore, if fixing is carried out without the recording medium being held tightly by suction on the fixing drum when the ink is cured and fixed by irradiating ultraviolet light, then the recording medium cannot be conveyed stably, fixing non-uniformities arise, and the image quality becomes instable.

Furthermore, for example, Japanese Patent Application Publication No. 2005-022398 discloses a double-side cut sheet printing machine in which, in order to enable printing of high quality by raising the drying efficiency and performing uniform drying through moving the sheet in a stable fashion, a drying apparatus having an irradiation lamp which dries the sheet is arranged in the peripheral area of a first intermediate drum which includes a gas blowing device for blowing a preheated gas onto the back surface of the sheet in order to promote drying of the back surface of the sheet and a second intermediate drum which has a gas sucking device for holding the sheet by suction.

Moreover, for example, Japanese Patent Application Publication No. 2008-179012 discloses an inkjet recording apparatus in which, in order to rapidly dry ink on a sheet conveyed by a sheet conveyance member, ink is ejected onto a printing surface of a sheet from a plurality of nozzles of an inkjet head to perform printing, whereupon the sheet which has been separated from the sheet conveyance member is held by suction onto the outer circumferential surface of a rotating body with the printing surface of the sheet facing outward, and the ink on the sheet is dried by a heating body arranged so as to oppose the outer circumferential surface of the rotating body. However, there is no mention of a device for suppressing cockling, and therefore no description relating to the design of the suction unit.

Japanese Patent Application Publication No. 2003-211749, for example, mentions the design of a suction unit and describes an image forming apparatus in which the opening ratio is decreased toward the downstream side of the conveyance direction of the recording medium. By making the opening ratio smaller toward the downstream side, when the vicinity of the leading end portion of the recording medium is held by suction by an opening section formed on the upstream side of the conveyance direction, it is possible to suppress excessive reduction of the negative pressure in the portion which is sealed off by the recording medium. However, since a composition is adopted in which the suction surface is not moved and the recording medium is conveyed by sliding over the suction surface while being held by suction from the back surface through suction holes, then the recording medium cannot be conveyed if the suction force is made too strong and problems such as tearing or jamming of the paper occur. Moreover, with a suction force sufficient to enable conveyance by sliding over the suction surface, it is not possible to suppress or correct cockling after recording. Furthermore, in a region where the opening ratio is large, in other words, where the suction hole diameter is large, the amount of depression of the paper caused by suction becomes extremely large, thus impairing the quality of the recorded object. In particular, when an image is formed on the image area, the depression of the paper is especially marked due to the reduced stiffness of the paper caused by permeation of water. Furthermore, since the temperature during drying is liable to decline in the region of the suction holes as a result of suction, then the larger the diameter of the holes, the more likely it is that drying non-uniformities will occur, and when carrying out fixing by application of heat or pressure, or UV monomer curing, there is a concern that decline is liable to occur due to residual water in the region of the holes.

Furthermore, Japanese Patent Application Publication No. 2007-144848 describes being able to achieve stable conveyance by preventing the likelihood of floating up of the end portions of a recording medium as a result of change in the air flow during high-speed conveyance, through providing suction holes at greater number in the positions corresponding to the end portions of the paper than in the central portion. However, the suction force is liable to be insufficient in the central portion of the paper where ink droplet deposition rate is relatively high, and it is not possible to suppress cockling after recording in a sufficient manner. Furthermore, since the suction force in the end portions is strong, then there is a problem in that cockling is liable to become concentrated in the central portion of the paper.

When paper is held by suction after image formation, then there is a tendency for cockling to become concentrated mainly in the central portion of the paper. Therefore, in the central portion of the paper, a large suction force is required and the opening ratio must be set to a large value. Here, if it is sought to achieve this by increasing the diameter of the suction holes, then the amount of depression due to suction becomes large in the case of thin paper, and quality is impaired. Furthermore, in paper in which cockling progresses quickly, such a matt paper or thin paper, if the holes are arranged too densely over the whole area of the paper, then there is nowhere for existing cockling to escape to when the paper is held by suction, the cockling grows abnormally in particular locations on the paper, and wrinkles may occur.

Further, recording media of a plurality of types having various different thicknesses cannot be held by suction readily in a stable fashion without the occurrence of wrinkles or floating, etc., on a suction drying drum which dries a recording medium by holding the medium by suction on an outer circumferential surface of the drum, and furthermore, if it is sought to smoothen the recording medium by removing wrinkles and floating through bringing a smoothening member into contact with an image recording surface of the recording medium which has not yet been dried, then since the recording medium is not dry, there is a problem in that image distortion and wrinkling occur and image defects occur.

SUMMARY OF THE INVENTION

The present invention has been contrived in view of these circumstances, an object thereof being to provide an inkjet recording apparatus and an inkjet recording method whereby recording media of a plurality of different types having various different thicknesses are held by suction stably on a recording medium holding drum, and images of high quality and resolution can be formed without the occurrence of wrinkles or curling, and without the occurrence of image non-uniformities such as fixing non-uniformities or luster non-uniformities, or the like.

Moreover, it is a further object of the present invention to provide an inkjet recording apparatus and an inkjet recording method whereby, even using an aqueous ultraviolet-curable ink, curing non-uniformities and fixing wrinkles are suppressed and images of high quality can be formed in a stable fashion.

It is yet a further object of the present invention to provide an inkjet recording apparatus and an inkjet recording method whereby the growth of cockling concentrated in the central portion of the recording medium is suppressed and existing cockling is dispersed to the end portions of the recording medium, thereby preventing abnormal growth of cockling and the occurrence of creases during suction, and ensuring that cockling is inconspicuous even after suction.

In order to attain the aforementioned object, the present invention is directed to an inkjet recording apparatus, comprising: a liquid ejection head which ejects an aqueous ultraviolet-curable ink toward a recording surface of a recording medium; a holding and drying unit including: a suction holding drum which conveys the recording medium on which an image has been formed by deposition of the aqueous ultraviolet-curable ink, while holding a back surface side of the recording medium reverse to the recording surface by suction through suction holes formed in an outer circumferential surface of the suction holding drum; and a hot air flow drying device which is disposed to face the outer circumferential surface of the suction holding drum; a transfer conveyance device which is arranged at a downstream side of the holding and drying unit and conveys the recording medium while holding a leading end of the recording medium and curving the back surface side of the recording medium in a convex shape; and a fixing unit including an ultraviolet light irradiation device which is arranged at a downstream side of the transfer conveyance device and irradiates ultraviolet light onto the image formed on the recording surface of the recording medium.

According to this aspect of the present invention, since the recording medium on which an image has been formed is dried adequately by a hot air flow in the holding and drying unit before fixing, then the occurrence of cockling is suppressed, and furthermore, since the recording medium is subsequently conveyed while being curved in the opposite direction to the direction of curl upon drying, it is possible to form an image of high definition and high quality without any wrinkles or curl and without the occurrence of image non-uniformities such as fixing uniformities or luster non-uniformities.

Preferably, the inkjet recording apparatus further comprises a smoothening device which is arranged at a downstream side of the holding and drying unit and an upstream side of the ultraviolet light irradiation device and smoothens the recording medium.

According to this aspect of the present invention, since fixing is performed after wrinkles and curl have been suppressed by the smoothening device, then it is possible to form images of high definition and high quality without any wrinkles or curl and without the occurrence of image non-uniformities such as fixing uniformities or luster non-uniformities.

Preferably, the fixing unit includes a fixing drum which conveys the recording medium by wrapping the recording medium around an outer circumferential surface of the fixing drum, the ultraviolet light irradiation device being disposed to face the outer circumferential surface of the fixing drum; and the smoothening device includes a pressing roller which presses the recording medium against the fixing drum.

According to this aspect of the present invention, even though the recording medium is pressed by the pressing roller, this occurs after drying and therefore it is possible to make contact with the image surface, and it is possible to smoothen the recording medium by means of a simple composition such as a roller.

Preferably, the inkjet recording apparatus further comprises a suction assisting device which assists the suction of the recording medium onto the suction holding drum. Preferably, the suction assistance device includes an air blowing device which is arranged at an upstream side of the hot air flow drying device and blows an air flow to the outer circumferential surface of the suction holding drum obliquely toward a trailing end side of the recording medium.

According to these aspects of the present invention, by providing a suction assistance device, it is possible to suppress the occurrence of suction wrinkles in response to changes in the thickness and size of the recording medium, which cannot be handled by suction on a suction holding drum alone.

Preferably, the transfer conveyance device includes a drying device which dries the recording surface of the recording medium. Preferably, the drying device of the transfer conveyance device has a device which performs drying by blowing a hot air onto the recording surface of the recording medium.

According to these aspects of the present invention, by providing a drying device in the transfer conveyance device, it is possible to homogenize drying non-uniformities caused by the suction holes, or the like, in the holding and drying drum of the holding and drying unit.

Preferably, the transfer conveyance device includes a ribbed guide member for conveying the recording medium while curving the back surface side of the recording medium in the convex shape.

According to this aspect of the present invention, the transfer conveyance device is able to convey the recording medium reliably with the back surface side of the recording surface formed into the convex shape.

Preferably, the holding and drying unit includes a flow regulating plate for directing a hot air flow blown out from the hot air flow drying device toward the outer circumferential surface of the suction holding drum.

According to this aspect of the present invention, it is possible to seek improvements in thermal efficiency and exhaust properties, in the holding and drying unit.

In order to attain the aforementioned object, the present invention is also directed to an inkjet recording method, comprising: an ink ejection step of ejecting an aqueous ultraviolet-curable ink toward a recording surface of a recording medium; a holding and drying step of performing drying by blowing a hot air flow toward the recording surface of the recording medium on which an image has been formed by deposition of the aqueous ultraviolet-curable ink, while conveying the recording medium by holding a back surface side of the recording medium reverse to the recording surface by suction through suction holes formed in an outer circumferential surface of a suction holding drum; a transfer conveyance step of conveying the recording medium while holding a leading end of the recording medium and curving the back surface side of the recording medium in a convex shape; and a fixing step of fixing the image formed on the recording surface of the recording medium conveyed in the transfer conveyance step by irradiating ultraviolet light onto the image.

According to this aspect of the present invention, since the recording medium on which an image has been formed is dried adequately by a hot air flow in the holding and drying step before fixing, then the occurrence of cockling is suppressed, and furthermore, since the recording medium is subsequently conveyed while being curved in the opposite direction to the direction of curl upon drying, it is possible to form an image of high definition and high quality without any wrinkles or curl and without the occurrence of image non-uniformities such as fixing uniformities or luster non-uniformities.

Preferably, the inkjet recording method further comprises, after the holding and drying step and before the fixing step, a smoothening step of smoothening the recording medium.

According to this aspect of the present invention, since smoothening is carried out before fixing, it is possible to remove wrinkles from the recording medium.

In order to attain the aforementioned object, the present invention is also directed to an inkjet recording apparatus, comprising: an inkjet head which ejects ink toward a recording medium; a drum including: a holding device which is arranged on an outer circumferential surface of the drum and holds a leading end of the recording medium; and an attraction device which attracts the recording medium onto the outer circumferential surface of the drum by attraction force, the drum being configured to rotate to convey the recording medium in a conveyance direction while holding the leading end of the recording medium by the holding device and holding the recording medium on the outer circumferential surface by the attraction force of the attraction device; and a weaker attraction force region forming device which forms a region of weaker attraction force in the outer circumferential surface of the drum where the attraction force acting on the recording medium is made weaker than in other regions in the outer circumferential surface of the drum, the region of weaker attraction force being arranged at a section in a circumferential direction of the drum through an entire width of the drum in such a manner that the region of weaker attraction force is relatively moved with respect to the recording medium held on the outer circumferential surface of the drum.

According to this aspect of the present invention, recording media of a plurality of different types having various different thicknesses can be held by suction stably on the recording medium holding drum, wrinkles are suppressed, image formation and drying can be performed in a uniform fashion, and images of high quality which are free of image defects can be recorded.

Preferably, the inkjet head is disposed to face the outer circumferential surface of the drum serving as an image formation drum; and the ink is ejected from the inkjet head toward the recording medium that is being held on the outer circumferential surface of the drum. Preferably, the inkjet recording apparatus further comprises a hot air flow drying device which is disposed to face the outer circumferential surface of the drum serving as a drying drum, wherein the recording medium on which the ink has been deposited is dried by the hot air flow drying device while being held on the outer circumferential surface of the drum.

According to these aspects of the present invention, the present invention can be applied suitably to an image formation drum and to a drying drum in an inkjet recording apparatus.

Preferably, the hot air flow drying device blows an air flow to the recording medium held on the outer circumferential surface of the drum from an outer side of the outer circumferential surface toward a downstream side of the weaker attraction force region in the conveyance direction of the recording medium.

According to this aspect of the present invention, in the case of a drying drum, since the device which blows out the hot air flow is already arranged, then by using this device as the air blowing device, it is possible to simplify the composition of the apparatus accordingly.

Preferably, the inkjet recording apparatus further comprises an air blowing device which is disposed to face the outer circumferential surface of the drum, and blows an air flow to the recording medium held on the outer circumferential surface of the drum from an outer side of the outer circumferential surface toward a downstream side of the weaker attraction force region in the conveyance direction of the recording medium.

According to this aspect of the present invention, by blowing an air flow onto the downstream side of the weaker suction force region in terms of the conveyance direction of the recording medium, it is possible to move the space capable of accommodating wrinkles more readily toward the trailing end side of the recording medium, below the weaker suction force region on the recording medium, and hence wrinkles can be removed reliably.

Preferably, the air blowing device blows the air flow obliquely toward a trailing end side of the recording medium.

According to this aspect of the present invention, it is possible to remove wrinkles from the trailing end side by blowing an air flow obliquely toward the trailing end side.

Preferably, the attraction device includes a suction device which attracts the recording medium onto the outer circumferential surface of the drum by sucking air through suction holes formed in the outer circumferential surface; and the weaker attraction force region forming device includes a suction hole shielding device which closes off a part of the suction holes and is fixed inside the drum irrespectively of rotation of the drum.

According to this aspect of the present invention, by closing off the suction holes, it is possible to form the weaker suction force region simply by weakening the suction force.

Preferably, the suction hole shielding device includes a plate member which has a band shape of a substantially same width throughout a whole width of the outer circumferential surface and of a V-shaped form that opens toward a downstream side in the conveyance direction and has an apex in a central portion in a width direction of the outer circumferential surface, the plate member substantially making contact with an inner circumferential surface of the drum, the plate member being fixed so as not to rotate with the drum. It is also preferable that the suction hole shielding device includes a plate member which has a band shape of a substantially same width throughout a whole width of the outer circumferential surface and of a U-shaped form that opens toward a downstream side in the conveyance direction and has an apex in a central portion in a width direction of the outer circumferential surface, the plate member substantially making contact with an inner circumferential surface of the drum, the plate member being fixed so as not to rotate with the drum.

According to these aspects of the present invention, by placing a plate-shaped member against the suction holes, it is possible to weaken the suction force and hence the weaker suction force region can be formed easily.

Preferably, the attraction device includes a suction device which attracts the recording medium onto the outer circumferential surface of the drum by suction force induced by sucking air through suction holes formed in the outer circumferential surface, the suction holes being arranged in a suction region on the outer circumferential surface; and the weaker attraction force region forming device divides the suction region into a plurality of regions in the conveyance direction of the recording medium, connects the suction holes in the divided regions respectively to the suction device, and controls the suction force for each of the divided regions.

According to this aspect of the present invention, by dividing the suction region into a plurality of regions and making it possible to control the suction force respectively in each divided region, it is possible to form the weaker suction force region in a simple fashion.

In order to attain the aforementioned object, the present invention is also directed to an inkjet recording method, comprising the steps of: conveying a recording medium on which ink is ejected from an inkjet head, while holding a leading end of the recording medium by a holding device arranged on an outer circumferential surface of a drum, attracting the recording medium onto the outer circumferential surface of the drum by attraction force of an attraction device, and rotating the drum to convey the recording medium in a conveyance direction; and forming a region of weaker attraction force in the outer circumferential surface of the drum where the attraction force acting on the recording medium is made weaker than in other regions in the outer circumferential surface of the drum, the region of weaker attraction force being arranged at a section in a circumferential direction of the drum through an entire width of the drum in such a manner that the region of weaker attraction force is relatively moved with respect to the recording medium held on the outer circumferential surface of the drum, wherein a space is formed between a part of the recording medium and the outer circumferential surface of the drum when the attraction force acting on the part of the recording medium becomes weakened while the part of the recording medium is in the region of weaker attraction force, the space is removed when the attraction force acting on the part of the recording medium returns upon the part of the recording medium leaves the region of weaker attraction force, and the space is thereby moved relatively to the recording medium toward a trailing end of the recording medium.

According to this aspect of the present invention, recording media of a plurality of different types having various different thicknesses can be held by suction stably on the recording medium holding drum, wrinkles are suppressed, image formation and drying can be performed in a uniform fashion, and images of high quality which are free of image defects can be recorded.

Preferably, the inkjet recording method further comprises the step of blowing an air flow to the recording medium held on the outer circumferential surface of the drum from an outer side of the outer circumferential surface toward a downstream side of the weaker attraction force region in the conveyance direction of the recording medium.

According to this aspect of the present invention, it is possible to move the space capable of accommodating wrinkles more readily toward the trailing end side of the recording medium, below the weak suction region on the recording medium.

Preferably, the attraction device includes a suction device which attracts the recording medium onto the outer circumferential surface of the drum by sucking air through suction holes formed in the outer circumferential surface; and the region of weaker attraction force is formed with a suction hole shielding device which closes off a part of the suction holes and is fixed inside the drum irrespectively of rotation of the drum.

According to this aspect of the present invention, by closing off the suction holes, it is possible to form the weaker suction force region simply by weakening the suction force.

In order to attain the aforementioned object, the present invention is also directed to an inkjet recording apparatus, comprising: an image formation unit including a liquid ejection head which ejects an aqueous ultraviolet-curable ink onto a recording surface of a recording medium; a drying unit including: a drying drum which conveys the recording medium on which an image has been formed by the aqueous ultraviolet-curable ink ejected from the liquid ejection head, while holding a leading end of the recording medium by a holding device arranged on an outer circumferential surface of the drying drum, and holding a back surface side of the recording medium reverse to the recording surface by suction through suction holes formed in the outer circumferential surface of the drying drum; and a hot air flow drying device which is disposed to face the outer circumferential surface of the drying drum and dries the recording medium by applying a hot air flow to the recording medium; a transfer conveyance unit which is arranged at a downstream side of the drying unit and conveys the recording medium while holding the leading end of the recording medium; and a fixing unit which is arranged at a downstream side of the transfer conveyance unit and includes: a fixing drum which conveys the recording medium while holding the leading end of the recording medium by a holding device arranged on an outer circumferential surface of the fixing drum, and holding the back surface side of the recording medium by suction through suction holes formed in the outer circumferential surface of the fixing drum; and an ultraviolet light irradiation device which is arranged to face the outer circumferential surface of the fixing drum and irradiates ultraviolet light to the image formed on the recording surface of the recording medium.

According to this aspect of the present invention, even if using an aqueous ultraviolet-curable ink, it is possible to suppress curing non-uniformities and fixing wrinkles, and an image of stable quality can be obtained.

Preferably, positions of the suction holes formed in the outer circumferential surface of the drying drum with respect to the holding device arranged on the outer circumferential surface of the drying drum, and positions of the suction holes formed in the outer circumferential surface of the fixing drum with respect to the holding device arranged on the outer circumferential surface of the fixing drum, are mutually different.

According to this aspect of the present invention, it is possible to suppress curing non-uniformities caused by suction.

Preferably, the image formation unit includes an image formation drum which conveys the recording medium in a state where the recording surface of the recording medium faces to the liquid ejection head, while holding the leading end of the recording medium by a holding device arranged on an outer circumferential surface of the image formation drum, and holding the back surface side of the recording medium by suction through suction holes formed in the outer circumferential surface of the image formation drum; and positions of the suction holes formed in the outer circumferential surface of the image formation drum with respect to the holding device arranged on the outer circumferential surface of the image formation drum, positions of the suction holes formed in the outer circumferential surface of the drying drum with respect to the holding device arranged on the outer circumferential surface of the drying drum, and positions of the suction holes formed in the outer circumferential surface of the fixing drum with respect to the holding device arranged on the outer circumferential surface of the fixing drum, are all mutually different.

According to this aspect of the present invention, it is possible to suppress curing non-uniformities caused by suction.

Preferably, wherein the fixing unit includes a pressing roller which presses the recording medium against the fixing drum.

According to this aspect of the present invention, it is possible to correct curl, suppress wrinkles and obtain images of stable quality.

Preferably, fixing unit includes a plurality of ultraviolet light irradiation devices.

According to this aspect of the present invention, if a plurality of ultraviolet light sources are arranged in this way, then it is possible to create curing conditions by means of the irradiation time while reducing the irradiation intensity of each irradiation device, and as well as lowering costs, the amount of heat generated by the ultraviolet light irradiation devices can be reduced.

Preferably, the ultraviolet light irradiation device irradiates ultraviolet light to the recording medium from an oblique direction.

According to this aspect of the present invention, it is possible to reduce irradiation non-uniformities caused by the suction holes in the fixing drum.

Preferably, the ultraviolet light irradiation device includes a plurality of ultraviolet light emitting elements; and positions of the suction holes formed in the outer circumferential surface of the drying drum with respect to the holding device arranged on the outer circumferential surface of the drying drum coincide with positions of the ultraviolet light emitting elements with respect to the holding device arranged on the outer circumferential surface of the fixing drum.

According to this aspect of the present invention, it is possible to increase the amount of light at the positions of the suction holes of the drying drum and to reduce non-uniformity caused by the suction holes of the drying drum.

Preferably, each of the suction holes formed in the outer circumferential surface of the fixing drum has a cross-sectional shape in which an end portion opening to the outer circumferential surface is a tapered shape broadening toward the outer circumferential surface. Preferably, the ultraviolet light irradiation device includes a plurality of ultraviolet light emitting elements; each of the suction holes formed in the outer circumferential surface of the fixing drum has a cross-sectional shape in which an end portion opening to the outer circumferential surface is a tapered shape broadening toward the outer circumferential surface; a diameter of a broadest part of the tapered shape of each of the suction holes is larger than a diameter of each of the light emitting elements; and a diameter of a narrowest part of the tapered shape connecting to a straight part inside each of the suction holes is smaller than the diameter of each of the light emitting elements.

According to these aspects of the present invention, it is possible to suppress the occurrence of non-uniformities.

In order to attain the aforementioned object, the present invention is also directed to an inkjet recording method, comprising: an image formation step of ejecting an aqueous ultraviolet-curable ink onto a recording surface of a recording medium; a drying step of drying the recording medium on which an image has been formed by the aqueous ultraviolet-curable ink ejected from the liquid ejection head by applying a hot air flow to the recording medium from a hot air flow drying device which is disposed to face an outer circumferential surface of a drying drum while conveying the recording medium while holding a leading end of the recording medium by a holding device arranged on the outer circumferential surface of the drying drum, and holding a back surface side of the recording medium reverse to the recording surface by suction through suction holes formed in the outer circumferential surface of the drying drum; a transfer step of conveying the recording medium by a transfer drum which is arranged at a downstream side of the drying drum, while holding the leading end of the recording medium; and a fixing step of irradiating ultraviolet light to the image formed on the recording surface of the recording medium having been transferred in the transfer step while conveying the recording medium while holding the leading end of the recording medium by a holding device arranged on an outer circumferential surface of a fixing drum, and holding the back surface side of the recording medium by suction through suction holes formed in the outer circumferential surface of the fixing drum.

According to this aspect of the present invention, even if using an aqueous ultraviolet-curable ink, it is possible to suppress curing non-uniformities and fixing wrinkles, and an image of stable quality can be obtained.

Preferably, positions of the suction holes formed in the outer circumferential surface of the drying drum with respect to the holding device arranged on the outer circumferential surface of the drying drum, and positions of the suction holes formed in the outer circumferential surface of the fixing drum with respect to the holding device arranged on the outer circumferential surface of the fixing drum, are mutually different.

According to this aspect of the present invention, it is possible to suppress curing non-uniformities caused by suction.

In order to attain the aforementioned object, the present invention is also directed to an inkjet recording apparatus, comprising: an inkjet head which deposits droplets of ink onto a recording surface of a recording medium to form an image on the recording surface; a conveyance device including: a holding device which holds the recording medium on which the droplets of ink have been deposited; a conveyance body which conveys the recording medium in a conveyance direction, the conveyance body having a suction surface in which a plurality of suction holes are formed; and a suction device which sucks air thorough the suction holes to attract the recording medium onto the suction surface; and a heating device which heats the conveyance body and the recording medium from a recording surface side of the recording medium, wherein intervals between the suction holes increase, whereby an opening ratio of the suction holes decreases, from a center part of a region of the suction surface corresponding to the recording medium, toward end parts of the region.

According to this aspect of the present invention, since the opening ratio of the suction surface corresponding to the recording medium decreases from the central portion toward the end portions, in other words, since the opening ratio is higher in the central portion, then it is possible to suppress the growth of cockling which concentrates in the central portion of the recording medium. Furthermore, since the opening ratio becomes smaller toward the end portions, then it is possible to disperse cockling which is already present, to the end portions of the recording medium. Consequently, the cockling can be made inconspicuous.

Since the opening ratio is adjusted by means of the interval between the suction holes, rather than the diameter of the suction holes themselves, it is possible to restrict the amount of depression caused by the suction holes in the case of a recording medium of low rigidity. Therefore, it is possible to prevent decline in the image quality.

It should be noted that, in the present invention, the interval between the suction holes means the shortest distance between mutually adjacent suction holes.

Preferably, the intervals between the suction holes increase from the center part of the region of the suction surface corresponding to the recording medium, toward the end parts of the region in a width direction of the recording medium.

According to this aspect of the present invention, since the interval between the suction holes increases from the central portion toward the end portions in the width direction of the recording medium, then it is possible to disperse the cockling in the width direction of the recording medium.

Preferably, the intervals between the suction holes increase from the center part of the region of the suction surface corresponding to the recording medium, toward the end parts of the region in the conveyance direction of the recording medium.

According to this aspect of the present invention, since the interval between the suction holes increases from the central portion toward the end portions in the conveyance direction of the recording medium, then it is possible to disperse the cockling in the conveyance direction of the recording medium.

Preferably, the opening ratio of the suction holes is the highest in the center part of the region of the suction surface corresponding to the recording medium.

According to this aspect of the present invention, since the suction holes are arranged in such a manner that the opening ratio is highest in the central portion of the suction surface, then the growth of cockling in the central portion of the recording medium is suppressed and cockling that already exists can be dispersed to the end portions.

Preferably, the suction holes are arranged in a hexagonal close packed configuration with forming prescribed intervals between the suction holes.

According to this aspect of the present invention, since the suction holes are arranged in a hexagonal close packed configuration, then it is possible to arrange the suction holes densely, and furthermore, by controlling the interval at which the suction holes are arranged, the opening ratio can be controlled precisely.

Preferably, each of the suction holes has one of a perfect circular shape and an elliptical shape.

According to this aspect of the present invention, since the shape of the suction holes is the perfect circular shape or the elliptical shape, then it is possible to diminish the visibility of suction depressions caused in the recording medium.

Preferably, edge portions of the suction holes have curved surfaces.

According to this aspect of the present invention, by forming the edge portions of the suction holes as curved surfaces, it is possible to restrict the suction pressure in the end portions of the suction holes and the suction depressions caused by the suction holes in the recording medium can be diminished.

Preferably, edge portions of the suction holes have grooves of figures similar to the suction holes and larger than the suction holes.

According to this aspect of the present invention, by providing a groove in the edge portions of the suction holes, it is possible to restrict the suction pressure in the end portions of the suction holes and therefore the suction depressions caused by the suction holes in the recording medium can be diminished.

Preferably, the inkjet recording apparatus further comprises a control device which controls suction pressure of the suction device in accordance with a type of the recording medium.

According to this aspect of the present invention, since the suction pressure is controlled in accordance with the type of recording medium, then the recording medium can be held by suction with a suitable suction pressure setting for causing the recording medium to adhere tightly to the conveyance body, and therefore it is possible to diminish the suction depressions caused by the suction holes.

Preferably, the suction holes are arranged in such a manner that the opening ratio in the suction surface decreases linearly.

According to this aspect of the present invention, since the suction holes are arranged in such a manner that the opening ratio of the suction surface decreases linearly, then it is possible to stabilize the suction of the recording medium onto the conveyance body.

Preferably, the suction surface is divided into a plurality of regions, and the suction holes are arranged in such a manner that the opening ratio decreases stepwise for the divided regions.

According to this aspect of the present invention, since the opening ratio is decreased in a stepwise fashion in each one of a plurality of divided regions, then the suction of the recording medium onto the conveyance body can be stabilized.

Preferably, the opening ratio decreases linearly between the divided regions of the suction surface, and the opening ratio is uniform in each of the divided regions.

According to this aspect of the present invention, since a region where the opening ratio decreases linearly is arranged between regions where the opening ratio is uniform, then it is possible to stabilize the suction of the recording medium onto the conveyance body.

Preferably, the opening ratio is uniform in the center part of 10% to 70% of the suction surface.

According to this aspect of the present invention, since the opening ratio in uniform in the aforementioned range of the central portion of the suction surface, then it is possible to ensure the suction force in the central portion of the suction surface, and cockling which occurs in the central portion of the recording medium can be suppressed.

It should be noted that, in the present invention, the "central portion of the suction surface" is a region of complementary shape to the recording medium, at the center of the suction surface, and the ratio is the ratio with respect to the whole surface area of the recording medium.

Preferably, the inkjet recording apparatus further comprises a recording medium pressing device which presses the recording medium against a surface of the conveyance body from the recording surface side.

According to this aspect of the present invention, since the recording medium pressing device which presses the recording medium against the surface of the conveyance body is arranged, then it is possible to hold the recording medium by suction in a uniform fashion.

Preferably, the opening ratio in a part of the suction surface corresponding to a trailing end of the recording medium in the conveyance direction is equal to the opening ratio in the center part of the suction surface.

According to this aspect of the present invention, apart from a composition where the opening ratio is decreased from the central portion toward the end portions of the suction surface as described above, the opening ratio of portion of the suction surface which corresponds to the trailing end of the recording medium in terms of the conveyance direction is set to be the same as the opening ratio of the central portion, and therefore it is possible to prevent the trailing end of the recording medium from floating up from the conveyance body. This is particularly effective in cases where the conveyance body is a curved surface conveyance body, and the recording medium is a medium having high rigidity.

Preferably, the opening ratio in a part of the suction surface corresponding to a leading end of the recording medium in the conveyance direction is equal to the opening ratio in the center part of the suction surface.

According to this aspect of the present invention, apart from a composition where the opening ratio is decreased from the central portion toward the end portions of the suction surface as described above, the opening ratio of portion of the suction surface which corresponds to the leading end of the recording medium in terms of the conveyance direction is set to be the same as the opening ratio of the central portion, and therefore it is possible to prevent slackness occurring in the leading end of the recording medium. This is particularly effective in cases where the conveyance body is a curved surface conveyance body, and the recording medium is a medium having low rigidity.

In order to attain the aforementioned object, the present invention is also directed to an inkjet recording method, comprising the steps of: depositing droplets of ink onto a recording surface of a recording medium to form an image on the recording surface; conveying, in a conveyance direction, the recording medium on which the droplets of ink have been deposited, by loading the recording medium on a conveyance body having a suction surface in which a plurality of suction holes are formed, while holding the recording medium, and attracting the recording medium onto the suction surface by sucking air through suction holes; and heating the conveyance body and the recording medium from a recording surface side of the recording medium, wherein intervals between the suction holes increase, whereby an opening ratio of the suction holes decreases, from a center part of a region of the suction surface corresponding to the recording medium, toward end parts of the region.

Preferably, the intervals between the suction holes increase from the center part of the region of the suction surface corresponding to the recording medium, toward the end parts of the region in a width direction of the recording medium.

Preferably, the intervals between the suction holes increase from the center part of the region of the suction surface corresponding to the recording medium, toward the end parts of the region in the conveyance direction of the recording medium.

Preferably, the inkjet recording method further comprises the step of controlling suction pressure at the suction holes in accordance with a type of the recording medium.

According to these aspects of the present invention, it is possible to obtain similar beneficial effects to the inkjet recording apparatus described above.

As described above, according to the present invention, since the recording medium on which an image has been formed is dried adequately by a hot air flow in the holding and drying unit before fixing, then the occurrence of cockling is suppressed, and furthermore, since the recording medium is subsequently conveyed while being curved in the opposite direction to the direction of curl upon drying, it is possible to form an image of high definition and high quality without any wrinkles or curl and without the occurrence of image non-uniformities such as fixing uniformities or luster non-uniformities.

Furthermore, according to the present invention, recording media of a plurality of different types having various different thicknesses can be held by suction stably on the recording medium holding drum, wrinkles are suppressed, image formation and drying can be performed in a uniform fashion, and images of high quality which are free of image defects can be recorded.

Furthermore, according to the present invention, if curing and fixing is performed by irradiating ultraviolet light by means of an ultraviolet light irradiation device while holding the recording medium by suction on the fixing drum, then even if using an aqueous ultraviolet-curable ink, curing non-uniformities and fixing wrinkles can be suppressed and images of stable quality can be obtained. Moreover, by making the positions at which the recording medium is held by suction through the suction holes in the fixing drum different from the positions at which the recording medium is held by suction through the suction holes in the drying drum, then it is possible to prevent non-uniformities caused by suction more effectively.

Furthermore, according to the present invention, it is possible to make cockling inconspicuous by raising the suction force in the portion of the suction surface corresponding to the central portion of the recording medium, where there is a high probability of droplets being ejected to form an image, and reducing the suction force in the end portions. Moreover, since the opening ratio is controlled by means of the interval between the suction holes, rather than the diameter of the suction holes, decline in image quality due to depressions at the suction holes is prevented and drying non-uniformities at the suction holes can be prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 22 is a table showing the results of Experiment 1;

FIG. 23 is a table showing the results of Experiment 2; and

FIG. 24 is a table showing the results of Experiment 3.

DETAILED DESCRIPTION OF THE PREFERRED EMBODIMENTS

Figure 1:
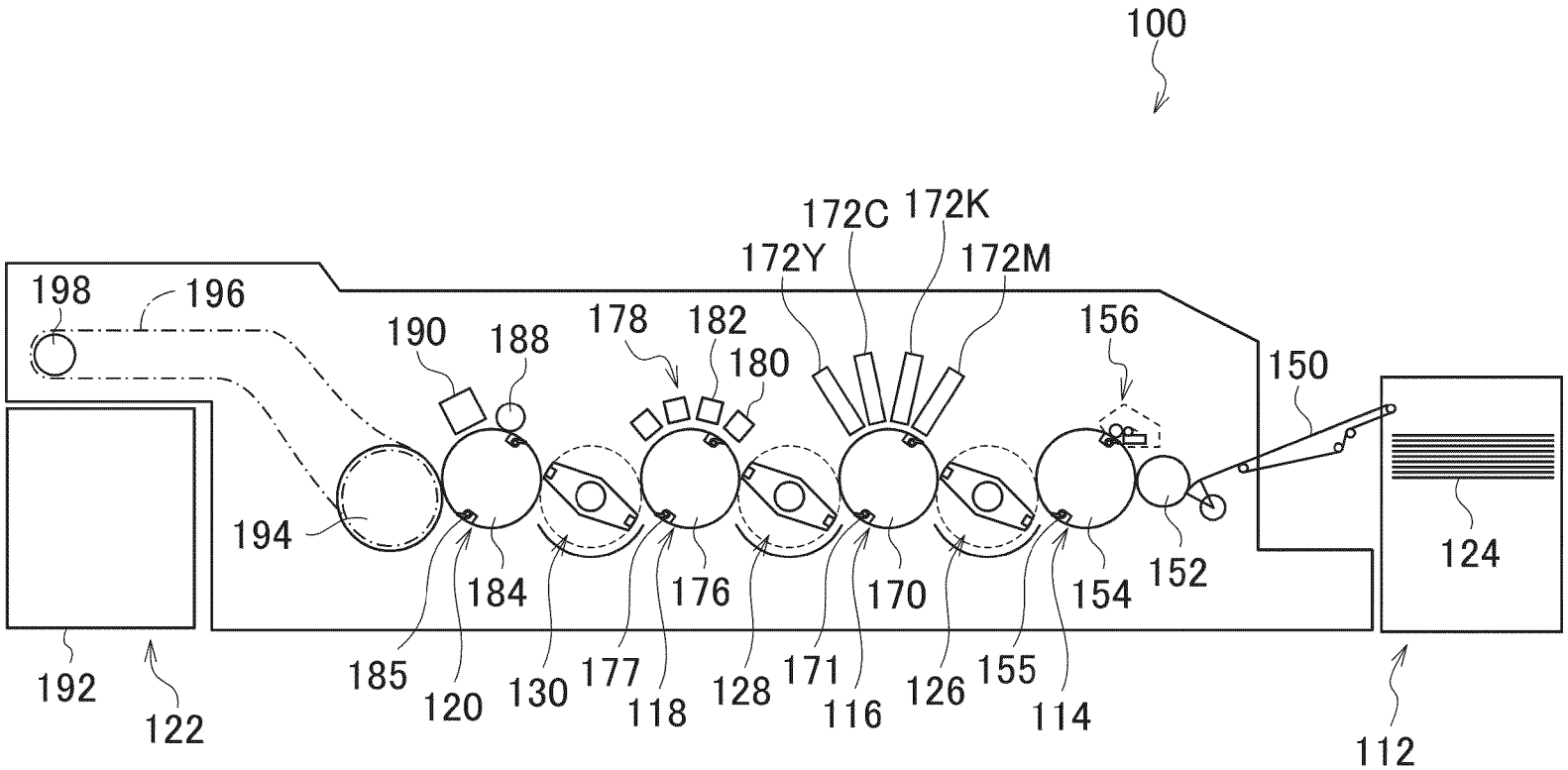
FIG. 1 is a general schematic drawing showing an inkjet recording apparatus according to an embodiment of the present invention.

FIG. 1 is a schematic drawing showing the general composition of an inkjet recording apparatus according to an embodiment of the present embodiment.

The inkjet recording apparatus 100 is an inkjet recording apparatus using a pressure drum direct image formation method, which forms a desired color image by ejecting and depositing droplets of aqueous ultraviolet-curable inks of a plurality of colors from inkjet heads 172M, 172K, 172C and 172Y onto a recording medium 124 held on a pressure drum (image formation drum 170) of an image formation unit 116. The inkjet recording apparatus 100 is an image forming apparatus of an on-demand type employing a two-liquid reaction (aggregation) method in which an image is formed on a recording medium 124 by depositing a treatment liquid (which contains an aggregating agent that aggregates components in the ink composition) on a recording medium 124 before ejecting and depositing droplets of ink, and causing the treatment liquid and ink liquid to react together.

As shown in FIG. 1, the inkjet recording apparatus 100 includes a paper feed unit 112, a treatment liquid deposition unit 114, an image formation unit 116, a drying unit 118, a fixing unit 120 and a paper output section 122.

The paper supply unit 112 is a mechanism for supplying a recording medium 124 to the treatment liquid deposition unit 114, and recording media 124, which are cut sheets of paper, are stacked in the paper supply unit 112. The paper supply unit 112 is provided with a paper supply tray 150, through which the recording medium 124 is supplied one sheet at a time to the treatment liquid deposition unit 114. In order to prevent floating up of the recording medium 124, suction holes can be arranged in the outer surface of the paper supply tray 150 and a suction device which performs suction through the suction holes can be connected.

In the inkjet recording apparatus 100 according to the present embodiment, it is possible to use recording media 124 of a plurality of types having different materials and dimensions (paper sizes). It is also possible to use a mode in which the paper supply unit 112 is provided with a plurality of paper trays (not illustrated) for respectively and separately stacking recording media of different types, and the paper supplied from the paper supply tray 150 amongst the plurality of paper trays is switched automatically, or a mode in which the operator selects the paper tray or replaces the paper tray according to requirements. In the present embodiment, cut sheets of paper (cut paper) are used as the recording media 124, but it is also possible to adopt a composition in which paper is supplied from a continuous roll (rolled paper) and is cut to the required size.

The treatment liquid deposition unit 114 is a mechanism which deposits treatment liquid onto a recording surface of the recording medium 124. The treatment liquid includes an aggregating agent which aggregates components in the ink composition deposited by the image formation unit 116, and produces an aggregating reaction with the ink upon making contact with the ink, thereby promoting the separation of the coloring material and the solvent in the ink and making it possible to form images of high quality by avoiding the occurrence of bleeding and landing interference (coalescence) or color mixing after deposition of the ink. The treatment liquid can be composed by also using other components, according to requirements, in addition to the aggregating agent. By using the treatment liquid in addition to the ink composition, it is possible to raise the speed of inkjet recording, and an image having excellent definition (reproducibility of fine lines and intricate detail portions) with good density and high resolution is obtained.

As shown in FIG. 1, the treatment liquid deposition unit 114 includes a paper supply drum 152, a treatment liquid drum 154 and a treatment liquid application device 156. The treatment liquid drum 154 is a drum which holds the recording medium 124 and conveys the medium to rotate. The treatment liquid drum 154 includes a hook-shaped gripping device (gripper) 155 arranged on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 can have suction holes arranged in the outer circumferential surface thereof, and be connected to a suction device which performs suction through the suction holes. By this means, it is possible to hold the recording medium 124 tightly against the circumferential surface of the treatment liquid drum 154.

The treatment liquid application device 156 is arranged opposing the circumferential surface of the treatment liquid drum 154, to the outside of the drum. The treatment liquid is applied to the recording surface of the recording medium 124 by the treatment liquid application device 156.

The recording medium 124 onto which the treatment liquid has been deposited by the treatment liquid deposition unit 114 is transferred from the treatment liquid drum 154 to the image formation drum 170 of the image formation unit 116 through an intermediate conveyance unit 126 (first transfer drum conveyance device).

The image formation unit 116 includes an image formation drum 170 and inkjet heads 172M, 172K, 172C and 172Y. Furthermore, although not shown in FIG. 1, it is also possible to arrange a paper pressing roller for removing wrinkles in the recording medium 124 to the forward side of the inkjet heads 172M, 172K, 172C and 172Y with respect to the image formation drum 170 (namely, to the upstream side in terms of the direction of rotation of the image formation drum 170).

Similarly to the treatment liquid drum 154, the image formation drum 170 includes a hook-shaped holding device (gripper) 171 on the outer circumferential surface of the drum, so as to hold and secure the leading end portion of the recording medium. Furthermore, the image formation drum 170 has a plurality of suction holes on the outer circumferential surface thereof, and the recording medium 124 is held by suction to the outer circumferential surface of the image formation drum 170 by negative pressure. By this means, contact with the head due to floating of the paper is avoided and paper jams are prevented. Moreover, image non-uniformities caused by variation in the clearance with respect to the head are prevented.

The recording medium 124 thus secured on the image formation drum 170 is conveyed with the recording surface thereof facing to the outer side, and droplets of aqueous ultraviolet-curable ink are deposited onto the recording surface from the inkjet heads 172M, 172K, 172C and 172Y.

The inkjet heads 172M, 172K, 172C and 172Y are each full-line type inkjet recording heads (inkjet heads) having a length corresponding to the maximum width of the image forming region on the recording medium 124, and rows of nozzles for ejecting ink arranged throughout the whole width of the image forming region are formed in the ink ejection surface of each head. The inkjet heads 172M, 172K, 172Y and 172Y are disposed so as to extend in a direction perpendicular to the conveyance direction of the recording medium 124 (the direction of rotation of the image formation drum 170).

When droplets of the corresponding colored ink are ejected from the inkjet heads 172M, 172K, 172C and 172Y toward the recording surface of the recording medium 124 that is held tightly on the image formation drum 170, the ink makes contact with the treatment liquid that has previously been deposited on the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

It is possible to carry out image formation onto the recording medium 124 in a single pass by means of the image formation unit 116 composed as described above. By this means, it is possible to achieve high-speed recording and high-speed output, and productivity can be raised.

The recording medium 124 onto which the image has been formed in the image formation unit 116 is transferred from the image formation drum 170 to a drying drum 176 of the drying unit 118 through an intermediate conveyance unit 128 (second transfer drum conveyance device).

The drying unit 118 is a mechanism which dries the water content contained in the solvent that has been separated by the action of aggregating the coloring material, and as shown in FIG. 1, includes a drying drum 176 and a solvent drying device 178.

Similarly to the treatment liquid drum 154, the drying drum 176 includes a hook-shaped holding device (gripper) 177 arranged on the outer circumferential surface of the drum, and the leading end of the recording medium 124 is held by the holding device 177. Furthermore, the drying drum 176 includes suction holes arranged in the outer circumferential surface thereof and has a suction device which performs suction through the suction holes. By this means, it is possible to hold the recording medium 124 tightly against the circumferential surface of the drying drum 176. The suction device is described in detail below. Furthermore, it is possible to hold the recording medium 124 on the drying drum 176 by carrying out negative pressure suction, and therefore it is possible to prevent cockling of the recording medium 124.

Furthermore, as described in detail below, the drying drum 176 has a device for creating a region where the suction force at the suction holes is weakened in a portion of the circumferential direction. This region of weakened suction force is fixed while the drying drum 176 is rotated, in such a manner that the recording medium 124 conveyed in the rotation while being held by suction on the drying drum 176 moves relatively with respect to the region of weakened suction force. When the recording medium 124 arrives at the region of weakened suction force, the suction is released temporarily, a gap or space capable of accommodating wrinkles occurs between the recording medium 124 and the outer circumferential surface of the drying drum 176, the space moves to the trailing end side of the recording medium 124 with the conveyance of the recording medium 124, and ultimately escapes from the trailing end section, and therefore the recording medium 124 is held by suction stably to the outer circumferential surface of the drying drum 176 without the occurrence of wrinkles.

Moreover, an air blowing device 180 (suction assisting device/smoothening device) and a solvent drying device 178 are arranged so as to oppose the outer circumferential surface of the drying drum 176. The air blowing device 180 blows air to the downstream side, in terms of the conveyance direction of the recording medium 124, from the portion where the wrinkle accommodational space is produced in the region of weakened suction force described above, and has an action of moving the wrinkle accommodational space reliably toward the trailing end side of the recording medium 124, thereby removing the wrinkles from the recording medium 124 and causing the recording medium 124 to be held by suction stably on the drying drum 176. In other words, the air blowing device 180 directs an air flow obliquely toward the end portions of the width direction of the recording medium 124 and thereby smoothens the recording medium 124 of which the leading end is held by the holding device 177, from the leading end side toward the trailing end side, in such a manner that occurrence of wrinkles is suppressed and the recording medium is held by suction more reliably. This is explained in more detail below.

The solvent drying device 178 is disposed at a position opposing the outer circumferential surface of the drying drum 176 and is constituted of a hot air flow drying device 182 in which a plurality of combined infrared (IR) heaters and fans, or the like, are arranged. It is possible to achieve various drying conditions, by suitably adjusting the temperature and air flow volume of the hot air flow which is blown from the hot air flow spraying nozzles of the hot air drying device 182 toward the recording medium 124. The recording medium 124 is conveyed by being held by suction against the outer circumferential surface of the drying drum 176 with the recording surface facing outward, and a drying process is performed by the IR heater and the hot air spraying nozzles with respect to the recording surface.

The recording medium 124 on which the drying process has been carried out in the drying unit 118 is transferred from the drying drum 176 to a fixing drum 184 of the fixing unit 120 through an intermediate conveyance unit 130 (third transfer drum conveyance device).

The fixing unit 120 is constituted of a fixing drum 184, a pressing roller 188 (leveling device) and an ultraviolet light source 190 (ultraviolet light irradiation device). Similarly to the drying drum 176, the fixing drum 184 includes a hook-shaped holding device (gripper) 185 on the outer circumferential surface thereof and grips the leading end of a recording medium 124 by means of this holding device 185, as well as including suction holes (not illustrated) arranged in the outer circumferential surface of the drum in such a manner that the recording medium 124 can be held on the fixing drum 184 by suction. The ultraviolet light source 190 which irradiates ultraviolet light onto the recording surface of the recording medium 124 is arranged so as to oppose the outer circumferential surface of the fixing drum 184.

Thus, the recording medium 124 is held by suction on the outer circumferential surface of the fixing drum 184 with the recording surface facing outward, and the recording medium 124 is conveyed by the rotation of the fixing drum 184. As the recording medium 124 is conveyed while being held by suction in this way, leveling is performed by the pressing roller 188 and curing and fixing are performed by the irradiation of ultraviolet light from the ultraviolet light source 190.

The pressing roller 188 levels the recording medium 124 by applying pressure to the recording medium 124 on which the ink has been dried. Furthermore, the ultraviolet light source 190 performs fixing of the ink by irradiating ultraviolet light onto the image formed by aqueous ultraviolet-curable ink that has been ejected onto the recording medium 124.

The fixing unit 120 can be provided with an in-line sensor which performs inspection of the image formed on the recording medium 124, the sensor being arranged opposing the outer circumferential surface of the fixing drum 184. The in-line sensor is a measurement device for measuring a test pattern, the amount of moisture, the surface temperature, the glossiness, and the like, of the image fixed on the recording medium 124; and a CCD line sensor, for example, can be employed suitably for the in-line sensor.

The paper output section 122 is arranged after the fixing unit 120. The paper output section 122 is provided with a paper output unit 192. A transfer drum 194 and a conveyance chain 196 are arranged between the fixing drum 184 of the fixing unit 120 and the paper output unit 192. The conveyance chain 196 is wound about a tension roller 198. The recording medium 124 that has passed by the fixing drum 184 is conveyed to the conveyance chain 196 through the transfer drum 194, and is then transferred from the conveyance chain 196 to the paper output unit 192.

Furthermore, although not shown in FIG. 1, the inkjet recording apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, as well as including a head maintenance unit which carries out cleaning (nozzle surface wiping, purging, nozzle suction, and the like) of the inkjet heads 172M, 172K, 172C and 172Y, a position determination sensor which determines the position of the recording medium 124 in the paper conveyance path, a temperature sensor which measures the temperature of the respective units of the apparatus, and the like.

Figure 2:
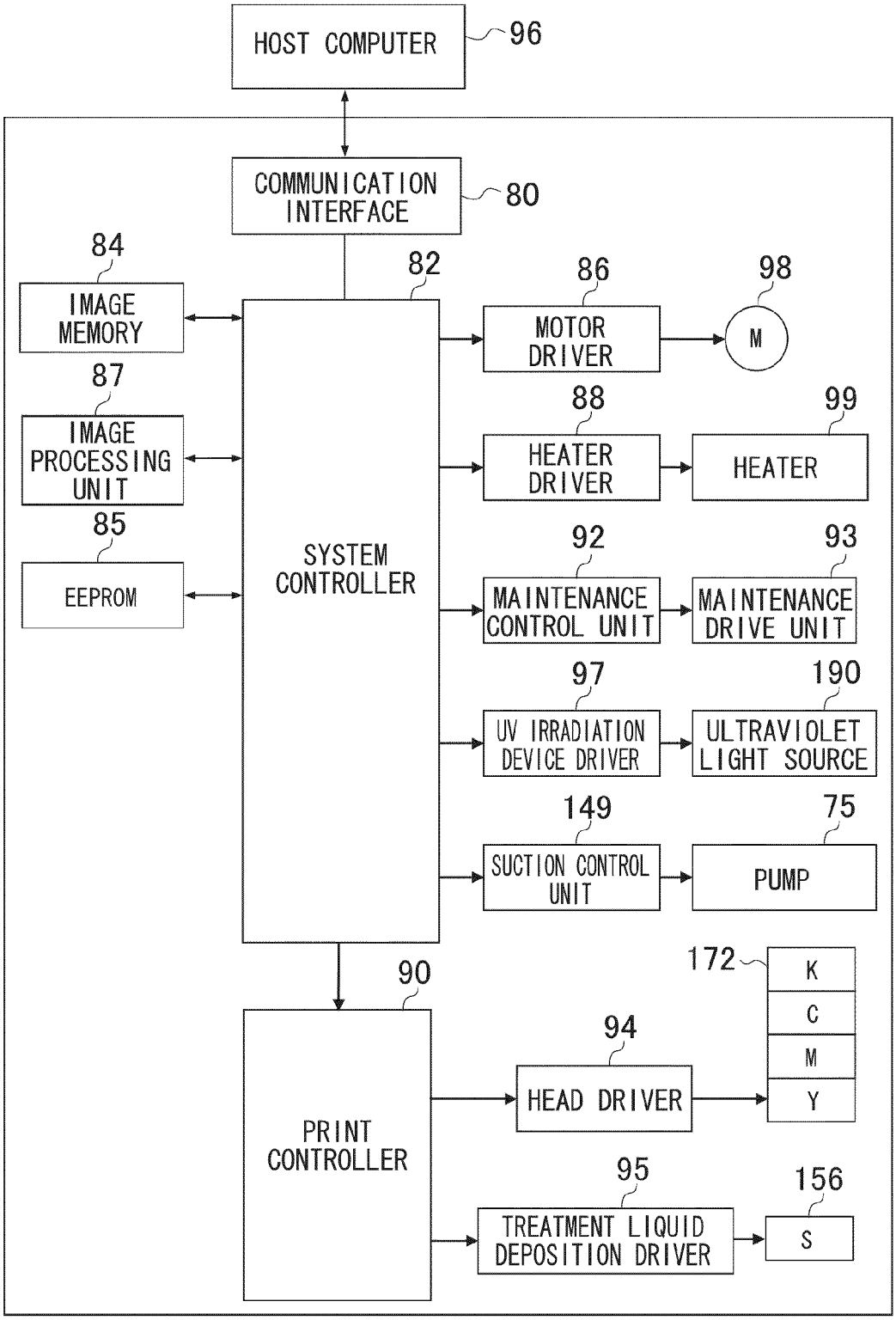
FIG. 2 is a principal block diagram showing the system composition of the inkjet recording apparatus according to the present embodiment.

FIG. 2 is a principal block diagram showing the system composition of the inkjet recording apparatus 100.

The inkjet recording apparatus 100 includes a communication interface 80, a system controller 82, an image memory 84, a motor driver 86, a heater driver 88, a print controller 90, a maintenance controller 92, a head driver 94, a treatment liquid deposition driver 95, an UV irradiation device driver 97, a suction control unit 149, and the like.

The communication interface 80 is an interface unit for receiving image data sent from a host computer 96. A serial interface such as USB (Universal Serial Bus), IEEE1394, Ethernet, wireless network, or a parallel interface such as a Centronics interface can be used as the communication interface 80. A buffer memory can be mounted in this portion in order to increase the communication speed. The image data sent from the host computer 96 is received by the inkjet recording apparatus 100 through the communication interface 80, and is temporarily stored in the image memory 84.

The image memory 84 is a storage device for temporarily storing images inputted through the communication interface 80, and data is written and read to and from the image memory 84 through the system controller 82. The image memory 84 is not limited to a memory composed of semiconductor elements, and a hard disk drive or another magnetic medium can be used.

The system controller 82 is constituted of a central processing unit (CPU) and peripheral circuits thereof, and the like, and the system controller 82 functions as a control device for controlling the whole of the inkjet recording apparatus 100 in accordance with a prescribed program, as well as a calculation device for performing various calculations. More specifically, the system controller 82 controls the various sections, such as the communication interface 80, image memory 84, motor driver 86, heater driver 88, and the like, as well as controlling communications with the host computer 96, and the system controller 82 also generates control signals for controlling a heater 99.

The program executed by the CPU of the system controller 82 and the various types of data which are required for control procedures are stored in the image memory 84. The image memory 84 can be a non-writeable storage device, or can be a rewriteable storage device, such as an EEPROM. The image memory 84 is used as a temporary storage region for the image data, and is also used as a program development region and a calculation work region for the CPU.

Furthermore, an EEPROM 85 storing various control programs and an image processing unit 87 which performs various image processes in respect of the image data are connected to the system controller 82. A control program is read in from the EEPROM 85 and executed in accordance with an instruction from the system controller 82. The EEPROM 85 may also serve as a storage device for operating parameters, and the like.

The motor driver 86 is a driver which drives a motor 98 in accordance with instructions from the system controller 82. In FIG. 2, the motors (actuators) which are arranged in the respective units of the inkjet recording apparatus 100 are denoted with the reference numeral 98. For example, the motor 98 shown in FIG. 2 includes motors which drive the intermediate conveyance units 126, 128 and 139 in FIG. 1, the paper supply drum 152, the treatment liquid drum 154, the image formation drum 170, the drying drum 176, the fixing drum 184, and the like, or the motor driving a pump 75 for sucking air through the suction holes of the image formation drum 170.

The heater driver 88 is a driver which drives the heater 99 in accordance with instructions from the system controller 82. In FIG. 2, the plurality of heaters which are arranged in the inkjet recording apparatus 100 are denoted with the reference numeral 99. For example, the heater 99 shown in FIG. 2 includes a heater of the treatment liquid deposition unit 114 shown in FIG. 1, the IR heater of the drying unit 118, and the like.

Apart from this, the maintenance controller 92 is connected to the system controller 82. The maintenance controller 92 controls a maintenance drive unit 93 which drives a maintenance unit (not shown) including a cap and a cleaning blade in accordance with instructions from the system controller 82.

The print controller 90 is a control unit which has signal processing functions for carrying out processing, correction, and other treatments in order to generate a print control signal on the basis of the image data in the image memory 84, in accordance with the control of the system controller 82, and also controls the treatment liquid deposition driver 95 prior to printing so as to deposit the treatment liquid on the recording medium 124 through the treatment liquid application device 156, as well as supplying the print data (dot data) thus generated to the head driver 94. Prescribed signal processing is carried out in the print controller 90, and the ejection volume and the ejection timing of the ink droplets in the ink heads 172M, 172K, 172C and 172Y are controlled through the head driver 94 on the basis of the image data. By this means, a desired dot size and dot arrangement are achieved.

The suction control unit 149 controls the suction device which is arranged inside the drying drum 176 in accordance with control implemented by the system controller 122, in order to convey the recording medium 124 on which an image has been formed, in a state of tightly held onto the drying drum 176. The suction device controls the suction pressure in accordance with the rigidity of the recording medium 124. By holding the recording medium with a sufficient suction pressure to convey the recording medium in a state of tightly held onto the drum, it is possible to control the suction depressions which occur in the recording medium. The suction pressures corresponding to the rigidities of the various types of recording media 124 are recorded in the EEPROM 85, and control can be implemented by directly inputting the type of recording medium 124 used, through a PC (not illustrated) for example.

Furthermore, the UV irradiation device driver 97 which controls the ultraviolet light source 190 is connected to the system controller 82.

Figure 3:
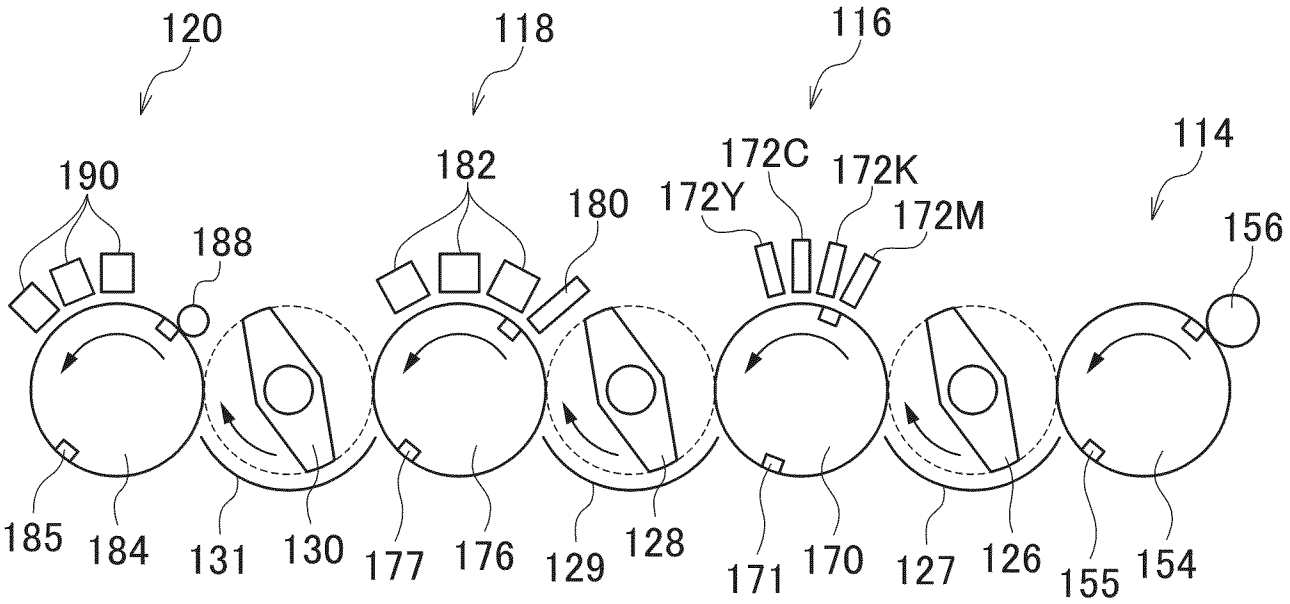
FIG. 3 is a schematic drawing showing the principal portion of the inkjet recording apparatus according to the present embodiment.

FIG. 3 shows an enlarged view of the treatment liquid deposition unit 114, the image formation unit 116, the drying unit 118 and the fixing unit 120 which are the main components of the inkjet recording apparatus 100, and the inkjet recording apparatus according to the embodiment of the present invention is described in further detail here.

As shown in FIG. 3, the treatment liquid drum 154, the intermediate conveyance unit 126 (the first transfer drum conveyance device), the image formation drum 170, the intermediate conveyance unit 128 (the second transfer drum conveyance device), the drying drum 176, the intermediate conveyance unit 130 (the third transfer drum conveyance device) and the fixing drum 184 are arranged in sequence and the recording medium 124 is conveyed by these drums in such a manner that processes of depositing treatment liquid, image formation, drying and fixing (curing) are performed successively while the recording medium is conveyed.

The intermediate conveyance units (first transfer drum conveyance device 126, second transfer drum conveyance device 128, third transfer drum conveyance device 130) respectively include ribbed guide members 127, 129 and 131, and rotate about respective rotational axes while gripping the leading end portion of the recording medium 124 with the respective holding hooks (not illustrated) on the front ends of arms which extend in directions that are mutually opposing at 180° on either side of the rotational axes, the trailing end portion of the recording medium 124 being in a free state and the recording medium 124 being conveyed respectively along the guide members 127, 129 and 131 with the recording surface thereof in a concave shape.

It is also possible that each of the intermediate conveyance units 126, 128 and 130 is composed in such a manner that the recording medium 124 is held by a chain gripper and conveyed with the recording surface in a concave shape.

The inkjet recording apparatus 100 according to the present embodiment records an image on a recording surface of the recording medium 124, and the recording medium 124 is not limited in particular, but rather it is possible to use general printing paper having cellulose as a main component, such as high-grade paper, coated paper, art paper, or the like, as used in a general offset printing, or the like. General printing papers having cellulose as a main component display relatively slow ink absorption and drying in image recording using a standard inkjet method which employs aqueous ink, movement of the coloring material is liable to occur after ink droplet deposition, and image quality is liable to decline. However, when the inkjet recording apparatus 100 according to the present embodiment is employed, then movement of the coloring material is suppressed and high-quality image recording having excellent color density and color hues can be achieved.

Of recording media, coated paper which is used in general offset printing, and the like, is desirable. Coated paper is high-grade or medium-grade paper principally made of cellulose and which does not generally have a surface treatment, which has a coating layer arranged on the surface thereof by applying a coating material. Coated paper is liable to produce problems of image quality, such as the image luster and wear resistance, and the like, in image formation using a standard aqueous inkjet method, but in the inkjet recording apparatus 100 according to the present embodiment, non-uniformities in luster are suppressed and it is possible to obtain an image having good luster and wear resistance. In particular, it is desirable to use a coated paper having a base paper and a coating layer including an inorganic pigment, and it is more desirable to use a coated paper having a base paper and a coating layer including kaolin and/or calcium bicarbonate. More specifically, art paper, coated paper, lightweight coated paper or fine coated paper are more desirable.

As stated above, the treatment liquid deposition unit 114 deposits the treatment liquid onto the recording surface of the recording medium 124 while dosing the treatment liquid by means of the treatment liquid application device 156, as the recording medium is conveyed by gripping the leading end portion of the recording medium 124 by the holding device 155 arranged on the outer circumferential surface of the treatment liquid drum 154.

The film thickness of the treatment liquid that has been applied to the recording surface by the treatment liquid application device 156 is desirably sufficiently smaller than the diameter of the ink droplets which are ejected and deposited by the inkjet heads 172M, 172K, 172C and 172Y of the image formation unit 116. For example, if the droplet ejection volume of the ink is 2 pl (picoliters), then the average diameter of the ink droplets is 15.6 μm. In this case, if the film thickness of the treatment liquid is large, then the ink droplets float inside the treatment liquid without making contact with the surface of the recording medium 124. Therefore, in order to obtain a diameter of 30 μm or more in the deposited dots when the ink droplet ejection volume is 2 pl, it is desirable that the film thickness of the treatment liquid should be 3 μm or less.

Although not shown in the drawings, the treatment liquid deposition apparatus 156 includes a treatment liquid container, a dosing roller and an application roller. The treatment liquid is stored in the treatment liquid container and a portion of the dosing roller is immersed in this treatment liquid. For the dosing roller, it is suitable to use a metal roller or an anilox roller in which a plurality of cells are regularly formed in a uniform number of lines on the circumferential surface of a metal roller, or a metal roller which has received a ceramic coating on the surface thereof For the material of the metal roller, it is possible to use iron, stainless steel, or the like. If iron is used as the material, then in order to improve the hydrophilic properties of the surface, as well as improving resistance to wear and anti-rusting properties, chromium plating or the like can be arranged on the surface. For the cell structure of the anilox roller, it is desirable to use a structure having a line number of no less than 150 lines and no more than 400 lines, a cell depth of no less than 20 μm and no more than 75 μm, and a cell volume of no less than 30 $cm^3/m^2$ and no more than 60 $cm^3/m^2$. The diameter of the dosing roller is, for example, no less than 20 mm and no more than 100 mm.

The dosing roller is rotatably supported and is connected to a motor (not illustrated) and is driven to rotate at a uniform speed. Consequently, the treatment liquid inside the treatment liquid container becomes attached to the surface of the dosing roller and this treatment liquid can be transferred to the surface of the application roller. The direction of rotation of the dosing roller is the same as that of the application roller, and the circumferential speed of the outer circumference of the roller can be the same as the application roller or can have a speed differential with respect to same. If there is a speed differential, then it is appropriate that the circumferential speed of the dosing roller should be no less than 80% and no more than 140% of the circumferential speed of the application roller. By adjusting the circumferential speeds of the application roller and the dosing roller, it is possible to adjust the rate of transfer from the dosing roller to the application roller and the thickness of the film of treatment liquid applied to the recording medium 124 can be adjusted.

A doctor blade for dosing the treatment liquid is arranged so as to abut against the surface of the dosing roller. The doctor blade is arranged to the upstream side of the point of contact between the dosing roller and the application roller, in terms of the direction of rotation of the dosing roller, so as to be able to scrape off the liquid on the surface of the dosing roller to regulate the dose of applied liquid. By this means, it is possible to supply an applied liquid which has been dosed by the doctor blade, to the application roller.

For the application roller, it is suitable to use a rubber roller having a rubber layer, such as EPDM or silicone, on the surface thereof. The application roller is rotatably supported and is connected to a motor (not illustrated) and is driven to rotate at a uniform speed. The direction of rotation of the application roller is the same as that of the treatment liquid drum 154, and the circumferential speed of the outer circumference of the roller is the same as the speed of the treatment liquid drum 154. By this means, the treatment liquid transferred from the dosing roller to the application roller is applied to the recording medium 124 held on the treatment liquid drum 154.

In this way, since the treatment liquid application device 156 applies the treatment liquid by means of the roller, then it is possible to apply the treatment liquid to the recording medium 124 uniformly and with a small application volume. Moreover, the treatment liquid application device 156 desirably contacts and separates the roller of the treatment liquid application device with respect to each recording medium, in order to prevent soiling of the conveyance drum for treatment liquid application (the treatment liquid drum 154). Since the treatment liquid drum 154 conveys the recording medium 124 with the holding hook which holds the leading end of the recording medium 124, then high-speed conveyance of the recording medium 124 becomes possible and the occurrence of paper conveyance jams can also be reduced.

It is also possible to arrange an IR heater and a hot air flow spraying nozzle opposing the outer circumferential surface of the treatment liquid drum 154, so as to dry the treatment liquid that has been applied to the recording medium 124. If the IR heater and the hot air flow spraying nozzle are arranged, then the IR heater is controlled to a high temperature (for example, 180° C.), and the hot air flow spraying nozzle is composed so as to blow a hot air flow at a high temperature (for example, 70° C.) toward the recording medium 124 at a uniform flow rate (for example, 9 $m^3$/min) By heating by means of the IR heater and the hot air flow spraying nozzle, the water content in the solvent of the treatment liquid is evaporated off and a thin film layer of treatment liquid is formed on the recording surface of the recording medium 124. By forming the treatment liquid as a thin layer in this way, when dots of ink formed by droplets ejected from the image formation unit 116 make contact with the recording surface of the recording medium 124, the required dot diameter is obtained, and furthermore aggregation of the coloring material occurs due to reaction with the treatment liquid component formed in the thin layer and hence an action of fixing the coloring material to the recording surface of the recording medium 124 can be achieved readily. The treatment liquid drum 154 can be controlled to a prescribed temperature (for example, 50° C.).

Moreover, the treatment liquid includes an aggregating agent which aggregates a component in the ink composition deposited by the image formation unit 116.

The aggregating agent used can be a compound capable of changing the pH of the ink composition, or a multivalent metal salt, or a polyallylamine. In the present embodiment, from the viewpoint of the aggregating properties of the ink composition, a compound capable of changing the pH of the ink composition is desirable, and a compound capable of lowering the pH of the ink composition is more desirable. Desirable examples of a compound capable of lowering the pH of the ink composition are acidic materials having high water solubility (such as phosphoric acid, nitric acid, malonic acid, citric acid, or derivatives or salts of these compounds, or the like).

In this way, desirably, an acid material having high water solubility is used as the aggregating agent, and from the viewpoint of raising the aggregating properties and fixing the whole of the ink, an organic acid is preferable and a bivalent or higher-valence organic acid is more desirable. Moreover, a bivalent or higher and trivalent or lower acid material is especially desirable. A bivalent or higher-valence organic acid is desirably an organic acid having a first pKa of no more than 3.5, more desirably an organic acid having a first pKa of no more than 3.0, and more specific examples include: phosphoric acid, nitric acid, malonic acid, citric acid, and the like.

In the aggregating agent, it is possible to use only one type, or a combination of two or more types, of acid material. By this means, the aggregating properties are raised and the whole of the ink can be solidified. The content ratio of the aggregating agent which aggregates the ink composition in the treatment liquid is desirably, 1 to 50 wt %, more desirably, 3 to 45 wt % and even more desirably 5 to 40 wt %. Furthermore, desirably, the pH of the ink composition is no less than 8.0 (at 25° C.), and the pH of the treatment liquid is in the range of 0.5 to 4 (at 25° C.). Consequently, it is possible to achieve image density, resolution and high speed inkjet recording.

Furthermore, it is also possible to include other additives in the treatment liquid. These additives can be commonly known additives, for example, an anti-drying agent (humidifying agent), an anti-fading agent, an emulsion stabilizer, a permeation promoter, an ultraviolet light absorber, an antibacterial agent, an antiseptic agent, a pH adjuster, a surface tension adjuster, an antifoaming agent, a viscosity adjuster, a dispersant, a dispersion stabilizer, an anti-rusting agent, a chelating agent, or the like.

As stated previously, in the present embodiment, the composition using the roller-based application method is given as an example, but the deposition of the treatment liquid is not limited to the application method and can also employ a commonly known method such as an inkjet method or immersion method, or the like. For the application method, is it possible to use a commonly known application method employing a bar coater, extrusion die coater, air doctor coater, blade coater, rod coater, knife coater, squeeze coater, reverse roll coater, or the like.

The treatment liquid deposition step can be arranged either before or after the ink deposition step using an ink composition. In the present embodiment, a desirable mode is one where the ink deposition step is arranged after the treatment liquid has been deposited in the treatment liquid deposition step. More specifically, a desirable mode is one where, before depositing the ink composition onto the recording medium 124, the treatment liquid for aggregating the pigment and/or self-dispersing polymer particles in the ink composition is deposited, and the ink composition is deposited to form an image so as to make contact with the treatment liquid that has been deposited on the recording medium 124. By this means, it is possible to achieve high speed inkjet recording and an image of high density and high resolution can be obtained even if printing at high speed.

Furthermore, the amount of treatment liquid deposited is not limited in particular, provided that the treatment liquid is capable of aggregating the ink composition, but desirably the amount of aggregating agent deposited is no less than 0.1 g/$m^2$. More desirably, the amount of aggregating agent deposited is in the range of 0.2 to 0.7 g/$m^2$. If the deposited amount is no less than 0.1 g/$m^2$, then the aggregating agent maintains good high-speed aggregating properties in accordance with various modes of use of the ink composition. Moreover, it is desirable if the deposited amount of aggregating agent is no more than 0.7 g/$m^2$, since no adverse effects are caused to the surface properties of the recording medium to which the aggregating agent has been applied (no change in luster, or the like).

Referring again to FIG. 3, the recording medium 124 on which the treatment liquid has been deposited by the treatment liquid deposition unit 114 is conveyed to the subsequent image formation unit 116 by the intermediate conveyance unit (first transfer drum conveyance device) 126. The recording medium 124 is conveyed by means of the leading end portion thereof being held by the holding hook (not illustrated) of the first transfer drum conveyance device 126, in such a manner that the recording surface is facing inward and the back surface side assumes a convex shape along the guide member 127.

Furthermore, the first transfer drum conveyance device 126 has a hot air flow drying device (not illustrated) arranged inside same (in the vicinity of the rotational axis), and directs a hot air flow onto the recording surface (front surface) of the recording medium 124 which is facing inward during the conveyance, thereby drying the treatment liquid that has been deposited on the front surface. By this means, when droplets of ink are deposited onto the recording medium 124 in the image formation unit 116, the deposited ink droplets are prevented from moving on the recording medium 124 during the deposition of ink.

The image formation drum 170 of the image formation unit 116 holds, by means of the holding device 171 arranged on the outer circumferential surface of the image formation drum 170, the leading end portion of the recording medium 124 transferred by the first transfer drum conveyance device 126, and also conveys the recording medium 124 while the recording medium 124 is held and secured on the outer circumferential surface of the image formation drum 170 by suction through the suction holes arranged in the outer circumferential surface of the image formation drum 170. In this way, the recording medium 124 secured on the outer circumferential surface of the image formation drum 170 is conveyed with the surface thereof on which the treatment liquid has been deposited (recording surface) facing to the outer side, and droplets of aqueous ultraviolet-curable ink are deposited onto this recording surface from the inkjet heads 172M, 172K, 172C and 172Y.

Here, the ink used in the present embodiment (the aqueous ultraviolet-curable ink) is described.

The aqueous ultraviolet-curable ink includes pigment, polymer particles and a water-soluble polymerizable compound which is polymerized by an active energy irradiation. By this means, it is possible to cure the ink by irradiating ultraviolet light, and hence excellent wear resistance and high film strength are obtained.

The ink composition in the present embodiment includes a pigment, and can be composed by also using a dispersant, a surfactant, and other components, according to requirements. The ink composition contains at least one type of pigment as a coloring material component. There are no particular restrictions on the pigment, and it is possible to select a pigment appropriately according to the object, for example, the pigment can be an organic or inorganic pigment. It is desirable from the viewpoint of ink coloring properties that the pigment should be one which is virtually insoluble or has poor solubility in water. Furthermore, desirably, the pigment is a water-dispersible pigment in which at least a portion of the surface of the pigment is coated with a polymer dispersant.

The ink composition of the present embodiment can include a dispersant of at least one type. As the pigment dispersant, it is possible to use either a polymer dispersant or a low-molecular surfactant. Furthermore, the polymer dispersant can be a water-soluble dispersant or a water-insoluble dispersant.

The weight-average molecular weight of the polymer dispersant is desirably 3,000 to 100,000, more desirably, 5,000 to 50,000, yet more desirably, 5,000 to 40,000, and especially desirably, 10,000 to 40,000.

The acid value of the polymer dispersant is desirably no more than 100 mg KOH/g, from the viewpoint of achieving good aggregating properties upon making contact with the treatment liquid. Furthermore, the acid value is more desirably 25 to 100 mg KOH/g, yet more desirably, 25 to 80 mg KOH/g, and especially desirably, 30 to 65 mg KOH/g. If the acid value of the polymer dispersant is no less than 25 mg KOH/g, then the self-dispersing properties thereof have good stability.

From the viewpoint of self-dispersing properties and the aggregation speed upon contact with the treatment liquid, the polymer dispersant desirably includes a polymer having a carboxyl group, and more desirably includes a polymer having a carboxyl group and an acid value of 25 to 80 mg KOH/g.

In the present embodiment, from the viewpoint of the lightfastness and the quality of the image, and the like, desirably, a pigment and a dispersant are included, more desirably, an organic pigment and a polymer dispersant are included, and especially desirably, an organic pigment and a polymer dispersant having a carboxyl group are included. Furthermore, from the viewpoint of aggregating properties, desirably, the pigment is coated with a polymer dispersant having a carboxyl group and is water-insoluble. Moreover, from the viewpoint of aggregating properties, desirably, the acid value of the self-dispersing polymer particles which are described hereinafter is smaller than the acid value of the polymer dispersant.

The average particle size of the pigment is desirably 10 to 200 nm, more desirably, 10 to 150 nm, and yet more desirably, 10 to 100 nm. Good color reproduction and good droplet ejection characteristics when ejecting by an inkjet method are obtained if the average particle size is no greater than 200 nm, and good lightfastness is obtained if the average particle size is no less than 10 nm. Furthermore, there are no particular restrictions on the particle size distribution of the coloring material, and it is possible to have a broad particle size distribution or a mono-disperse particle size distribution. Furthermore, it is also possible combine and use two or more types of coloring material each having mono-disperse particle size distribution.

The average particle size and the particle size distribution of the pigment particles is determined by measuring the volume-average particle size by dynamic light scattering using a Nikkiso UPA-EX150 Nanotrac particle size analyzer, for example.

The pigments may be used independently, or two or more types of pigment may be used in combination. From the viewpoint of image density, the content of the pigment in the ink composition is desirably, 1 to 25 wt %, more desirably, 2 to 20 wt %, yet more desirably, 5 to 20 wt %, and especially desirably, 5 to 15 wt %, with respect to the ink composition.

<Polymer Particles>

The ink component in the present embodiment can include polymer particles of at least one type. The polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image.

In order to react with the aggregating agent, polymer particles having an anionic surface charge can be used, a commonly known latex can be used provided that adequate reactivity and ejection stability can be obtained, and it is especially desirable to use self-dispersing polymer particles.

<Self-Dispersing Polymer Particles>

Desirably, the ink composition in the present embodiment includes at least one type of self-dispersing polymer particles as the polymer particles. The self-dispersing polymer particles have a function of solidifying the ink composition by destabilizing dispersion upon contact with the treatment liquid or the area where the treatment liquid has dried, causing aggregation and leading to increase in the viscosity of the ink, and hence making it possible further to improve the fixing properties of the ink composition onto the recording medium and the wear resistance of the image. Furthermore, the self-dispersing polymer includes resin particles which are desirable from the viewpoint of the ejection stability and the stability of the liquid composition containing the pigment (and in particular, dispersion stability).

Self-dispersing polymer particles means particles of a water-insoluble polymer which does not contain free emulsifier and which can be obtained as a dispersion in an aqueous medium due to a functional group (particularly, an acid group or salt thereof) contained in the polymer itself, without the presence of a separate surfactant.

The acid value of the self-dispersing polymer in the present embodiment is desirably no more than 50 mg KOH/g, from the viewpoint of achieving good aggregating properties upon making contact with the treatment liquid. Moreover, the acid value is more desirably 25 to 50 mg KOH/g, and even more desirably, 30 to 50 mg KOH/g. If the acid value of the self-dispersing polymer is no less than 25 mg KOH/g, then the self-dispersing properties thereof have good stability.

From the viewpoint of self-dispersion properties and the aggregation speed upon contact with the treatment liquid, the particles of self-dispersing polymer according to the present embodiment desirably include a polymer having a carboxyl group, more desirably include a polymer having a carboxyl group and an acid value of 25 to 50 mg KOH/g, and even more desirably include a polymer having a carboxyl group and an acid value of 30 to 50 mg KOH/g.

As regards the molecular weight of the water-insoluble polymer which constitutes the self-dispersing polymer particles, a weight-average molecular weight of 3,000 to 200,000 is desirable, 5,000 to 150,000, more desirable, and 10,000 to 100,000, even more desirable. By having a weight-average molecular weight of no less than 3,000, it is possible to restrict the amount of water-soluble component effectively. Furthermore, by having a weight-average molecular weight of no more than 200,000, it is possible to improve the self-dispersion stability.

The weight-average molecular weight can be measured by gel permeation chromatography (GPC). For example, the GPC can be carried out using an HLC-8220 GPC device (made by Tosoh Corp.) and three columns, a TSK gel Super HZM-H, TSK gel Super HZ4000, TSK gel Super HZ2000 (product names of Tosoh Corp.; 4.6 mm ID by 15 cm), with an eluent of THF (tetrahydrofuran). Furthermore, the chromatography conditions can be: sample density 0.35/min, flow rate 0.35 ml/min, sample inlet amount 10 μl, and measurement temperature 40° C., and an IR detector is used. Moreover, a calibration curve can be created from eight samples manufactured by Tosoh Corp.: "standard sample TSK standard, polystyrene": "F-40", "F-20", "F-4", "F-1", "A-5000", "A-2500", "A-1000", and "n-propyl benzene".

The average particle size of the self-dispersing polymer particles is desirably in the range of 10 nm to 400 nm, more desirably in the range of 10 to 200 nm, and even more desirably, in the range of 10 to 100 nm, as a volume-average particle size. If the volume-average particle size is no less than 10 nm, manufacturability is improved and if the volume-average particle size is no more than 1 μm, then storage stability is improved.

The average particle size and the particle size distribution of the particles of self-dispersing polymer are determined by measuring the volume-average particle size by dynamic light scattering using a Nikkiso UPA-EX150 Nanotrac particle size analyzer, for example.

The particles of self-dispersing polymer used can be of one type only or a combination of two or more types. The content of the self-dispersing polymer particles in the ink composition is desirably 1 to 30 wt % and more desirably 5 to 15 wt % with respect to the ink composition, from the viewpoint of the aggregation speed and the image luster, and so on.

Furthermore, the content ratio between the pigment and the self-dispersing polymer particles in the ink composition (for example, the ratio of water-insoluble pigment particles/self-dispersing polymer particles) is desirably 1/0.5 to 1/10 and more desirably 1/1 to 1/4, from the viewpoint of the wear resistance of the image, and the like.

<Polymerizable Compound>

The ink composition according to the present embodiment can include at least one type of water-soluble polymerizable compound which is polymerized by active energy irradiation.

Desirably, the polymerizable compound is a nonionic or cationic polymerizable compound, from the viewpoint of avoiding reaction with the aggregating agent and the pigment, or the polymer particles. Furthermore, water-soluble means that the compound can be dissolved to a prescribed concentration or above in water, and the compound should be dissolvable in an aqueous ink (and desirably in a uniform fashion). Furthermore, the compound can also be dissolved in the ink (desirably in a uniform fashion), by raising the solubility through the addition of a water-soluble organic solvent, which is described hereinafter. More specifically, the solubility of the compound with respect to water is desirably no less than 10 wt % and more desirably, no less than 15 wt %.

From the viewpoint of impeding reaction with the aggregating agent, the pigment and the polymer particles, the polymerizable compound is desirably a nonionic or cationic polymerizable compound and preferably is a polymerizable compound having a solubility with respect to water of no less than 10 wt % (and more desirably, no less than 15 wt %).

From the viewpoint of raising resistance to wear, the polymerizable compound of the present embodiment is desirably a polyfunctional monomer, preferably a bifunctional to a hexafunctional monomer, and from the viewpoint of achieving both solubility and wear resistance, a bifunctional to a tetrafunctional monomer.

It is possible to include only one type or a combination of two or more types of polymerizable compound.

The content of the polymerizable compound in the ink composition is desirably 30 to 300 wt % and more desirably 50 to 200 wt %, with respect to the total solid content of the pigment plus the self-dispersing polymer particles. If the content of the polymerizable compound is no less than 30 wt %, then the image strength is improved and excellent wear resistance of the image is obtained, whereas if the content is no more than 300 wt %, then an advantage is obtained in terms of pile height.

At least one of the ink composition and the treatment liquid includes an initiator which initiates polymerization of the polymerizable compound by the active energy irradiation.

<Initiator>

The ink composition according to the present embodiment can also contain at least one type of initiator which initiates polymerization of the polymerizable compound by an active energy irradiation, either in addition to the treatment liquid described below or in the absence of the treatment liquid. A photopolymerization initiator can be used, either one type only or a combination or two or more types, and can be used conjointly with a sensitizing agent.

The initiator can include a suitably selected compound which is capable of starting a polymerization reaction by application of an active energy; for example, it is possible to use an initiator (for example, a photopolymerization initiator) which creates an active species (radical, acid, base, or the like) upon application of radiation, light or an electron beam.

If an initiator is included, than the content of the initiator in the ink composition is desirably 1 to 40 wt %, and more desirably, 5 to 30 wt %, with respect to the polymerizable compound. If the content of the initiator is no less than 1 wt %, then the wear resistance of the image is further improved, which is advantageous in the case of high-speed recording, and if the content of the initiator is no more than 40 wt %, then an advantage in terms of ejection stability is obtained.

<Water-Soluble Organic Solvent>

The ink composition according to the present embodiment can include at least one type of water-soluble organic solvent. A water-soluble organic solvent can obtain beneficial effects in preventing drying, lubricating or promoting permeation. In order to prevent drying, the solvent is used as an anti-drying agent which prevents blockages caused by ink adhering to the ink ejection ports of the ejection nozzles and drying to form aggregate material, and in order to prevent drying and achieve lubrication, a water-soluble organic solvent having a lower vapor pressure than water is desirable. Furthermore, in order to promote permeation, the solvent can be used as a permeation promoter which raises the permeability of the ink into the paper.

A water-soluble organic solvent having a lower vapor pressure than water is desirable as an anti-drying agent.

It is possible to use only one type or a combination of two or more types of anti-drying agent. The content of the anti-drying agent is desirably in the range of 10 to 50 wt % in the ink composition.

A water-soluble organic solvent is suitable as a permeation promoter with the object of causing the ink composition to permeate more readily into the recording medium (printing paper, or the like). It is possible to use only one type or a combination of two or more types of permeation promoter. The content of the permeation promoter is desirably in the range of 5 to 30 wt % in the ink composition. Furthermore, the permeation promoter is desirably used in a weight range that does not cause image bleeding or print through.

<Water>

The ink composition includes water, but there are no particular restrictions on the amount of water. However, a desirable content of water is 10 to 99 wt %, more desirably, 30 to 80 wt %, and even more desirably, 50 to 70 wt %.

<Other Additives>

The ink composition of the present embodiment can be composed by using other additives apart from the components described above. The other additives may be commonly known additives, for example, an anti-drying agent (humidifying agent), an anti-fading agent, an emulsion stabilizer, a permeation promoter, an ultraviolet light absorber, an antibacterial agent, an antiseptic agent, a pH adjuster, a surface tension adjuster, an antifoaming agent, a viscosity adjuster, a dispersant, a dispersion stabilizer, an anti-rusting agent, a chelating agent, or the like.

Referring again to FIG. 3, in the image formation unit 116, when droplets of the corresponding colored ink are ejected from the inkjet heads 172M, 172K, 172C and 172Y toward the recording surface of the recording medium 124 which is held tightly on the image formation drum 170, the ink makes contact with the treatment liquid that has previously been deposited onto the recording surface by the treatment liquid deposition unit 114, the coloring material (pigment) dispersed in the ink is aggregated, and a coloring material aggregate is thereby formed. By this means, flowing of coloring material, and the like, on the recording medium 124 is prevented and an image is formed on the recording surface of the recording medium 124.

From the viewpoint of achieving high-definition images, the ink droplet volume ejected from the inkjet heads 172M, 172K, 172C and 172Y is desirably 1 to 10 pl (picoliters) and more desirably 1.5 to 6 pl. Furthermore, from the viewpoint of improving image non-uniformities and continuous tonal graduation, it is effective to eject a combination of droplets having different volumes, and the present embodiment is suitable for application to cases such as this.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

It is also possible to carry out image formation onto a recording medium 124 in a single pass by means of the image formation unit 116 composed as described above.

The recording medium 124 onto which the image has been formed in the image formation unit 116 is transferred from the image formation drum 170 to the drying drum 176 of the drying unit 118 through the intermediate conveyance unit (second transfer drum conveyance device) 128. The second transfer drum conveyance device 128 holds the leading end portion of the recording medium 124 received from the image formation drum 170, by means of the holding hook (not illustrated) and conveys the recording medium 124 with the recording surface of the recording medium 124 facing inward and the back surface side assuming a convex shape along the guide member 129.

The second intermediate conveyance unit 128 also has an internal hot air flow drying device (not illustrated), and blows a hot air flow onto the recording surface side of the recording medium 124 which faces toward the inside during the conveyance, thereby drying the ink droplets deposited on the surface of the medium. By this means, the ink can be dried immediately after deposition of the ink droplets, and therefore it becomes easier to reduce cockling of the recording medium 124 due to permeation of ink, and the occurrence of suction wrinkles due to holding by suction on the drying drum 176 in the drying unit 118 can be suppressed more readily.

The drying unit 118 is a mechanism which dries the water content included in the solvent separated by the coloring material aggregating action, and as shown in FIG. 3, the drying unit 118 is constituted of the drying drum 176 and the hot air flow drying device 182 in which a plurality of combinations of an IR heater, or the like, and a fan are arranged at positions opposing the outer circumferential surface of the drying drum 176. Furthermore, the air blowing device 180 (suction assistance device and leveling device) is arranged on the upstream side of the plurality of hot air flow drying devices 182 (in terms of the direction of the direction of rotation of the drying drum 176), so as to oppose the outer circumference of the drying drum 176.

Similarly to the treatment liquid drum 154, the drying drum 176 includes the hook-shaped holding device (gripper) 177 arranged on the outer circumferential surface of the drum, in such a manner that the leading end of the recording medium 124 can be held by the holding device 177. Furthermore, the drying drum 176 has the suction holes in the outer circumferential surface thereof and holds the recording medium 124 on the outer circumferential surface of the drying drum 176 by negative pressure so as to convey the medium while holding the medium tightly onto the drum. A hot air flow is directed from the hot air flow spraying nozzles of the hot air flow drying device 182 onto the recording medium 124 which has been held on the drying drum 176 in this way, thereby drying the recording medium 124.

By this means, the occurrence of cockling is prevented. Furthermore, by causing the recording medium 124 held tightly onto the outer circumferential surface of the drying drum 176, it is possible to prevent the occurrence of jams or paper burns caused by the recording medium 124 coming into contact with the hot air flow drying device 182.

The hot air flow spraying nozzles of the hot air flow drying device 182 are composed in such a manner that a hot air flow controlled to a prescribed temperature (for example, 50° C. to 70° C.) is blown at a prescribed air flow volume (for example, 12 $m^3$/min) onto the recording medium 124, and the IR heaters are controlled respectively to a prescribed temperature (for example, 180° C.). The water contained in the recording surface of the recording medium 124 held on the drying drum 176 is evaporated off by the hot air flow spraying nozzle and the IR heater, thereby performing a drying process. In this case, since the drying drum 176 of the drying unit 118 is structurally separate from the image formation drum 170 of the image formation unit 116, then it is possible to reduce ink ejection failures caused by drying of the head meniscus portion due to drying by heat in the inkjet heads 172M, 172K, 172C and 172Y. Furthermore, the temperature of the drying unit 118 can be set freely, and an optimal drying temperature can therefore be set.

Desirably, the evaporated moisture can be expelled to the exterior of the apparatus with the air by means of a discharging device, which is not illustrated. Furthermore, it is possible that the recovered air is cooled by a cooler (radiator), or the like, to recover the liquid therein.

Furthermore, the outer circumferential surface of the drying drum 176 is desirably controlled to a prescribed temperature. By heating from the back surface of the recording medium 124, drying is promoted and breaking of the image during fixing can be prevented. The range of the surface temperature of the drying drum 176 is desirably not lower than 50° C., and more desirably, not lower than 60° C. Furthermore, although there are no particular restrictions on the upper limit, from the viewpoint of the safety of maintenance work (preventing burns due to hot temperature), such as cleaning the ink adhering to the surface of the drying drum 176, an upper temperature limit of no higher than 75° C. is desirable.

Furthermore, desirably, the drying drum 176 is previously heated to a prescribed temperature before the recording medium 124 is conveyed. By previously heating the drying drum 176, it is possible to promote drying, and therefore breaking of the image is prevented and cockling can also be prevented. Desirably, the heating temperature is in the same range as the surface temperature of the drying drum 176.

In order to prevent temperature fall during suction, desirably, heating is performed at a prescribed temperature while sucking air. Furthermore, when heating without suction, it is desirable to perform heating to a higher temperature than the prescribed temperature, in order to account for the fall in temperature when suction is performed. Furthermore, by holding the recording medium 124 in such a manner that the recording surface thereof is facing outward on the outer circumferential surface of the drum (in other words, in a state where the recording surface of the recording medium 124 is curved in a convex shape), and drying while conveying the recording medium in rotation, it is possible to prevent the occurrence of wrinkles or floating up of the recording medium 124, and therefore drying non-uniformities caused by these phenomena can be prevented reliably.

Moreover, the drying drum 176 has the device for arranging the region of weakened suction force compared to the other portions, in a part of the circumferential direction of the outer circumferential surface, and this region is used to hold the recording medium 124 by suction stably without the occurrence of wrinkles. This is described below.

Figure 4:
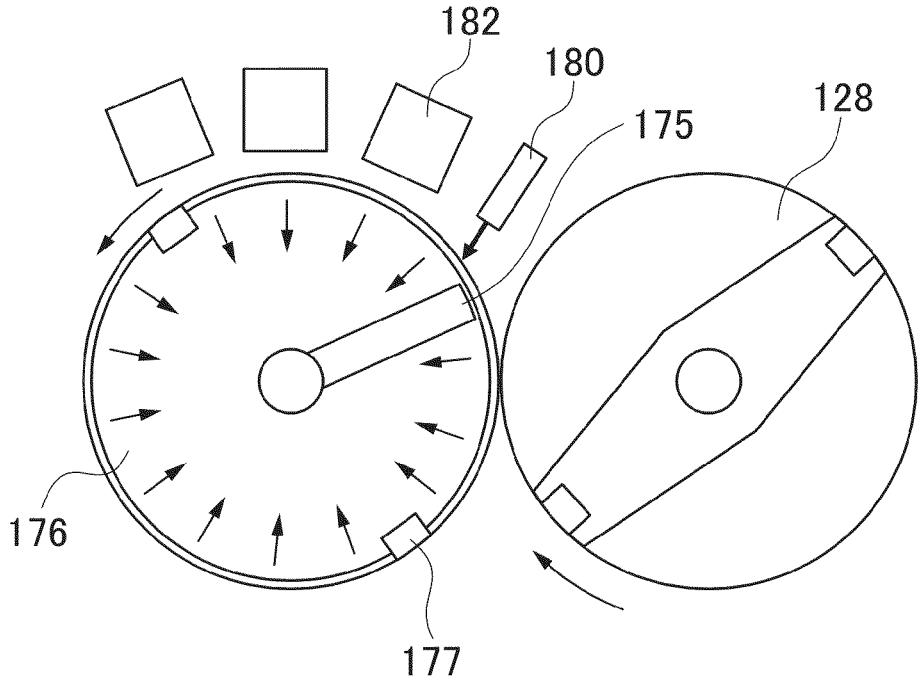
FIG. 4 is a schematic drawing showing an enlarged depiction of a portion of the drying drum.

FIG. 4 shows an enlarged view of the second transfer drum conveyance drum 128 and the drying drum 176.

As stated previously, the drying drum 176 holds the recording medium 124 (not shown here) that has been transferred from the second transfer drum conveyance device 128, by means of the holding device 177, and the recording medium 124 is dried by the hot air flow drying device 182 while the recording medium 124 is conveyed in rotation by being held by suction onto the outer circumferential surface of the drying drum 176 due to the peripheral air being sucked inside the drum through the suction holes (not shown) as indicated by the arrow in FIG. 4.

In this case, the device is provided for forming the region having a weaker suction force than the other portions throughout the whole width of the drum, in a portion of the circumferential direction of the drying drum 176. In the present embodiment, the device for forming the region having the weaker suction force than the other portions is constituted of a shielding device 175, which shuts off the suction holes formed in the outer circumferential surface of the drying drum 176 from the inside of the drum.

The shielding device 175 is fixed inside the drying drum 176 (to the rotational axis of the drying drum 176, for example), and a front end face formed on the front end portion thereof has a shape which follows the inner circumferential surface shape of the drying drum 176 in such a manner that the suction holes in the portion which overlaps with this front end face are closed off. The recording medium 124 cannot then be held by suction through the suction holes which are being closed off by the front end face, and the portion corresponding to the front end face of the shielding device 175 forms the region having weaker suction force than the other portions.

In the region of weaker suction force, the suction of the recording medium 124 on the drying drum 176 is temporarily released, and therefore the recording medium 124 floats up slightly from the outer circumferential surface of the drying drum 176 and a space capable of accommodating wrinkles is formed between the recording medium 124 and the outer circumferential surface of the drying drum 176. Since the shielding device 175 is fixed in place, then as the drying drum 176 rotates, the region of weaker suction force moves relatively toward the trailing end side of the recording medium 124 and finally exits from the trailing end of the recording medium 124. By this means, it is possible to remove wrinkles which have occurred in the recording medium 124.

Furthermore, an air flow is emitted from the air blowing device 180 on the downstream side of the region of weaker suction force (in terms of the direction of rotation of the drying drum 176) and this air flow more reliably moves the space formed between the recording medium 124 and the outer circumferential surface of the drying drum 176 toward the trailing end side of the recording medium 124, in such a manner that wrinkles in the recording medium 124 are smoothened out.

Figure 5:
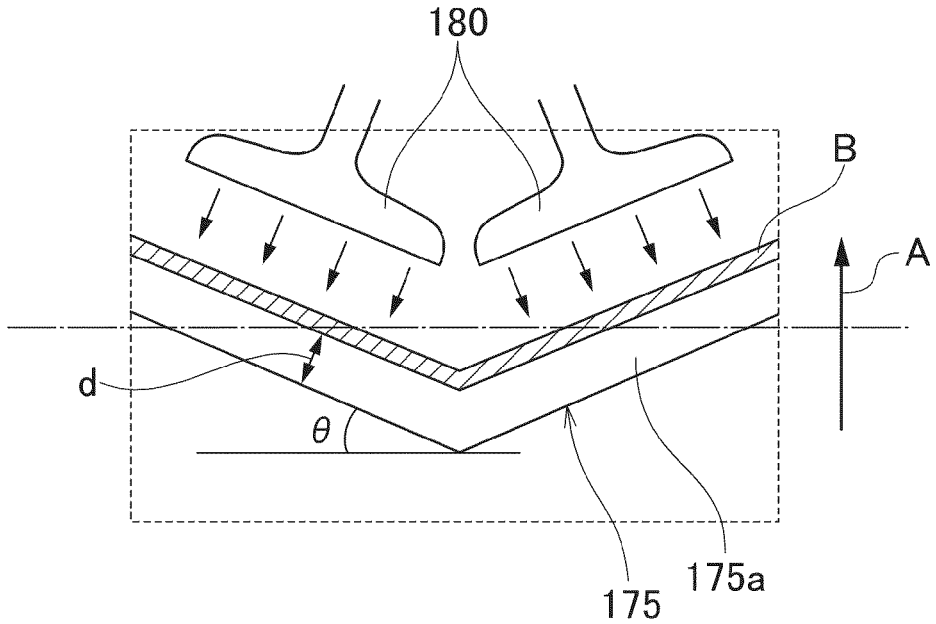
FIG. 5 is an illustrative diagram showing a region where the suction force is weakened and an air blowing region on the outer circumferential surface of the drying drum.

FIG. 5 shows a plan view of the vicinity of the region of weaker suction force described above, as observed from the outer circumferential surface of the drying drum 176. The horizontal direction in FIG. 5 corresponds to the lengthwise direction of the drying drum 176, and the direction of arrow A is the direction of rotation of the drying drum 176 (the direction of conveyance of the recording medium 124). As shown in FIG. 5, the front end face 175*a* of the shielding device 175 forms a wide V-shape, and the central portion of the recording medium 124 conveyed in the direction of arrow A firstly comes to the region of weaker suction force initially, whereupon the widthwise sides of the recording medium 124 gradually come to the region of weaker suction force.

In this case, an air flow is blown from the air blowing device 180 onto the region B hatched with oblique lines in FIG. 5. By this means, air is gradually blown from the central portion of the space formed between the recording medium 124 and the outer circumferential surface of the drying drum 176 (the wrinkle accommodational space) toward either widthwise side, in substantially the same shape as the V-shaped form of the front end face 175*a* of the shielding device 175. By this means, with the conveyance of the recording medium 124, the wrinkle accommodational space is moved reliably toward the trailing end side and finally exits from the trailing end of the recording medium 124, thereby removing the wrinkles from the recording medium.

The shielding device 175 shuts off the suction force by closing off the suction holes arranged in the outer circumferential surface of the drying drum 176 by means of the front end face 175*a* thereof. Since the drying drum 176 rotates while the shielding device 175 is fixed, then a slight gap exists in any case between the shielding device 175 and the inner circumferential surface (the back surface of the outer circumferential surface) of the drying drum 176 and the suction holes are not closed off completely; however, it is sufficient for the shielding device 175 to be capable of making the suction force weaker than in the other portions even if the suction holes are not closed completely. The shielding device 175 brings the wrinkles in the recording medium 124 toward the region of weaker suction force, moves the wrinkles relatively to the recording medium 124, and ultimately removes the wrinkles by causing them to exit from the trailing end side of the recording medium 124.

As shown in FIG. 5, the region of weaker suction force is formed by the front end face 175*a* of the shielding device 175, has the same width d throughout the entire width direction of the drying drum 176 and is formed in a V shape. Desirably, the width d is 10 mm to 200 mm. This is because crease folds occur if the width d is too narrow. Furthermore, if the width d is, conversely, too wide, then suction defects arise in the trailing end portion of the recording medium 124 and floating of the recording medium 124 occurs. The width d varies with the size and thickness of the recording medium 124, and it is preferable that the width d is approximately 25% of the length of the recording medium 124.

Furthermore, it is preferable that the aforementioned V shape has a relatively broad opening. For example, it is preferable that the angle θ shown in FIG. 5 is no more than around 20 degrees.

In the embodiment described above, the device for weakening the suction force involves closing off the suction holes by means of the shielding device 175; however, the device for weakening the suction force is not limited to this. For example, it is also possible to provide a shutter in the suction holes of the drying drum 176 and to weaken the suction force by controlling the opening and shutting of this shutter. In a case where a composition of this kind is adopted, it is possible to achieve fine adjustment of the suction force by altering the number of suction holes which are closed off (the closing ratio per unit surface area).

Furthermore, as a further embodiment of a device for weakening the suction force, the suction region of the suction face formed on the outer circumferential surface of the drying drum 176 is divided into a plurality of areas in the conveyance direction, flow channels connecting respectively from the divided areas to the suction force generating device (vacuum pump, etc.) are arranged, and the region of weaker suction force is moved progressively as the drying drum 176 rotates by controlling the suction force in each of the divided areas at a prescribed timing. This is described more specifically below with reference to FIGS. 6A and 6B.

Figure 6A:
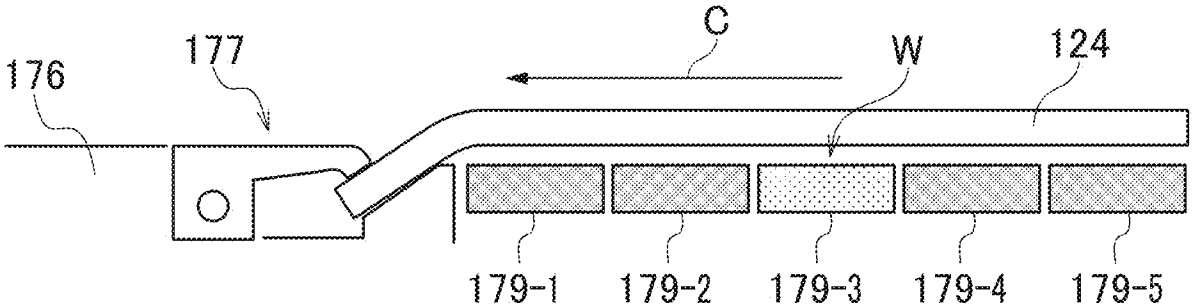
FIGS. 6A and 6B are enlarged cross-sectional diagrams showing a region where the suction force is weakened on the outer circumferential surface of the drying drum.
Figure 6B:
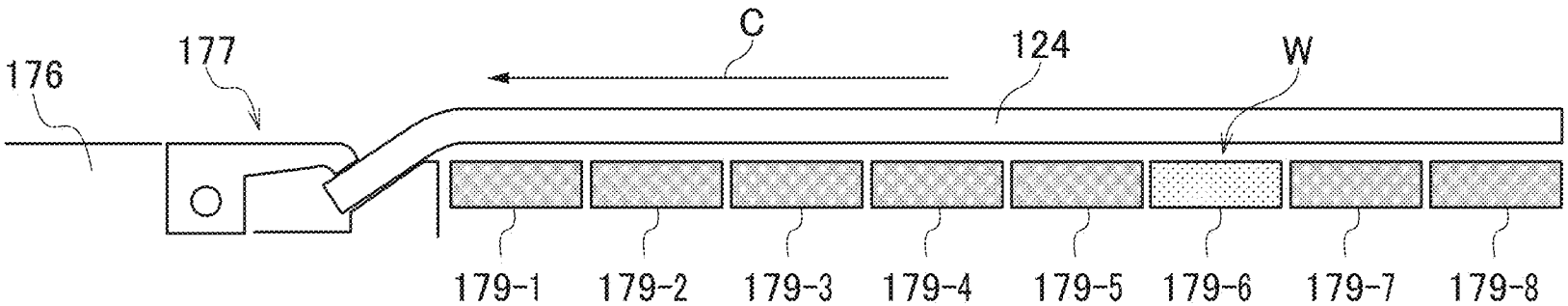

FIGS. 6A and 6B are cross-sectional diagrams showing an enlarged view of a portion of the outer circumferential surface of the drying drum 176. As shown in FIGS. 6A and 6B, the recording medium 124 is conveyed in the direction of arrow C in the drawings by means of the leading end portion being held by the holding device 177. In this case, a plurality of suction holes (not illustrated) are arranged in the outer circumferential surface following the holding device 177, in such a manner that the recording medium 124 is held by suction on the outer circumferential surface.

Here, the suction regions formed by the suction holes are divided into a plurality of regions in the conveyance direction and the respective divided regions 179-1, 179-2, 179-3, 179-4, 179-5, and so on, are connected to the suction force generating device (not illustrated) through flow channels, in such a manner that the suction force can be controlled respectively and independently in the divided regions. For example, a valve is arranged in the flow channel of each divided region, and control is implemented by reducing the suction flow volume or shutting off the flow channel, or the like.

During suction holding conveyance, at the timing $t=t_0$, for example, as shown in FIG. 6A, the suction force of the divided region 179-3 is weakened, thereby making this divided region 179-3 a weaker suction force region W. Furthermore, at the timing $t=t_1$ after $t=t_0$, as shown in FIG. 6B, the suction force in the divided region 179-6 is weakened in such a manner that this region becomes the weaker suction force region W.

In this way, by dividing the suction region of the outer circumferential surface of the drying drum 176 into the divided regions in the conveyance direction, and causing the region of weakened suction force of the divided regions to move successively to the upstream side in the conveyance direction, as the drying drum 176 hold by suction and conveys the recording medium 124, then it is possible to obtain similar beneficial effects to the embodiment described with reference to FIG. 4.

It is preferable that each divided region is formed throughout the entire width direction of the drying drum 176, and each divided region has a V-shaped form as shown in FIG. 5, or a U-shaped form as being obtained by rounding the apex of the V-shaped form.

Furthermore, the air blowing device 180 (smoothening device) disposed on the upstream side of the hot air flow drying device 182 is arranged in order to remove suction wrinkles by blowing air onto the upstream side of the region where the suction force is weakened by the shielding device 175 and causing the space capable of accommodating wrinkles in the recording medium 124 to move relatively toward the trailing end side of the recording medium 124, and by this means, uniform drying and uniform suction are possible. In this way, the air blowing device 180 serves as the smoothening device and the suction assistance device. Suction is assisted in this way by means of the air blowing device 180 which employs a non-contact method, because assisting suction by means of a contact-based device causes undried ink to be transferred to the contact device and thus leads to image defects.

As shown in FIG. 5, for example, the air blowing device 180 blows air in an oblique direction toward the trailing end side of the recording medium 124, and causes the air flow to strike obliquely against the end portions of the width direction of the recording medium 124, as well as being controlled in such a manner that the air flow force is greater at the trailing end of the recording medium 124. By this means, floating up of trailing end of the recording medium 124 is prevented, as well as removing suction wrinkles in the recording medium 124 and enabling uniform drying and uniform suction.

Figure 7:
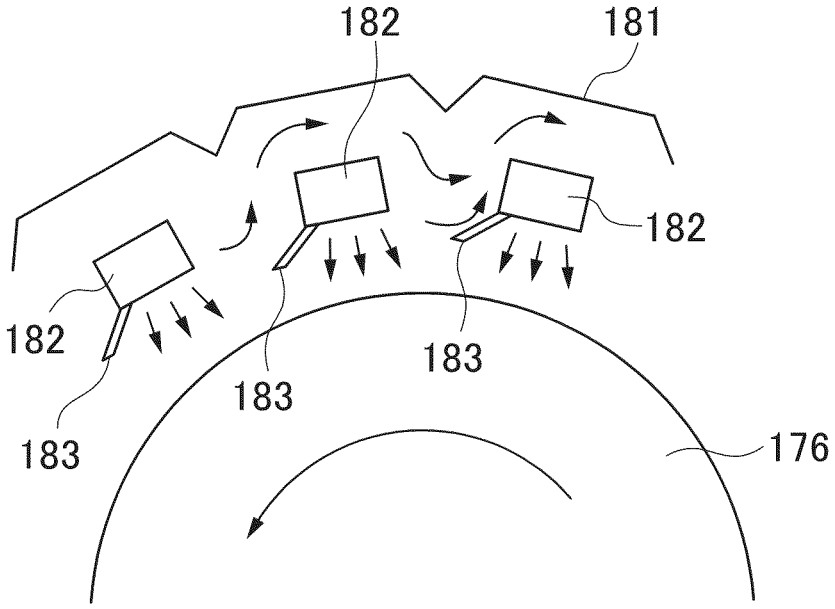
FIG. 7 is a schematic drawing showing an enlarged depiction of a portion of the drying drum where a hot air flow drying device is arranged.

Moreover, as shown in FIG. 7, it is also possible to arrange a flow regulating plate 181 in the drying unit 118 in such a manner that the hot air flow from the hot air flow drying devices 182 can be reused. The flow regulating plate 181 is formed so as to cover the upper sides of the hot air flow drying devices 182, and also so as to direct the hot air flow blown out from the hot air flow drying device 182 back toward the drying drum 176. By arranging the flow regulating plate 181 in this way, the thermal efficiency is improved and improvement in air exhaust properties can also be achieved. In this case, it is preferable that a guide plate 183 is also arranged on the downstream side of each hot air flow drying device 182 in terms of the direction of rotation of the drying drum 176, and the hot air flows which have been blown out from the respective hot air flow drying devices 182 and have struck the surface of the drying drum 176 travel as indicated by the arrows in FIG. 7 so as to flow back toward the drying drum 176 again.

The recording medium 124 on which the drying process has been carried out in the drying unit 118 is transferred from the drying drum 176 to the fixing drum 184 of the fixing unit 120 through the intermediate conveyance unit 130.

The recording medium 124 is conveyed by means of the leading end portion thereof being held by the holding hook (not illustrated) of the third transfer drum conveyance device 130 (transfer conveyance device), in such a manner that the recording surface is facing inward and the back surface side assumes a convex shape along the guide member 131, with the trailing end of the recording medium 124 in a free state.

More specifically, in the third drum conveyance device 130 (transfer conveyance device), the recording medium 124 is not held by suction and therefore the holding of the recording medium 124 that has been dried while being conveyed in the suction held state on the drying drum 176 in the drying unit 118 is temporarily released and the recording medium 124 is bent and corrected in the opposite direction, thus flattening the recording medium 124 and preventing the occurrence of curl.

Furthermore, the third intermediate conveyance unit 130 also has an internal hot air flow drying device (drying device), which is not illustrated, and blows a hot air flow onto the recording surface side of the recording medium 124 which faces toward the inside during conveyance, thereby drying the ink which has been deposited on the surface of the medium. By this means, it is possible to homogenize drying non-uniformities caused by the suction holes of the drying drum 176 in the drying unit 118, and the like.

The hot air flow drying device arranged inside the third transfer conveyance device 130 can also be an air blowing device of which the temperature is set to be lower than the hot air flow drying device 182 of the drying unit 118, thereby lowering power consumption.

The recording medium 124 thus dried is transferred onto the fixing drum 184 of the fixing unit 120 by the third transfer drum conveyance device 130. The fixing unit 120 cures the ink deposited on the recording surface of the recording medium 124 by means of the ultraviolet light source 190 (ultraviolet irradiation device).

Upon receiving the recording medium 124 from the third transfer drum conveyance device 130, the fixing drum 184 holds the leading end portion of the recording medium 124 by means of the hook-shaped holding device 185 arranged on the outer circumferential surface of the fixing drum 184, and conveys the recording medium 124 in a suction held state on the outer circumferential surface of the fixing drum 184 with the recording surface of the recording medium 124 facing outward, by holding the back surface side of the recording medium 124 by suction through the suction holes formed in the outer circumferential surface of the fixing drum 184. The recording medium 124 is conveyed by holding the leading end thereof with the hook-shaped holding device 185 in this way, in order to stabilize conveyance and ensure the positional accuracy of the paper, for instance, by reducing the rate of paper jams. Moreover, by fixing the recording medium 124 in the suction held state on the outer circumferential surface of the fixing drum 184, contraction of the ink upon fixing by ultraviolet light is prevented, as well as being able to prevent the occurrence of deformation, such as undulations or contraction of the recording medium 124. Furthermore, the direction of curl of the whole sheets of paper is the same (the recording surface side of the recording medium 124 assumes a concave shape) and therefore stacking properties are improved. As a method of holding the recording medium 124 onto the outer circumferential surface of the fixing drum 184, it is also possible to use an electrostatic method instead of the suction method described above, but the suction method is preferable due to having general compatibility with various thicknesses of recording media 124.

The ultraviolet light source 190 (ultraviolet irradiation device) is not limited in particular, and can employ, for example, a metal halide lamp, a high-pressure mercury vapor lamp, a black light, a cold cathode tube, a UV-LED, or the like. Due to problems of heat generation, it is desirable to use a light source in which UV-LEDs are arranged in the width direction of the recording medium 124 conveyed. The peak wavelength of the ultraviolet light irradiated by the ultraviolet light source 190 depends on the absorption characteristics of the ink composition, and is desirably 200 to 600 nm, more desirably, 300 to 450 nm, and even more desirably 350 to 450 nm. The irradiation energy of the ultraviolet light source 190 is desirably no more than 2000 mJ/cm$^2$, more desirably, 10 to 2000 mJ/cm$^2$, and even more desirably, 20 to 1000 mJ/cm$^2$, and especially desirably, 50 to 800 mJ/cm$^2$. Furthermore, in the inkjet recording apparatus according to the present embodiment, the ultraviolet light is irradiated onto the recording surface of the recording medium for, desirably, 0.01 to 10 seconds, and more desirably, 0.1 to 2 seconds.

If a metal halide lamp or a high-pressure mercury vapor lamp, or the like, is used as the ultraviolet light source 190, then since these lamps are always on when the power supply is switched on, it is desirable to provide a shutter on the front face of the lamp so that the light is shut off by closing the shutter when no recording medium is passing, and the shutter is opened when a recording medium is passing, thereby avoiding fixing non-uniformities which are caused by instability in the amount of light due to the start-up of the lamps.

On the other hand, if LEDs are used as the ultraviolet light source 190, it is preferable that the LEDs are lighted up only when the recording medium is passing, so that it is possible to lower power consumption and reduce the amount of heat generated.

If using UV-LEDs for the ultraviolet light source 190, the distance between the light source and the surface of the recording medium 124 is set to a short distance of 1 mm to 5 mm, for example, due to the irradiated light quantity, and if there is floating or curling of the recording medium 124, then the recording medium 124 may contact the light source and give rise to a conveyance jam. Therefore, it is desirable that the recording medium 124 be conveyed in the suction held state on the outer circumferential surface of the fixing drum 184, as stated previously.

Furthermore, if a plurality of LEDs are arranged, then the positions thereof are made to coincide with the positions of the suction holes in the drying drum 176. This is in order to reduce non-uniformity that occurs between the portions of the recording medium 124 having coincided with the suction holes on the drying drum 176 and the portions of the recording medium 124 not having coincided with the drying suction holes, since the portions having coincided with the suction holes contain a large amount of water. In other words, by making the arrangement positions of the LEDs coincide with the positions of the suction holes of the drying drum 176, the amount of light irradiated onto the portions of the recording medium 124 having coincided with the suction holes on the drying drum 176 is made greater and therefore non-uniformities caused by the suction holes are diminished.

Figure 8:
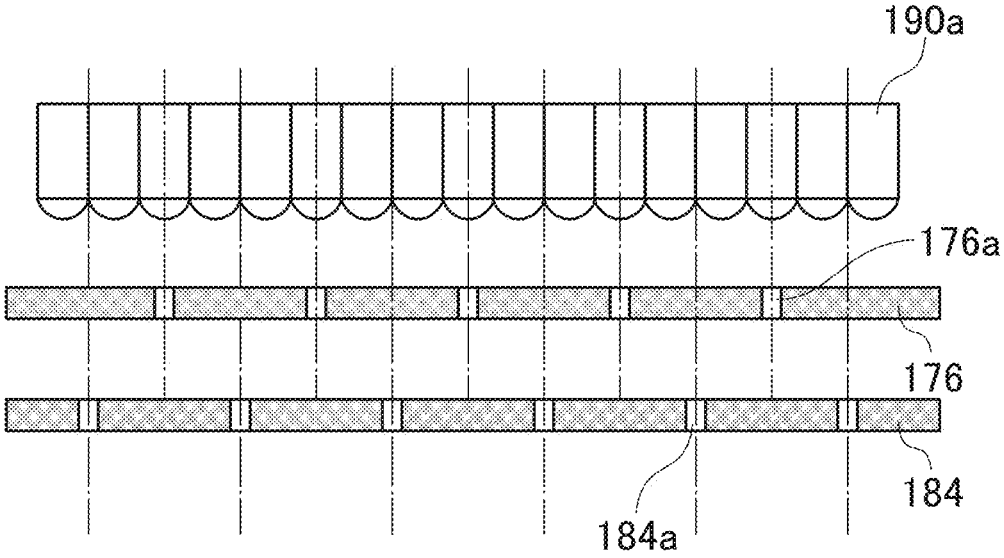
FIG. 8 shows a cross-sectional diagram of the relationship between the positions of the LEDs, the positions of the suction holes of the drying drum and the positions of the suction holes of the fixing drum.

Moreover, the positions of the suction holes on the fixing drum 184 are staggered with respect to the positions of the plurality of LEDs arranged in the ultraviolet light source 190. FIG. 8 shows a cross-sectional diagram of the relationship between the positions of the LEDs, the positions of the suction holes of the drying drum 176 and the positions of the suction holes of the fixing drum 184.

In order to enable a comparison of the positions with reference to the holding devices 177 and 185, FIG. 8 shows side-by-side sectional views of the LEDs 190*a* which constitute the ultraviolet light source 190 arranged opposing the fixing drum 184 (not illustrated), the suction holes 176*a* which are formed in the outer circumferential surface of the drying drum 176, and the suction holes 184*a* which are formed in the outer circumferential surface of the fixing drum 184, when their respective holding devices 177 and 185 (not illustrated in FIG. 8) are coinciding in position.

As shown in FIG. 8, the positions of the suction holes 176*a* of the drying drum 176 and the positions of the LEDs 190*a* coincide with each other. Furthermore, the positions of the suction holes 176*a* in the drying drum 176 and the positions of the suction holes 184*a* in the fixing drum 184 are staggered with respect to each other.

Furthermore, although not shown in FIG. 8, the positions of the holding devices 177 and 185 are aligned and therefore the suction holes 176*a* and 184*a* in the drying drum 176 and the fixing drum 184 are arranged at different positions (distances) from the respective holding devices 177 and 185.

Therefore, the positions where the recording medium 124 is held by suction differ between when the recording medium 124 is held by the holding device 177 of the drying drum 176 and when the recording medium 124 is held by the holding device 185 of the fixing drum 184. If the same positions on the recording medium 124 are held by suction at all times, then fixed depression shapes caused by suction arise, but by ensuring that the positions where the recording medium 124 is held by suction are varied between the respective drums in this way, it is possible to prevent non-uniformity caused by the creation of fixed depression shapes in the fixing unit 120, and traces of the suction holes 184*a* of the drying drum 176 are not left in the recording medium 124 after fixing in the fixing unit 120.

By varying the positions (distances) from the holding devices 177 and 185 of the suction holes 176*a* and 184*a* in the drying drum 176 and the fixing drum 184, the suction holes 176*a* and the suction holes 184*a* hold the recording medium 124 by suction at respectively different positions, thus obtaining a beneficial effect of preventing non-uniformities. This should not be considered only between the two drums 176 and 184, but rather it is desirable to take account of the image formation drum 170 (and also the treatment liquid drum 154 if this has suction holes) and therefore the respective suction holes of the image formation drum 170, the drying drum 176 and the fixing drum 184 are arranged at mutually different positions from the holding devices 155, 177 and 185 arranged on the respective drums.

By this means, when the recording medium 124 is held by suction through the suction holes of the respective drums, since the positions held by suction are mutually different, then it is possible to avoid suction traces from being left in the recording medium 124, as well as being able to prevent non-uniformities caused by suction.

Figure 9A:
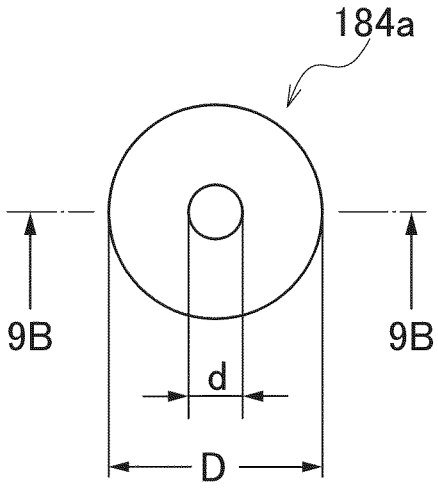
FIG. 9A is a plan diagram showing the shape of suction holes in a fixing drum.
Figure 9B:
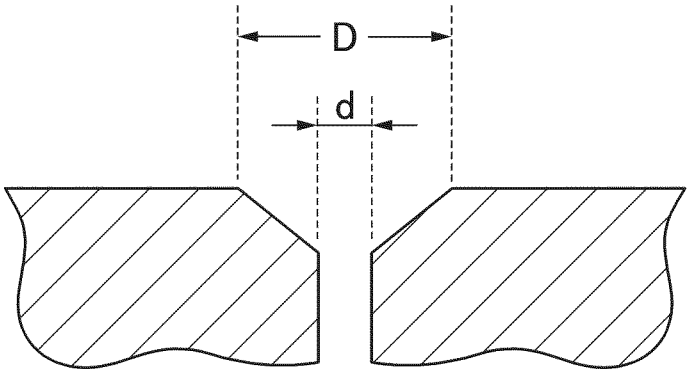
FIG. 9B is a cross-sectional diagram along line 9B-9B in FIG. 9A.

FIG. 9A shows a plan diagram of the suction hole 184*a* in the fixing drum 184, and FIG. 9B shows a cross-sectional diagram along 9B-9B in FIG. 9A.

As shown in FIGS. 9A and 9B, the suction holes 184*a* in the fixing drum 184 have a tapered cross-sectional shape. This is in order to make non-uniformities hard to perceive by eliminating extreme distribution of reflected light between the portions where the suction holes 184*a* are present and the portions where no suction holes 184*a* are present, on the outer circumferential surface of the fixing drum 184.

Furthermore, the light from the LED light source strikes the recording medium 124 from an oblique direction rather than being irradiated perpendicularly onto the recording medium 124. By this means, it is possible to reduce irradiation non-uniformities due to the suction holes 184*a* in the fixing drum 184.

As regards the size of the suction holes 184*a*, desirably, the taper diameter D of the suction holes 184*a* is larger than the diameter of the LEDs, and the diameter d of the inner straight portion is equal to or less than the diameter of the LEDs. Consequently, non-uniformities are not liable to occur.

Moreover, since the amount of curing contraction upon fixing is smaller than the amount of contraction occurring upon drying, it is desirable if the opening ratio of the suction holes 184*a* of the fixing drum 184 (the opening surface area per unit surface area) is smaller than the opening ratio of the suction holes 176*a* of the drying drum 176, since this makes processing easier.

It is preferable that the outer circumferential surface and the tapered sections of the fixing drum 184 have a rough surface treatment rather than a mirror surface. By this means, it is possible to reduce fixing non-uniformities caused by diffusion of the reflected light.

Moreover, it is also possible to arrange a plurality of ultraviolet light sources 190 (ultraviolet light irradiation sources) as shown in FIG. 3, for example. If the plurality of ultraviolet light sources are arranged, then it is possible to create suitable curing conditions by prolonging the irradiation time while reducing the irradiation intensity of each irradiation device, and as well as lowering costs, the amount of heat generated by the ultraviolet light irradiation devices can be reduced. Problems of reduced lifespan due to heat generation occur in the ultraviolet light irradiation device, and therefore it is desirable to arrange a water or air-based cooling device in the ultraviolet light irradiation device.

Furthermore, the fixing drum 184 includes the pressing roller 188 for smoothening the recording medium 124. The recording medium 124 conveyed by being held on the outer circumferential surface of the fixing drum 184 is pressed by the pressing roller (smoothening device) 188 arranged so as to oppose the fixing drum 184, and curl is corrected while wrinkles are removed by means of the recording medium 124 being pressed against the fixing drum 184.

More specifically, the pressing roller 188 is disposed so as to press against the fixing drum 184, in such a manner that a nip is created between the fixing roller and the fixing drum 184. By this means, the recording medium 124 is sandwiched between the pressing roller 188 and the fixing drum 184 and is nipped with a prescribed nip pressure (for example, 0.15 MPa), whereby a smoothening process is carried out.

Furthermore, the pressing roller 188 can also be a heated roller. For example, the fixing roller 188 is constituted of a heated roller formed by a metal pipe of aluminum, or the like, having good thermal conductivity, which internally incorporates a halogen lamp, and is controlled to a prescribed temperature (for example, 60° C. to 80° C.). By heating and also pressing the recording medium 124 by the pressing roller 188 which is constituted as the heated roller in this way, thermal energy of no less than the Tg temperature (glass transition temperature) of the latex contained in the ink is applied, the latex particles are melted, undulations in the image surface of the recording medium 124 are leveled, and lustrous properties are obtained.

It is possible that the surface temperature of the fixing drum 184 is set to be no lower than 50° C., and the recording medium 124 held on the outer circumferential surface of the fixing drum 184 is heated from the back surface. By this means, drying of the recording medium 124 is ensured, breaking of the image during fixing can be prevented, and it is also possible to raise the image strength due to the effects of the raised temperature of the image.

As described above, in the present embodiment, the recording medium 124 after formation of an image thereon is held by suction on the drying drum 176 and dried by the hot air flow while being conveyed in the held state, whereupon the recording medium 124 is conveyed on the third transfer drum conveyance device 130 without being held by suction, in other words, while temporarily releasing the suction holding of the recording medium 124, and while being bent in the opposite direction to the drying drum 176 so that the back surface side (reverse to the recording surface side) of the recording medium 124 assumes a convex shape. The recording medium 124 is then smoothened by the pressing roller 188 in the fixing unit 120 and the ink is then fixed by ultraviolet light curing, and therefore the occurrence of cockling can be suppressed and furthermore it is possible to form an image of high definition and high quality without wrinkles or curl and without the occurrence of image non-uniformities, such as fixing non-uniformities or luster non-uniformities.

The suction surface of the suction drum is described in detail below.

The suction force of the suction surface can be expressed as "opening surface area"×"pressure per unit surface area". The suction force can be raised further by increasing the surface area occupied by the suction holes in the recording medium suction holding region, in other words, by raising the opening ratio.

FIGS. 10A to 10G include diagrams showing the arrangement of suction holes on the suction surface and distribution diagrams of the opening ratio in the width direction of the recording medium (in X-X line) and the conveyance direction (in Y-Y line). In FIGS. 10A to 10G, the Y direction is the conveyance direction of the recording medium and the X direction is the width direction of the recording medium.

Figure 10A:
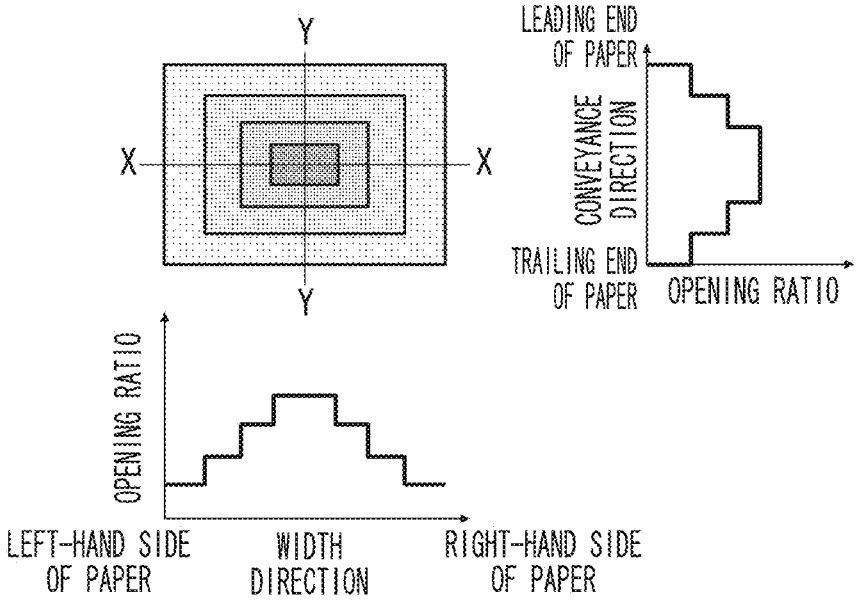
FIGS. 10A to 10G show diagrams of the arrangements of suction holes on the suction surface and distribution diagrams of the opening ratio.
Figure 10B:
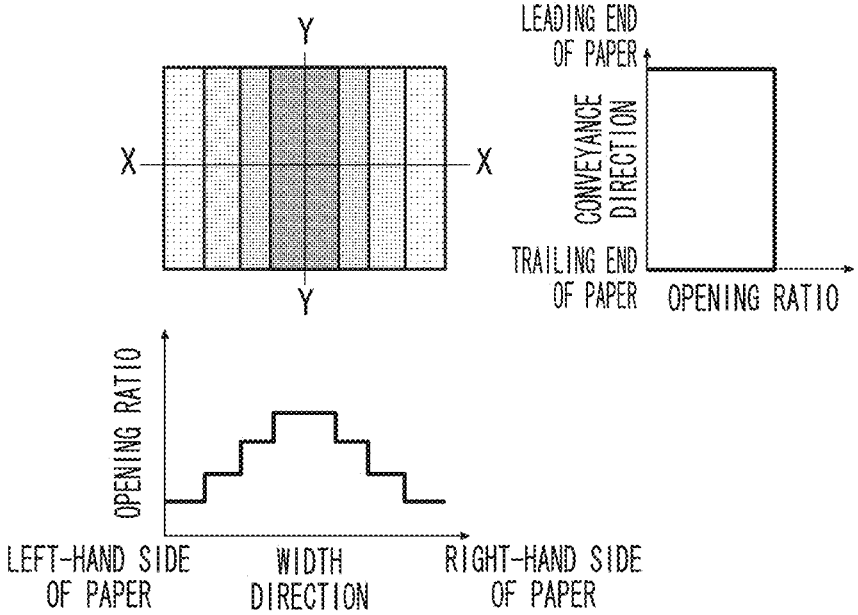
Figure 10C:
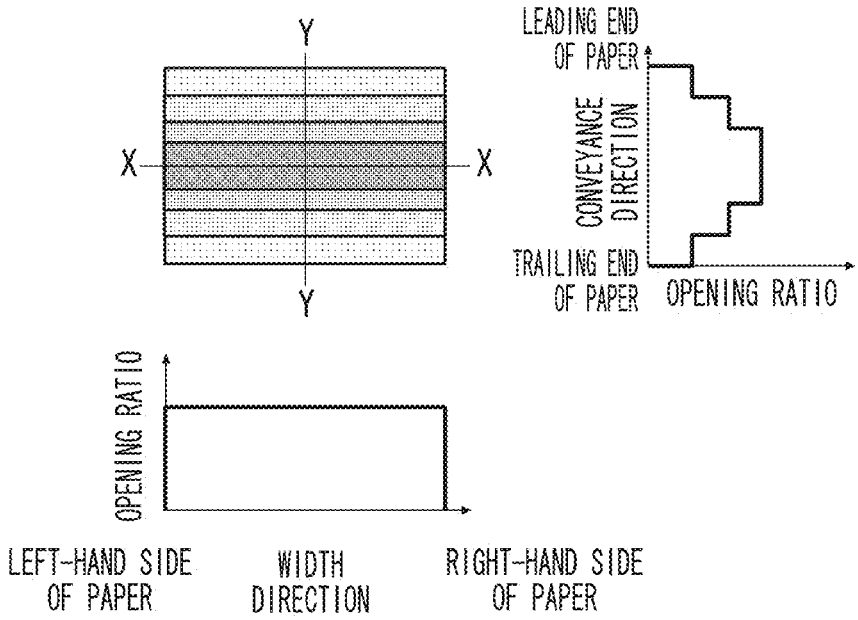

FIG. 10A is the diagram showing a case where prescribed regions have respectively uniform intervals between the suction holes, and the opening ratio decreases in stepwise fashion from the central portion toward the end portions of the suction surface. Similarly, FIG. 10B shows the diagram where the opening ratio is uniform in the conveyance direction of the recording medium and the opening ratio decreases in stepwise fashion in the width direction of the recording medium. FIG. 10C is the diagram of a case where the opening ratio is uniform in the width direction of the recording medium and the opening ratio decreases in stepwise fashion from the central portion of the suction surface toward the upstream side and the downstream side of the conveyance direction.

Since cockling formed in the central portion can be dispersed to the end portions by decreasing the opening ratio from the central portion of the suction surface toward the end portions, then it is possible to make the cockling inconspicuous.

Furthermore, desirably the opening ratio is highest and has a uniform value in the central portion of 10 to 70% of the suction surface. By making the opening ratio higher in the central portion, the growth of cockling concentrated in the central portion is suppressed and cockling can be dispersed to the end portions.

Figure 10D:
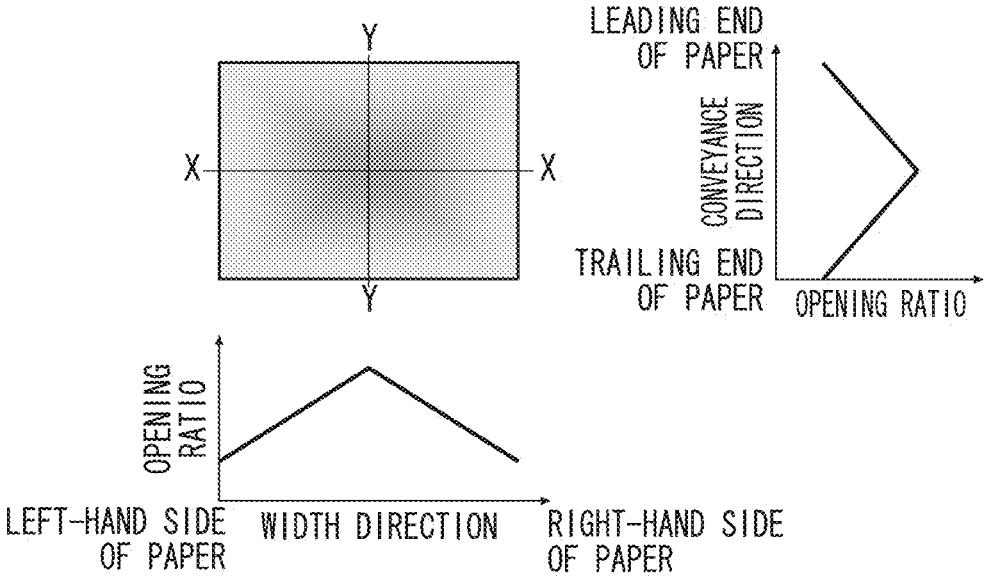
Figure 10E:
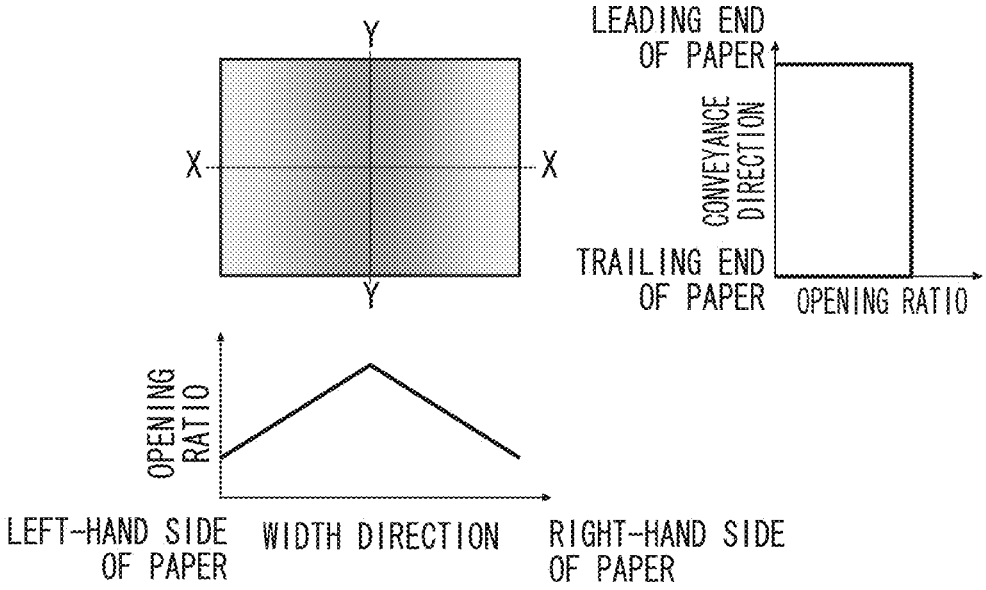
Figure 10F:
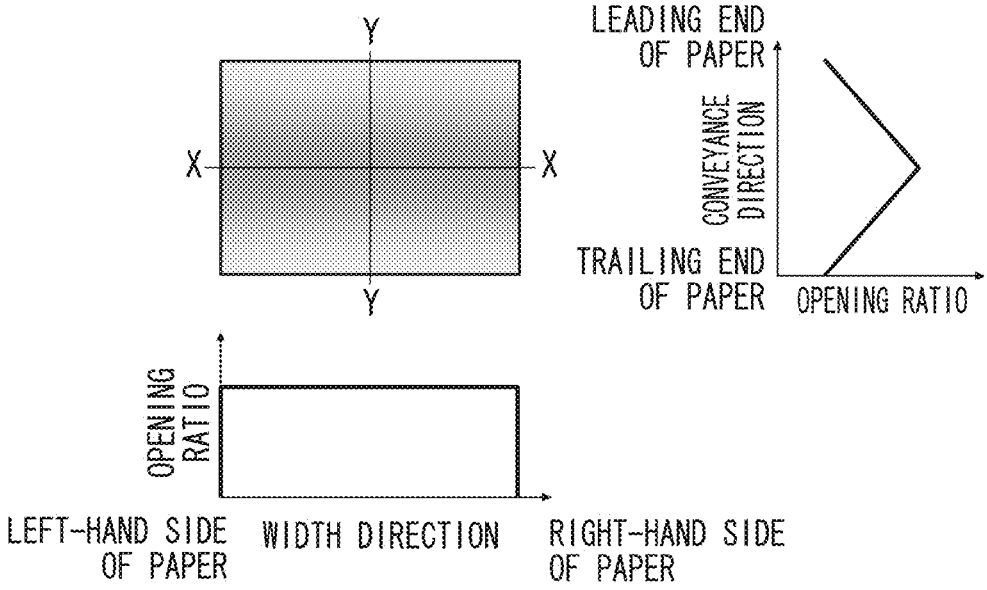

FIG. 10D shows a case where the interval between the suction holes gradually increases from the central portion toward the end portions of the suction surface, and the opening ratio decreases linearly from the central portion toward the end portions. In FIG. 10E, the interval between the suction holes in the conveyance direction is uniform, and the opening ratio is decreased by increasing the interval between the suction holes in the width direction of the recording medium. FIG. 10F is the diagram of a case where, conversely to the arrangement in FIG. 10E, the interval between the suction holes in the width direction is uniform, and the opening ratio is decreased linearly by increasing the interval between the suction holes gradually from the central portion toward the upstream side and the downstream side in the conveyance direction. Similarly to FIGS. 10A to 10C where the opening ratio is decreased in stepwise fashion, it is possible to obtain the same effects in FIGS. 10D to 10G where the opening ratio is decreased linearly.

Figure 10G:
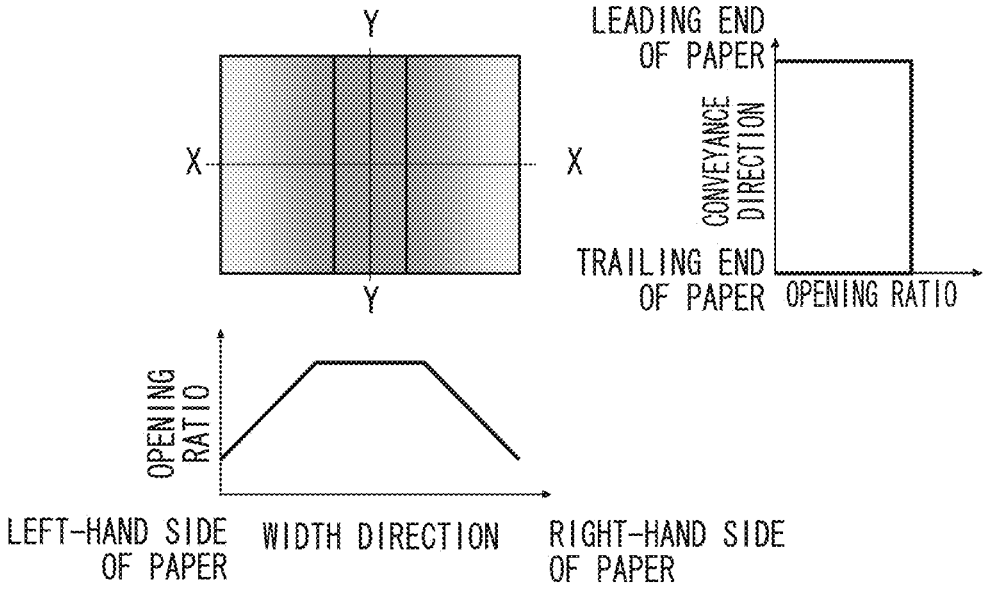

Furthermore, FIG. 10G shows the case where the opening ratio is uniform in the central portion in the width direction of the recording medium, modified from the arrangement of the suction holes shown in FIG. 10E. In this way, by adopting a uniform opening ratio in the central portion, it is possible to ensure sufficient suction force in the central portion, and cockling which arises in the central portion of the recording medium can be suppressed.

The opening ratio with respect to a unit surface area of 1 $cm^2$ of the suction surface is desirably no less than 1% and no more than 75%, and more desirably, no less than 1% and no more than 50%. By setting the opening ratio to the range described above, it is possible to suppress cockling and to improve drying performance. If the opening ratio is less than 1%, then it is not possible to adequately suppress swelling deformation of the recording medium caused by absorption of water after recording. On the other hand, if the opening ratio exceeds 75%, then the contact surface area between the back surface of the recording medium and the holding surface of the conveyance body decreases, and therefore it is not possible to obtain sufficient drying performance when the medium is in a state of being held by suction. Moreover, since drying does not progress, then cockling also tends to become worse.

More desirably, in the central portion of the suction surface, the opening ratio is no less than 10% and no more than 75%, and even more desirably, no less than 20% and no more than 75%. Furthermore, desirably, in the end portions of the suction surface, the opening ratio is no less than 1% and no more than 50%, and more desirably, no less than 1% and no more than 30%.

The opening ratio can be controlled by means of the diameter, interval, shape and arrangement of the suction holes. The hole diameter is desirably not smaller than 0.4 mm in order to ensure the opening ratio and raise the suction force, and is desirably not greater than 1.5 mm so that depression marks (suction marks) are not left in the recording medium due to the negative pressure suction. By making the hole diameter not smaller than 0.4 mm, it is possible to ensure both wrappability about the pressure drum and rigidity (durability with respect to deformation). Furthermore, the interval between the suction holes is desirably set to be no less than 0.1 mm in order to prevent thermal deformation of the surface of the conveyance body and ensure rigidity, and is desirably set to be no greater than 10 mm in order to prevent wrinkles which occur during suction if the interval between the holes are too large and the effect in suppressing deformation of the recording medium is insufficient.

Figure 11:
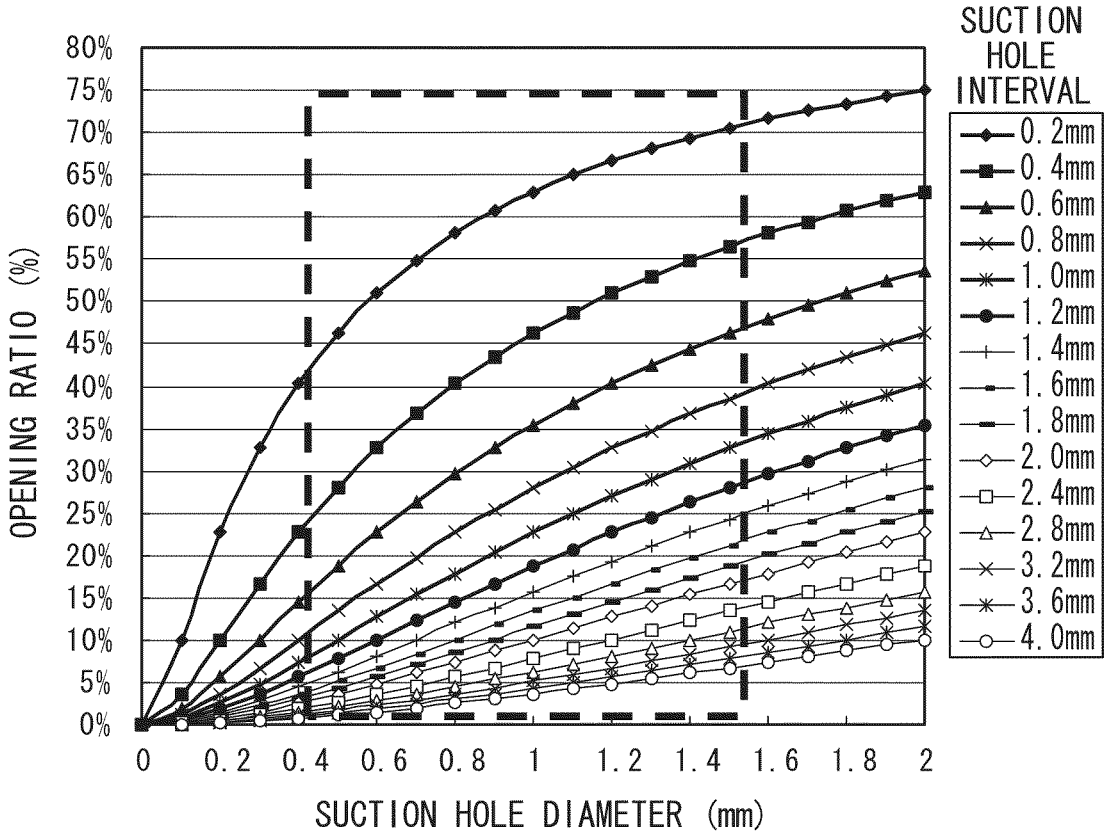
FIG. 11 is a diagram showing the relationship between the suction hole diameter, the suction hole interval and the opening ratio.

FIG. 11 shows the relationship between the suction hole diameter, the interval between the suction holes and the opening ratio. The suction hole diameter and the interval between the suction holes are desirably set in such a manner that the opening ratio per unit surface area (1 $cm^2$) is in the range enclosed by the dashed line in FIG. 11 (i.e., the opening ratio of 1 to 75%).

If the shape of the suction holes is a square or acute shape, then stress is concentrated in the corner parts, and therefore it is desirable to form the corner parts with a rounded shape. Furthermore, in the rotating conveyance body, the amount of deformation of the recording medium due to the suction pressure is greater in the axial direction (the width direction of the recording medium) than in the circumferential direction (the conveyance direction of the recording medium). Consequently, it is possible to make the deformation of the recording medium in the circumferential direction and the deformation thereof in the axial direction equal by forming the suction holes as elliptical or elongated holes having the major axis in the circumferential direction of the rotating conveyance body and the minor axis in the axial direction of the rotating conveyance body.

Apart from the numerical ranges described above, desirably, a region having an opening ratio similar to the central portion of the suction surface is arranged in a position of the suction surface that corresponds to the trailing end of the recording medium in the conveyance direction. By arranging the region having the opening ratio similar to the central portion in the position corresponding to the trailing end of the recording medium in the conveyance direction, it is possible to prevent floating up of the trailing end of the recording medium that has high rigidity. The region corresponding to the trailing end portion of the recording medium can have the opening ratio similar to the central portion in the whole of the width direction or can have the opening ratio similar to the central portion in a portion of the width direction.

Figure 12A:
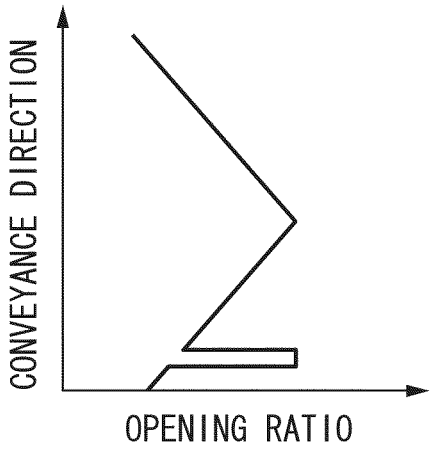
FIGS. 12A and 12B are distribution diagrams of the opening ratio in the conveyance direction according to further embodiments.
Figure 12B:
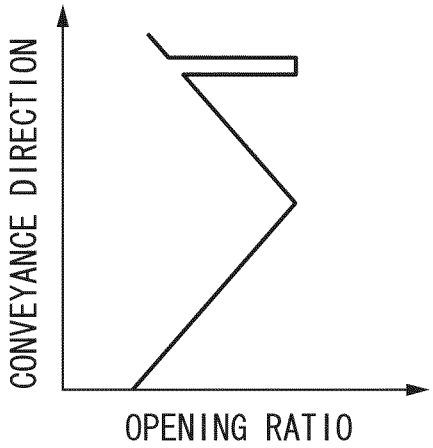

Furthermore, it is also possible to arrange a region having the opening ratio similar to the central portion of the suction surface in a position of the suction surface that corresponds to the leading end of the recording medium in the conveyance direction. By arranging the region having the opening ratio similar to the central portion in the position corresponding to the leading end of the recording medium in the conveyance direction, it is possible to prevent slack in the recording medium that has low rigidity. To give concrete embodiments, FIGS. 12A and 12B show modifications of the distribution diagram of the opening ratio in the conveyance direction (Y-Y line) of the recording medium shown in FIG. 10F, namely, a distribution diagram having the opening ratio similar to the central portion in the position corresponding to the trailing end in the conveyance direction (FIG. 12A) and a distribution diagram having the opening ratio similar to the central portion in the position corresponding to the leading end in the conveyance direction (FIG. 12B).

Figure 13:
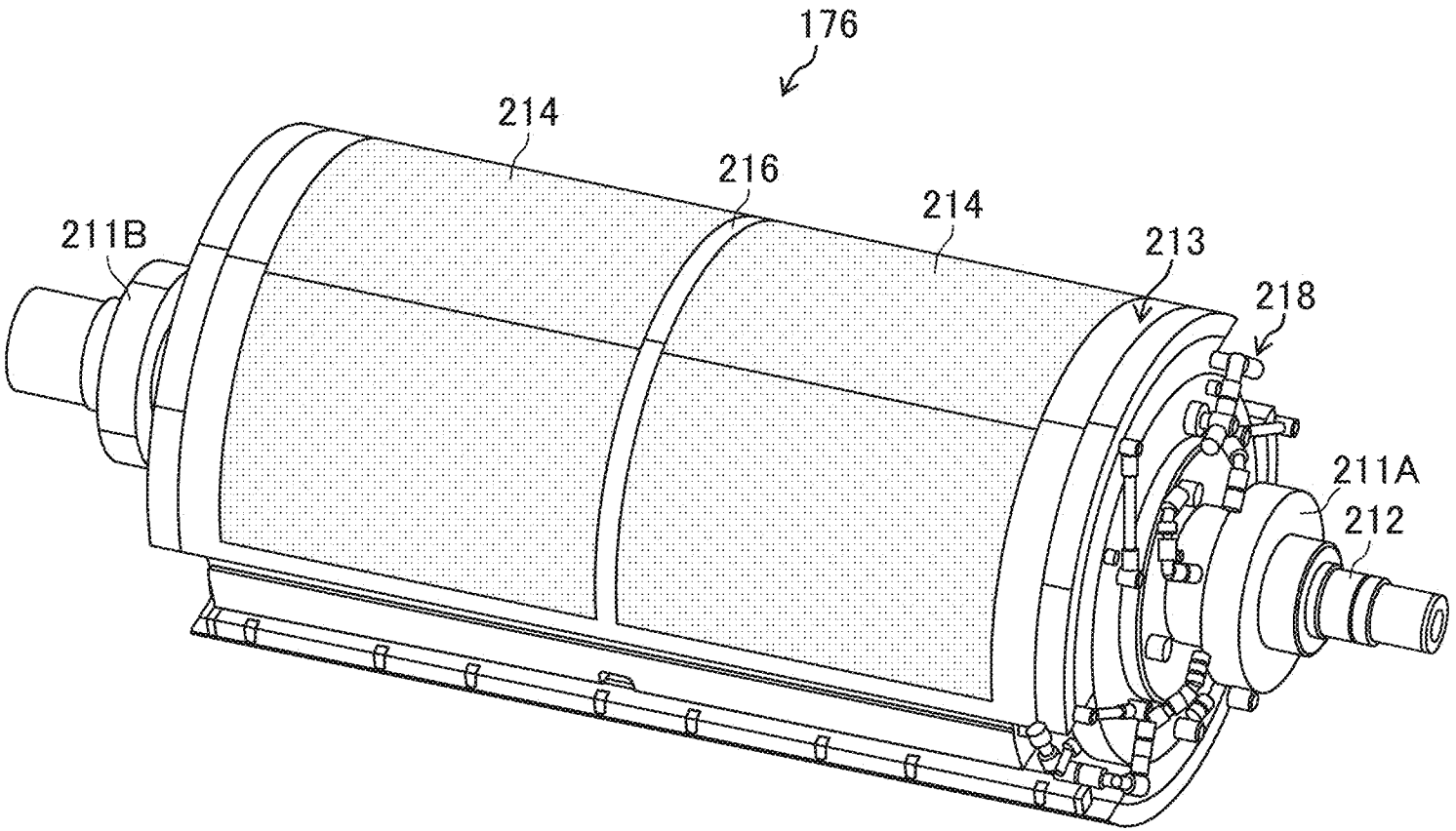
FIG. 13 is a perspective diagram showing the overall structure of the drying drum.

Next, a case is described in which a suction sheet having an arrangement of suction holes as shown in FIGS. 10A to 10G is used on the drying drum 176. FIG. 13 is a perspective diagram showing the overall structure of the drying drum 176. As shown in FIG. 13, the drying drum 176 is a rotating member which is connected to a rotating mechanism (not illustrated) and is composed so as to be rotatable about a rotational shaft 212 supported by bearings 211A and 211B, due to the operation of the rotating mechanism.

A recording medium holding region 214 (indicated with dot hatching in FIG. 13) is arranged on the recording medium holding surface (circumferential surface) 213 where the recording medium 124 is held (secured) on the drying drum 176, and the plurality of suction holes (openings) are arranged in the recording medium holding region 214. On the other hand, the approximate central portion in the axial direction of the drying drum 176 (the parallel direction to the rotational shaft 212) is a non-open section 216 where no suction holes are arranged.

A vacuum flow channel that is connected with the suction holes is arranged inside the drying drum 176 shown in FIG. 13, and the vacuum flow channel is connected to a vacuum pump arranged externally to the drying drum 176 though a vacuum pipe system 218 (including pipes, joints, etc.) arranged on a side face of the drying drum 176 and a vacuum flow channel that is arranged inside the rotational shaft 212 of the drying drum 176. When a vacuum (negative pressure) is generated by operating the vacuum pump, a suction pressure is applied to the recording medium 124 through the suction holes and the vacuum flow channel, and the like. In other words, the drying drum 176 is composed in such a manner that the recording medium 124 is held on the circumferential surface, which is the recording medium holding surface 213, by an air suction method.

Next, the structure of the vacuum flow channels inside the drying drum 176 is described.

Figure 14:
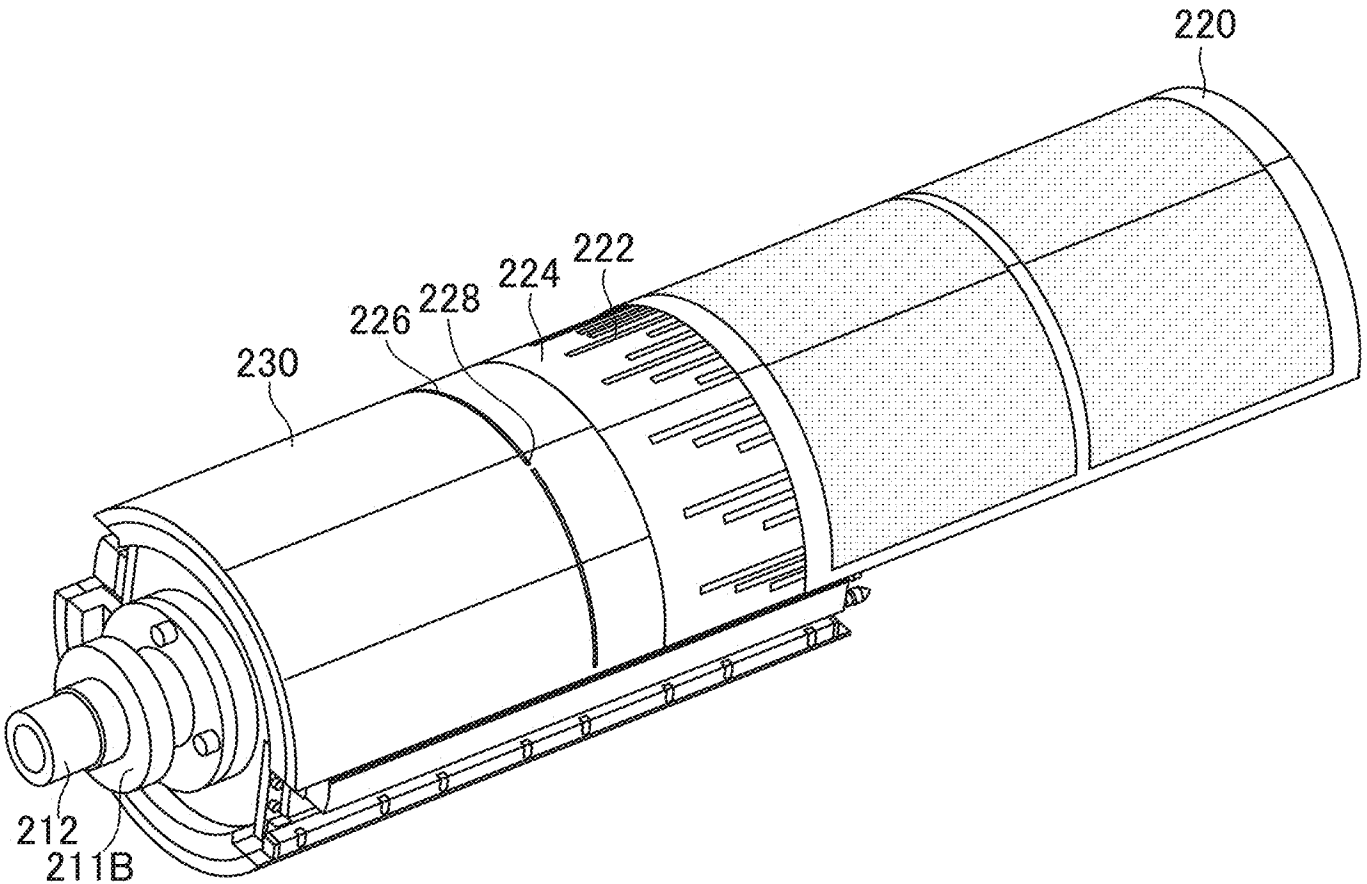
FIG. 14 is an exploded perspective diagram showing the internal structure of the drying drum shown in FIG. 13.

FIG. 14 is an exploded perspective diagram showing the internal structure of the drying drum 176. As shown in FIG. 14, the drying drum 176 includes a suction sheet 220 in which the suction holes are formed, an intermediate sheet 224 in which a plurality of suction grooves 222 connected to the suction holes (a flow channel forming section having opening sections) are formed in accordance with the prescribed arrangement pattern, and in addition, a drum main body 230 having a drum suction groove 226 (pressure generation section) which is connected with restrictor sections 234 (not shown in FIG. 14, and shown in FIG. 17) arranged in the respective suction grooves 222.

Moreover, drum suction holes 228, which are connected to a vacuum flow channel (not illustrated) arranged inside the drum main body 230, are disposed in the end parts of the drum suction groove 226 arranged on the circumferential surface of the drum main body 230.

As shown in FIG. 14, the drying drum 176 has a structure in which the drum suction groove 226 of the drum main body 230 is registered in position with the restrictor sections (flow channel control sections) of the intermediate sheet 224, the intermediate sheet 224 is wrapped about and secured in tight contact with the circumferential surface of the drum main body 230, the suction grooves 222 of the intermediate sheet 224 and the suction holes of the suction sheet 220 are registered in position, and the suction sheet 220 is wrapped about and secured in tight contact with the intermediate sheet 224, in such a manner that each of the suction holes arranged in the suction sheet 220 connects with any of the suction grooves 222 in the intermediate sheet 224.

Desirably, the arrangement pattern of the suction holes arranged in the suction sheet 220 corresponds with the pattern of the suction grooves 222 in the intermediate sheet 224. There may also be suction holes which do not connect with the suction grooves 222.

Figure 15:
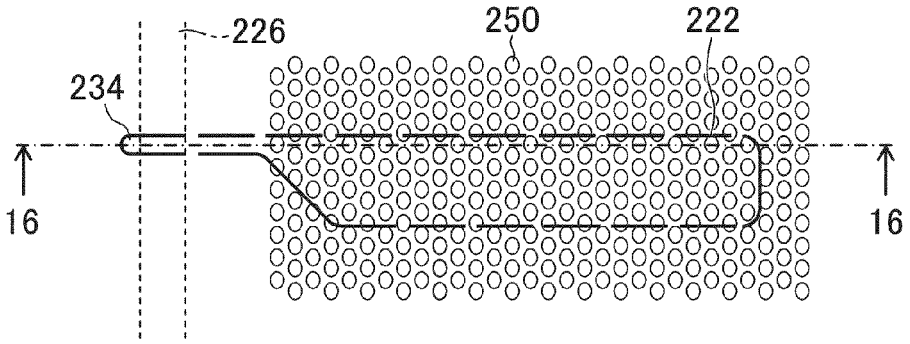
FIG. 15 is a partially enlarged diagram of the drying drum shown in FIG. 13.
Figure 16:
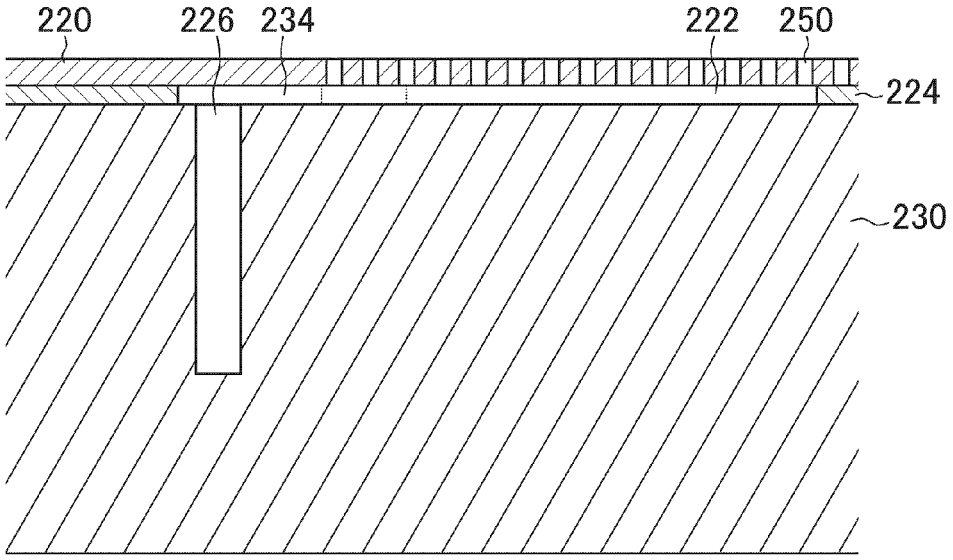
FIG. 16 is a cross-sectional diagram along line 16-16 in FIG. 15.

FIGS. 15 and 16 show the positional relationship between the suction holes 250, suction grooves 222 and drum suction groove 226. FIG. 15 is a plan diagram, and FIG. 16 is a cross-sectional diagram along line 16-16 in FIG. 15. In FIG. 16, the depth direction is depicted in enlarged fashion in order to aid understanding.

As shown in FIG. 15, the width of the suction grooves 222 (the length in the vertical direction in FIG. 15) is a length corresponding to a plurality of suction holes, and FIG. 15 shows a mode where the width of suction grooves 222 is approximately four times the diameter of the suction holes 250 (the length of the holes in the major axis direction).

The width of the drum suction groove 226 (in the horizontal direction in FIG. 15) is shorter than the length of the restrictor sections 234, and FIG. 15 shows a mode where the width of the drum suction groove 226 is approximately ½ the length of the restrictor sections 234. Moreover, the restrictor sections 234 have a length reaching to a position surpassing the drum suction groove 226.

As shown in FIGS. 15 and 16, the width of the restrictor sections 234 is smaller than the width of the suction grooves 222, whereas the restrictor sections 234 and the suction grooves 222 have substantially the same depth. In other words, the cross-sectional area of the restrictor sections 234 is smaller than the cross-sectional area of the suction grooves 222, and the flow volume passing through the suction grooves 222 is restricted by the restrictor sections 234.

Figure 17:
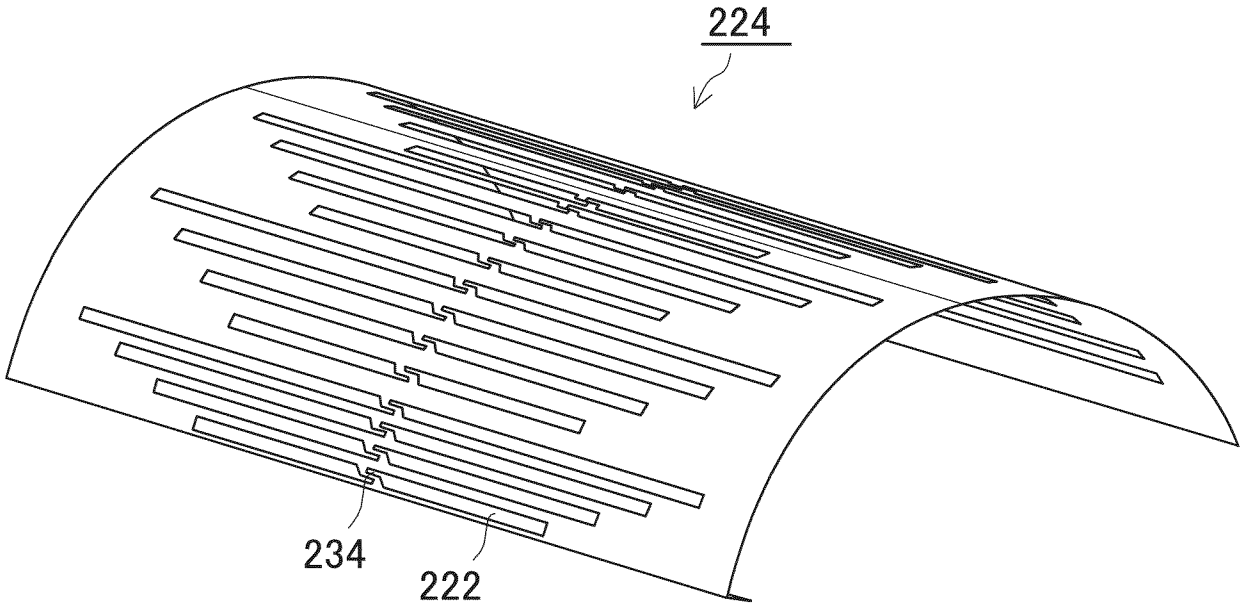
FIG. 17 is a perspective diagram showing the structure of the intermediate sheet shown in FIG. 14.

As shown in FIG. 16, the thickness of the suction sheet 220 is greater than the thickness of the intermediate sheet 224, and FIG. 17 shows a mode where the thickness of the intermediate sheet 224 is substantially ½ the thickness of the suction sheet 220.

Next, the structure of the intermediate sheet 224 is described in detail.

FIG. 17 is a perspective diagram of the intermediate sheet 224. As shown in FIG. 17, the plurality of suction grooves 222 extending from substantially the central portion of the axial direction of the drying drum 176 to either end portion following the axial direction of the drying drum 176 are arranged in the intermediate sheet 224 at equidistant intervals in the circumferential direction of the drying drum 176.

The end portions of the suction grooves 222 on the side of the central portion of the intermediate sheet 224 each have a structure (restricting structure) whereby the groove width is reduced to ¼ or less compared to the other portions of the groove, thereby forming a restrictor section (flow channel control section) 234 passing through the intermediate sheet 224. The restrictor sections 234 have a structure which connects with the drum suction groove 226 shown in FIG. 14, and the open portions thereof are covered with the non-open sections 216 of the suction sheet 220, in such a manner that the restrictor sections 234 are not connected directly to the external air.

Furthermore, the suction grooves 222 are desirably arranged as densely as possible, and a desirable mode is one where the suction grooves 222 corresponding to a recording medium of a prescribed size are arranged at a pitch of no more than 50 mm.

The suction grooves 222 arranged in the intermediate sheet 224 have a length corresponding to the size of the recording medium 124 used, and suction grooves 222 of different lengths are arranged in order to be compatible with recording media of a plurality of sizes.

Next, the suction sheet 220 is described in detail.

Figure 18:
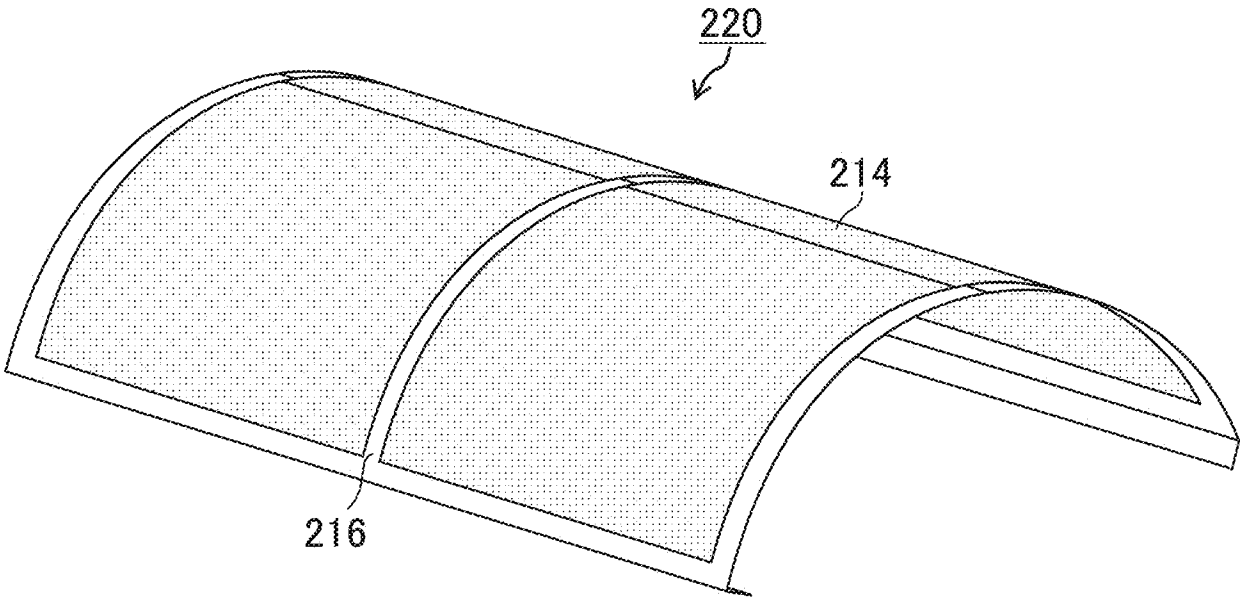
FIG. 18 is a perspective diagram showing the structure of the suction sheet shown in FIG. 14.

FIG. 18 is a perspective diagram of the suction sheet 220. The plurality of suction holes are arranged in accordance with a prescribed arrangement pattern in the recording medium holding region 214 of the suction sheet 220. The approximate central portion of the suction sheet 220 in the axial direction of the drying drum 176 forms the non-open section 216 where no suction holes 250 are arranged. Moreover, either end of the suction sheet 220 in the circumferential direction of the drying drum 176 forms a fold-back structure (L bend structure) for securing onto the drum main body 230.

The suction sheet 220 ensures a function of limiting pressure loss in the restrictor sections 234 (namely, restricting pressure loss), by not arranging suction holes but rather forming the non-open section 216 in the portion of the suction sheet 220 corresponding to the restrictor sections 234 of the intermediate sheet 224 (see FIG. 17). Furthermore, by arranging the plurality of suction holes in the portion apart from the non-open section 216 of the suction sheet 220, it is possible to use a suction sheet pattern of the same shape without having to change the suction hole pattern depending on the corresponding paper size.

FIGS. 19A to 19K show concrete embodiments of suction sheets which can be used on the drying drum 176.

Figure 19A:
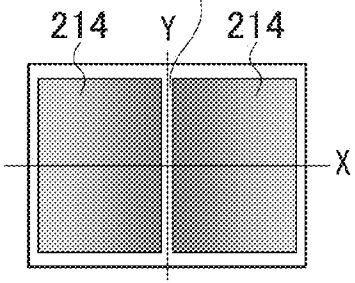
FIGS. 19A to 19K are diagrams showing the arrangements of suction holes in the suction sheets used in the present invention.
Figure 19B:
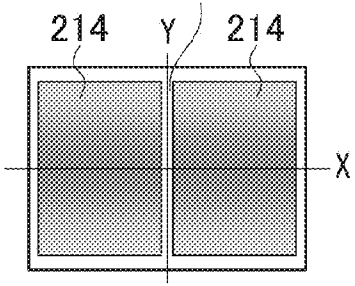
Figure 19C:
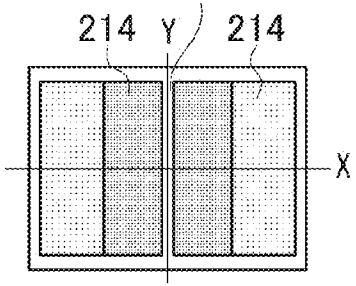

FIG. 19A shows a suction sheet in which the recording medium holding region 214 is divided by the non-open section 216 in parallel with the conveyance direction into two parts in the center of the width direction, the opening ratio is raised in the center of the width direction of the suction sheet, and the interval between the suction holes is gradually increased and the opening ratio is decreased in the width direction. In FIG. 19B, the dividing of the recording medium holding region 214 is the same with FIG. 19A, but the opening ratios of the respective recording medium holding regions 214 are controlled to decrease from the center toward the end portions in the conveyance direction. In FIG. 19C, the opening ratios of the respective recording medium holding regions are decreased in a stepwise fashion from the center toward the end portions in the width direction.

Figure 19D:
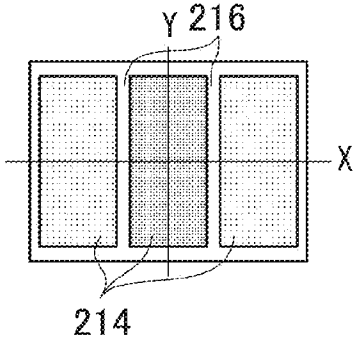
Figure 19E:
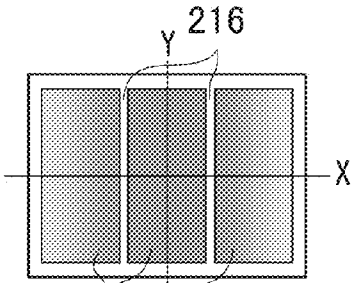

FIGS. 19D to 19G are diagrams in which the recording medium holding region 214 is further divided into 3 or 4 parts in parallel with the conveyance direction by the non-open sections 216. In FIG. 19D, the opening ratio in each of the divided regions is uniform, while the opening ratio is decreased toward the end portions of the recording medium holding region 214. In FIG. 19E, the opening ratio is uniform in the center of the recording medium holding region 214 which is divided into three parts, and the opening ratio in the end portions of the recording medium holding region 214 is decreased linearly from the central portion toward the end portions.

Figure 19F:
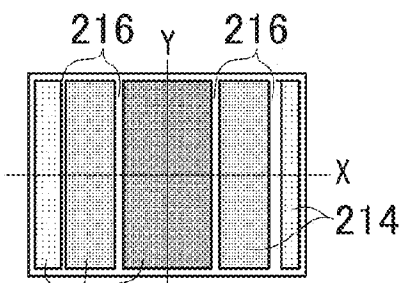
Figure 19G:
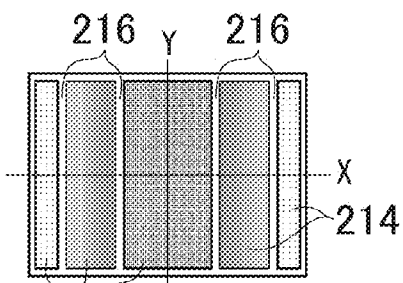

FIGS. 19F and 19G are diagrams in which the recording medium holding region 214 is divided into four parts in parallel with the conveyance direction by the non-open sections 216. In FIG. 19F, the opening ratio in each of the divided regions is uniform, while the opening ratio is decreased in stepwise fashion toward the end portions of the recording medium holding region 214. In FIG. 19G, the opening ratio in each of the central portion and the end portions is uniform, and the opening ratio is decreased linearly in the recording medium holding regions 214 between the central portion and the end portions.

Figure 19H:
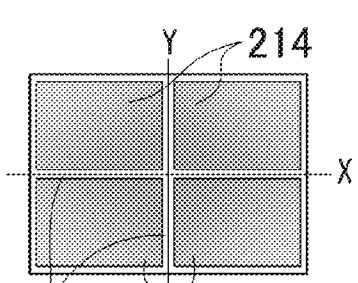
Figure 19K:
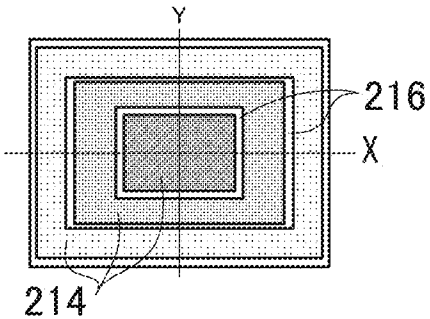
Figure 19J:
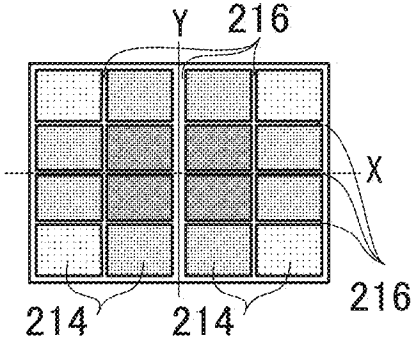
Figure 19I:
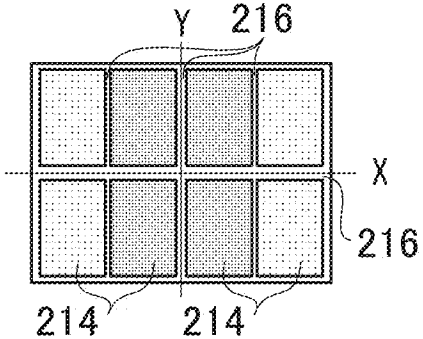

FIGS. 19H to 19J are diagrams where the recording medium holding region 214 is divided by the non-open sections 216 in a parallel direction to the width direction, in addition to the division in parallel with the conveyance direction of the drying drum 176. In FIG. 19H, the opening ratio is decreased linearly in the conveyance direction and the width direction from the central portion of the suction surface. In FIG. 19I, the opening ratio is uniform in each of the divided regions, the opening ratio is uniform in the conveyance direction, and the opening ratio is decreased in stepwise fashion in the width direction. In FIG. 19J, the recording medium holding region 214 is divided finely by the non-open sections 216, the opening ratio in each of the divided regions is uniform, and the opening ratio is decreased in stepwise fashion from the central portion toward the end portions of the recording medium holding region 214.

Moreover, FIG. 19K is a diagram in which the recording medium holding region 214 is divided into loop shapes by dividing the suction surface by means of the non-open sections 216, from the central portion. The opening ratio is uniform in each of the divided regions, and the opening ratio can be decreased in stepwise fashion from the central portion toward the end portions of the suction surface.

Thus, it is possible to cause cockling formed in the central portion to escape to the end portions by adopting various compositions for the suction sheet 220.

The direction of change of the opening ratio is desirably altered depending on the direction of the fibers of the recording medium. If the direction of the fibers of the recording medium is perpendicular to the conveyance direction, then marked cockling occurs in the conveyance direction (the circumference direction of the drying drum 176), and it is hence desirable to employ the suction surface in which the opening ratio changes in the circumferential direction as shown in FIG. 19A, in order to correspond to the direction in which cockling occurs. If the direction of the fibers of the recording medium is parallel to the conveyance direction, then marked cockling occurs in the width direction (the axial direction of the drying drum 176), and it is hence desirable to employ the suction surface in which the opening ratio changes in the axial direction as shown in FIG. 19B.

Provided that a composition is possible in which the opening ratio of the suction holes is decreased from the central portion toward the end portions, the composition of the suction sheet is not limited to the embodiments shown in FIGS. 19A to 19K and various different modes can be adopted. Since the non-open sections 216 are formed with an extremely narrow width, then even though the non-open section is formed in the center of the suction sheet 220, the narrow width thereof means that cockling can still be suppressed provided that there is sufficient suction force in the recording medium holding region surrounding the non-open section.

Furthermore, as stated previously, since the composition is adopted in which the open portions are covered with the non-open section 216 and are therefore not open to the outside air, then when the suction sheet such as those shown in FIGS. 19A to 19K is used, a structure is achieved in which the drum suction groove 226, the drum suction holes 228 and the restrictor sections 234 of the intermediate sheet 224 are arranged below the non-open section 216, and suction can be performed more effectively by arranging the suction grooves 222 below the recording medium holding region 214 on the suction sheet 220.

There are no particular restrictions on the arrangement of the suction holes, but in order to arrange the plurality of suction holes at high density, the arrangement is preferably a hexagonal close packed arrangement. If the suction holes are arranged in the hexagonal close packed configuration, then it is possible to reduce the opening ratio by leaving a prescribed interval between the suction holes arranged in a hexagonal close packed configuration (namely, by thinning out the suction holes).

Figure 20A:
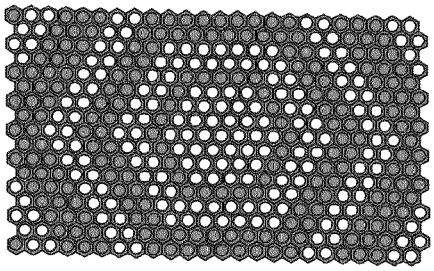
FIGS. 20A to 20H are diagrams showing the arrangements of suction holes based on a hexagonal close packed configuration.
Figure 20B:
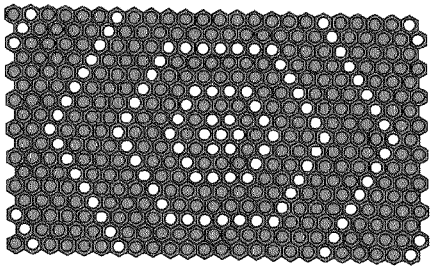
Figure 20C:
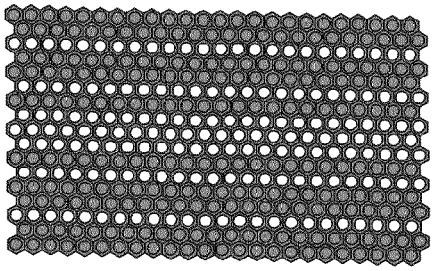
Figure 20D:
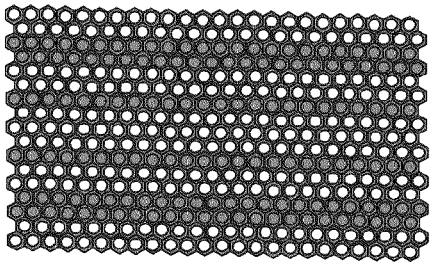
Figure 20E:
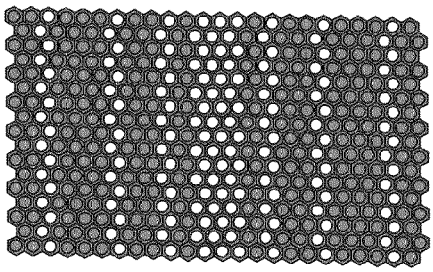
Figure 20F:
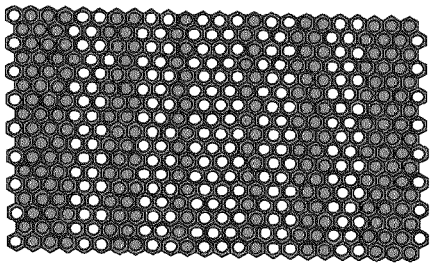
Figure 20G:
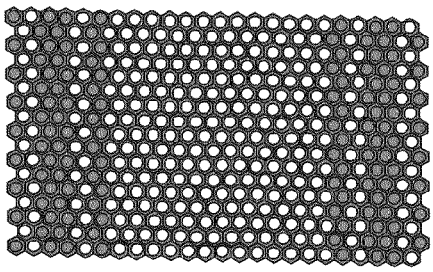
Figure 20H:
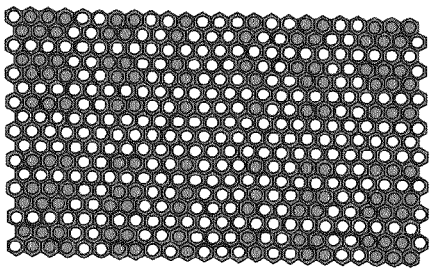

FIGS. 20A to 20H show embodiments of arrangement of the suction holes in the suction sheets formed by thinning out the suction holes. In FIGS. 20A and 20B, the opening ratio is decreased by gradually increasing the number of suction holes which are thinned out, from the central portion of the suction surface toward the end portions in the conveyance direction and the width direction. In FIGS. 20C and 20D, the opening ratio is decreased from the central portion of the suction surface toward the end portions in the conveyance direction. In FIGS. 20E to 20G, the opening ratio is decreased from the central portion of the suction surface toward the end portions in the width direction. In FIG. 20H, the opening ratio is decreased from the central portion of the suction surface toward the end portions in the conveyance direction and the width direction.

The method of thinning out the suction holes when using the hexagonal close packed configuration is not limited to the embodiments shown in FIGS. 20A to 20H, provided that the opening ratio can be made to decline from the center toward at least one of the end portions.

Figure 21A:
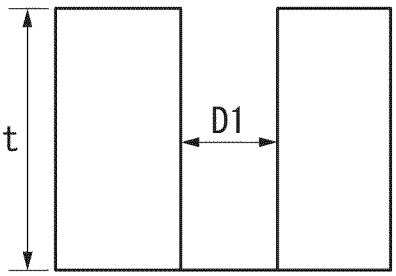
FIGS. 21A to 21E are diagrams showing shapes of the edge portions of suction holes.
Figure 21B:
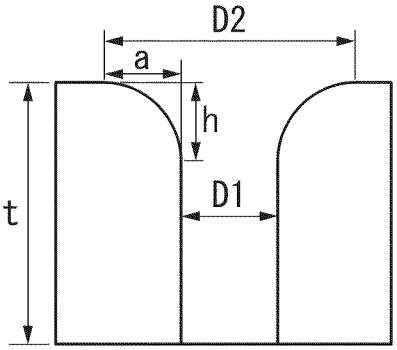
Figure 21C:
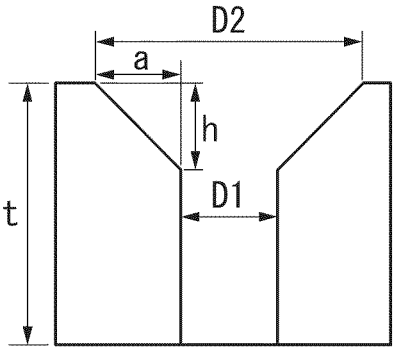
Figure 21D:
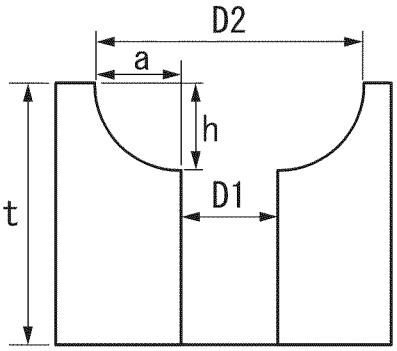
Figure 21E:
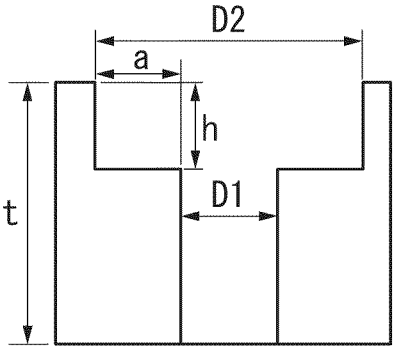

FIGS. 21A to 21E show embodiments of shapes of suction holes. With regard to the shapes of the suction holes, possible options are: suction holes having the same diameter as the diameter of the opening sections on the surface of the suction sheet, the edges of the suction holes not being shaped, as shown in FIG. 21A; suction holes having rounded edges as shown in FIG. 21B; suction holes having linear edges as shown in FIG. 21C; suction holes having inverted-rounded edges as shown in FIG. 21D; and suction holes shaped with a two-step form by arranging grooves (step difference) in the edges thereof as shown in FIG. 21E. The shape of the surface of the suction sheet is desirably a shape that is complementary with the shape of the suction holes. There are no particular restrictions on the shape of the holes and any shape can be used, but the shapes shown in FIGS. 21B to 21E are desirable when consideration is given to the depressions occurring in the recording medium due to the suction holes. By adopting the shape of this kind, it is possible to weaken the suction force in the vicinity of the end portions of the holes at the surface of the suction sheet, and therefore depressions caused by the suction holes become less liable to occur in the recording medium. In the present embodiments, the diameter of the suction holes means the dimension of D1 in FIGS. 21A to 21E.

With regard to the dimensions of the edge portions of the suction holes shown in FIGS. 21B to 21E: D1 is the minimum hole diameter (the diameter of the suction hole); D2 is the hole diameter at the surface of the suction sheet; t is the thickness of the suction sheet; h is the depth required for the diameter to change from D2 to D1; and a is (D2−D1)/2, then it is preferable that the edge portions of the holes are formed so as to satisfy:

$A \leqq 0.25 \times t$, and in FIG. 21*B*, $0 < h \leqq 0.5 \times t$;

in FIG. 21*C*, $0 < h \leqq 0.35 \times t$; and in FIGS. 21*D* and 21*E*, $0 < h \leqq 0.25 \times t$.

Examples

The present invention is described in more specific terms below with reference to practical examples, but the present invention is not limited to these examples.

Experiment 1: Evaluation Based on Arrangement of Holes in Suction Surface of Drying Drum A solid image was formed by the inkjet recording apparatus shown in FIG. 1, and the occurrence of depression at the suction holes, the image strength in the region of the holes, and the occurrence of cockling were confirmed in the samples thus formed. The experiment was carried out using the conditions shown in FIG. 22 for the opening ratio, the suction hole diameter and the interval between the suction holes in the suction sheets having the thickness of 0.4 mm. In examples where the opening ratio was changed between the central portion and the end portions, the average suction hole diameter was 0.8 mm, and the average interval between the suction holes was 0.8 mm. The shape of the edge portions of the suction holes employed the shape shown in FIG. 21A. The suction pressure was 40 kPa. The recording medium used was OK Top Coat 104 gsm of half Kiku size (636×469 mm). In the practical examples, the recording medium was conveyed with the longer edges of the recording medium in the width direction and the shorter edges in the conveyance direction, and therefore comparative examples 1 to 3 were implemented with the paper fibers oriented in both the longitudinal direction (namely, with the paper fibers perpendicular to the conveyance direction) and the lateral direction (namely, with the paper fibers parallel to the conveyance direction). In practical example 1 and comparative examples 4 to 6, the paper fibers in the paper used were laterally oriented, and in practical example 2 and comparative examples 7 to 9, the paper fibers in the paper used were longitudinally oriented. The ink droplet ejection volume was 5 pl.

The evaluations were based on the following criteria.

<Depression at Suction Holes>

The visibility of depressions caused by the suction holes in the solid image portion of the output recording medium was evaluated visually.

Excellent: Not visible
Good: Hardly visible
Fair: Slightly visible in parts, but tolerable
Poor: Visible
Very poor: Clearly visible <Image Strength in Hole Sections>

The adherence of the image in the regions of the suction holes was evaluated by sticking cellophane tape (made by Nichiban) to a region of the solid image portion of the output sample including a region of suction holes.

Good: No adherence of image to tape when peeled away
Fair: Partial adherence of image in region of suction holes to tape when peeled away
Poor: Marked adherence of image in region of suction holes to tape when peeled away <Cockling>

The extent of cockling in the solid image portion of the output recording medium was evaluated visually.

Good: Cockling within tolerances
Fair: Cockling outside tolerances in parts
Poor: Cockling outside tolerances
Very poor: Marked cockling, indisputable As shown in FIG. 22, in the comparative examples 1 to 3 where the opening ratio was uniform, cockling was observed, since it was not possible to suppress the growth of cockling in the central portion in the case of the comparative examples where the opening ratio was low, and the cockling in the end portions could not be dispersed completely in the case of the comparative example where the opening ratio was high. Cockling was also observed, similarly, in the comparative examples 4 and 7, where the opening ratio was low in the central portion and high in the end portions. Furthermore, in the comparative examples 5, 6, 8 and 9 where the opening ratio was altered by changing the hole diameter, depressions were observed in the recording medium in the portion where the suction holes had a large diameter. Since the hole diameter was 0.8 mm, no effects were observed due to the shapes of the edge portions.

In the practical examples 1 and 2 where the opening ratio was changed by adopting a uniform diameter for the suction holes and altering the interval between the suction holes, it was possible to form a good image having no cockling and no depressions caused by the suction holes.

Experiment 2: Evaluation of Suction Depression According to the Basis Weight (Rigidity) of the Recording Medium A solid image was formed on recording media of three types by the inkjet recording apparatus shown in FIG. 1, and the suction depression in the image portion was evaluated. The suction sheet had a uniform thickness of 0.4 mm and the interval between the suction holes of 0.8 mm, and the suction hole diameter was changed in the range of 0.2 to 2.0 mm in such a manner that the opening ratio decreased in a stepwise fashion in each region as shown in FIG. 10B or 10C. The opening ratios in FIG. 23 are the opening ratios in the respective regions. The ink droplet ejection volume was 5 pl. The shape of the edge portions of the suction holes employed the shape shown in FIG. 21A. The suction pressure was 40 kPa.

As shown in FIG. 23, in the case of the recording medium having high rigidity, suction depression was not liable to occur even if the diameter of the suction holes was large. Hence, it is desirable to control the diameter of the suction holes in accordance with the rigidity of the recording medium. Furthermore, desirably, the hole diameter is no more than a prescribed value, in order to achieve compatibility with recording media of low rigidity. From FIG. 23, to achieve compatibility to a basis weight of 104.7 gsm, the hole diameter is desirably set to no more than 1.4 mm, and to achieve compatibility to a basis weight of 73.3 gsm, the hole diameter is desirably set to no more than 1.2 mm.

Experiment 3: Evaluation of Suction Depression Due to Shaping of Edges of Suction Holes A solid image was formed by the inkjet recording apparatus shown in FIG. 1 and the suction depression was evaluated. The suction sheet had a uniform thickness of 0.4 mm and the interval between the suction holes of 0.8 mm, and the suction hole diameter was changed between 1.2 mm and 1.6 mm in such a manner that the opening ratio decreased in a stepwise fashion in each region as shown in FIG. 10B or 10C. Moreover, experiments were carried out using suction holes having the edge shapes shown in FIGS. 21A, 21B and 21E, and the suction hole diameter D1, the depth h required for the diameter to change from D2 to D1, and the value of a (=(D2−D1)/2) were set to the conditions shown in FIG. 24 (in FIG. 21A, both a and h are 0). OK Top Coat (basis weight: 73.3 gsm) was used as the recording medium, and the ink droplet ejection volume was 5 pl.

The marked suction depression was confirmed in Experiment 2 in the sample having the suction hole diameter of 1.6 mm; however, by shaping the edges of the holes, improvement in the suction depression was observed as shown in FIG. 24 and the experiment numbers 11 and 12, and hence the beneficial effects of shaping the edge portions could be confirmed.

As described above, in the embodiments of the present invention, the region is arranged where the attraction force acting on the recording medium held on the drying drum 176 is temporarily released, in such a manner that a space accommodating wrinkles is formed in this region, and the attraction force is subsequently increased again, and by relatively moving this space and causing the space to exit from the trailing end side of the recording medium due to the conveyance of the recording medium, wrinkles can be removed and uniform suction can be achieved. A composition of this kind applies to any attraction drum which holds a recording medium by attraction and is not limited to the drying drum 176; for example, this composition can be applied to any of the treatment liquid drum 154, the image formation drum 170 and the fixing drum 184.

In the embodiment described above, in the treatment liquid drum 154, the image formation drum 170, the drying drum 176 and the fixing drum 184, the recording medium 124 is attracted onto the respective drums by suction through the suction holes, but the method of attraction is not limited to the suction method, and the present invention can also be applied to a drum which employs electrostatic attraction, for example.

The inkjet recording apparatus and the inkjet recording method according to the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a liquid ejection head which ejects an aqueous ultraviolet-curable ink toward a recording surface of a recording medium;

a holding and drying unit including: a suction holding drum which conveys the recording medium on which an image has been formed by deposition of the aqueous ultraviolet-curable ink, while holding a back surface side of the recording medium reverse to the recording surface by suction through suction holes formed in an outer circumferential surface of the suction holding drum; and a hot air flow drying device which is disposed to face the outer circumferential surface of the suction holding drum;

a transfer conveyance device which is arranged at a downstream side of the holding and drying unit and conveys the recording medium while holding a leading end of the recording medium and curving the back surface side of the recording medium in a convex shape; and a fixing unit including an ultraviolet light irradiation device which is arranged at a downstream side of the transfer conveyance device and irradiates ultraviolet light onto the image formed on the recording surface of the recording medium, wherein intervals between the suction holes increase, whereby an opening ratio of the suction holes decreases, from a center part of a region of the outer circumferential surface corresponding to the recording medium, toward end parts of the region, wherein the intervals between the suction holes increase from the center part of the region of the outer circumferential surface corresponding to the recording medium, toward the end parts of the region in a width direction of the recording medium, and wherein edge portions of the suction holes have grooves of figures similar to the suction holes and larger than the suction holes.

2. The inkjet recording apparatus as defined in claim 1, further comprising a smoothening device which is arranged at a downstream side of the holding and drying unit and an upstream side of the ultraviolet light irradiation device and smoothens the recording medium.

3. The inkjet recording apparatus as defined in claim 2, wherein:

the fixing unit includes a fixing drum which conveys the recording medium by wrapping the recording medium around an outer circumferential surface of the fixing drum, the ultraviolet light irradiation device being disposed to face the outer circumferential surface of the fixing drum; and the smoothening device includes a pressing roller which presses the recording medium against the fixing drum.

4. The inkjet recording apparatus as defined in claim 1, further comprising a suction assisting device which assists the suction of the recording medium onto the suction holding drum.

5. The inkjet recording apparatus as defined in claim 4, wherein the suction assistance device includes an air blowing device which is arranged at an upstream side of the hot air flow drying device and blows an air flow to the outer circumferential surface of the suction holding drum obliquely toward a trailing end side of the recording medium.

6. The inkjet recording apparatus as defined in claim 1, wherein the transfer conveyance device includes a drying device which dries the recording surface of the recording medium.

7. The inkjet recording apparatus as defined in claim 6, wherein the drying device of the transfer conveyance device has a device which performs drying by blowing a hot air onto the recording surface of the recording medium.

8. The inkjet recording apparatus as defined in claim 1, wherein the transfer conveyance device includes a ribbed guide member for conveying the recording medium while curving the back surface side of the recording medium in the convex shape.

9. The inkjet recording apparatus as defined in claim 1, wherein the holding and drying unit includes a flow regulating plate for directing a hot air flow blown out from the hot air flow drying device toward the outer circumferential surface of the suction holding drum.

10. An inkjet recording apparatus, comprising:

an inkjet head which ejects ink toward a recording medium;

a drum including: a holding device which is arranged on an outer circumferential surface of the drum and holds a leading end of the recording medium; and an attraction device which attracts the recording medium onto the outer circumferential surface of the drum by attraction force, the drum being configured to rotate to convey the recording medium in a conveyance direction while holding the leading end of the recording medium by the holding device and holding the recording medium on the outer circumferential surface by the attraction force of the attraction device; and a weaker attraction force region forming device which forms a region of weaker attraction force in the outer circumferential surface of the drum where the attraction force acting on the recording medium is made weaker than in other regions in the outer circumferential surface of the drum, the region of weaker attraction force being arranged at a section in a circumferential direction of the drum through an entire width of the drum in such a manner that the region of weaker attraction force is relatively moved with respect to the recording medium held on the outer circumferential surface of the drum, and the attraction device includes a suction device which attracts the recording medium onto the outer circumferential surface of the drum by suction force induced by sucking air through suction holes formed in the outer circumferential surface, the suction holes being arranged in a suction region on the outer circumferential surface; and the weaker attraction force region forming device divides the suction region into a plurality of regions in the conveyance direction of the recording medium, connects the suction holes in the divided regions respectively to the suction device, and controls the suction force for each of the divided regions.

11. The inkjet recording apparatus as defined in claim 10, wherein:

the inkjet head is disposed to face the outer circumferential surface of the drum serving as an image formation drum; and the ink is ejected from the inkjet head toward the recording medium that is being held on the outer circumferential surface of the drum.

12. The inkjet recording apparatus as defined in claim 10, further comprising a hot air flow drying device which is disposed to face the outer circumferential surface of the drum serving as a drying drum, wherein the recording medium on which the ink has been deposited is dried by the hot air flow drying device while being held on the outer circumferential surface of the drum.

13. The inkjet recording apparatus as defined in claim 12, wherein the hot air flow drying device blows an air flow to the recording medium held on the outer circumferential surface of the drum from an outer side of the outer circumferential surface toward a downstream side of the weaker attraction force region in the conveyance direction of the recording medium.

14. The inkjet recording apparatus as defined in claim 10, further comprising an air blowing device which is disposed to face the outer circumferential surface of the drum, and blows an air flow to the recording medium held on the outer circumferential surface of the drum from an outer side of the outer circumferential surface toward a downstream side of the weaker attraction force region in the conveyance direction of the recording medium.

15. The inkjet recording apparatus as defined in claim 14, wherein the air blowing device blows the air flow obliquely toward a trailing end side of the recording medium.

16. The inkjet recording apparatus as defined in claim 10, wherein:

the attraction device includes a suction device which attracts the recording medium onto the outer circumferential surface of the drum by sucking air through suction holes formed in the outer circumferential surface; and the weaker attraction force region forming device includes a suction hole shielding device which closes off a part of the suction holes and is fixed inside the drum irrespectively of rotation of the drum.

17. The inkjet recording apparatus as defined in claim 16, wherein the suction hole shielding device includes a plate member which has a band shape of a substantially same width throughout a whole width of the outer circumferential surface and of a V-shaped form that opens toward a downstream side in the conveyance direction and has an apex in a central portion in a width direction of the outer circumferential surface, the plate member substantially making contact with an inner circumferential surface of the drum, the plate member being fixed so as not to rotate with the drum.

18. The inkjet recording apparatus as defined in claim 16, wherein the suction hole shielding device includes a plate member which has a band shape of a substantially same width throughout a whole width of the outer circumferential surface and of a U-shaped form that opens toward a downstream side in the conveyance direction and has an apex in a central portion in a width direction of the outer circumferential surface, the plate member substantially making contact with an inner circumferential surface of the drum, the plate member being fixed so as not to rotate with the drum.

19. An inkjet recording apparatus, comprising:

an image formation unit including a liquid ejection head which ejects an aqueous ultraviolet-curable ink onto a recording surface of a recording medium;

a drying unit including: a drying drum which conveys the recording medium on which an image has been formed by the aqueous ultraviolet-curable ink ejected from the liquid ejection head, while holding a leading end of the recording medium by a holding device arranged on an outer circumferential surface of the drying drum, and holding a back surface side of the recording medium reverse to the recording surface by suction through suction holes formed in the outer circumferential surface of the drying drum; and a hot air flow drying device which is disposed to face the outer circumferential surface of the drying drum and dries the recording medium by applying a hot air flow to the recording medium;

a transfer conveyance unit which is arranged at a downstream side of the drying unit and conveys the recording medium while holding the leading end of the recording medium; and a fixing unit which is arranged at a downstream side of the transfer conveyance unit and includes: a fixing drum which conveys the recording medium while holding the leading end of the recording medium by a holding device arranged on an outer circumferential surface of the fixing drum, and holding the back surface side of the recording medium by suction through suction holes formed in the outer circumferential surface of the fixing drum; and an ultraviolet light irradiation device which is arranged to face the outer circumferential surface of the fixing drum and irradiates ultraviolet light to the image formed on the recording surface of the recording medium, wherein each of the suction holes formed in the outer circumferential surface of the fixing drum has a cross-sectional shape in which an end portion opening to the outer circumferential surface is a tapered shape broadening toward the outer circumferential surface.

20. The inkjet recording apparatus as defined in claim 19, wherein positions of the suction holes formed in the outer circumferential surface of the drying drum with respect to the holding device arranged on the outer circumferential surface of the drying drum, and positions of the suction holes formed in the outer circumferential surface of the fixing drum with respect to the holding device arranged on the outer circumferential surface of the fixing drum, are mutually different.

21. The inkjet recording apparatus as defined in claim 19, wherein:

the image formation unit includes an image formation drum which conveys the recording medium in a state where the recording surface of the recording medium faces to the liquid ejection head, while holding the leading end of the recording medium by a holding device arranged on an outer circumferential surface of the image formation drum, and holding the back surface side of the recording medium by suction through suction holes formed in the outer circumferential surface of the image formation drum; and positions of the suction holes formed in the outer circumferential surface of the image formation drum with respect to the holding device arranged on the outer circumferential surface of the image formation drum, positions of the suction holes formed in the outer circumferential surface of the drying drum with respect to the holding device arranged on the outer circumferential surface of the drying drum, and positions of the suction holes formed in the outer circumferential surface of the fixing drum with respect to the holding device arranged on the outer circumferential surface of the fixing drum, are all mutually different.

22. The inkjet recording apparatus as defined in claim 19, wherein the fixing unit includes a pressing roller which presses the recording medium against the fixing drum.

23. The inkjet recording apparatus as defined in claim 19, wherein fixing unit includes a plurality of ultraviolet light irradiation devices.

24. The inkjet recording apparatus as defined in claim 19, wherein the ultraviolet light irradiation device irradiates ultraviolet light to the recording medium from an oblique direction.

25. An inkjet recording apparatus, comprising:

an image formation unit including a liquid ejection head which ejects an aqueous ultraviolet-curable ink onto a recording surface of a recording medium;

a drying unit including: a drying drum which conveys the recording medium on which an image has been formed by the aqueous ultraviolet-curable ink ejected from the liquid ejection head, while holding a leading end of the recording medium by a holding device arranged on an outer circumferential surface of the drying drum, and holding a back surface side of the recording medium reverse to the recording surface by suction through suction holes formed in the outer circumferential surface of the drying drum; and a hot air flow drying device which is disposed to face the outer circumferential surface of the drying drum and dries the recording medium by applying a hot air flow to the recording medium;

a transfer conveyance unit which is arranged at a downstream side of the drying unit and conveys the recording medium while holding the leading end of the recording medium; and a fixing unit which is arranged at a downstream side of the transfer conveyance unit and includes: a fixing drum which conveys the recording medium while holding the leading end of the recording medium by a holding device arranged on an outer circumferential surface of the fixing drum, and holding the back surface side of the recording medium by suction through suction holes formed in the outer circumferential surface of the fixing drum; and an ultraviolet light irradiation device which is arranged to face the outer circumferential surface of the fixing drum and irradiates ultraviolet light to the image formed on the recording surface of the recording medium, wherein:

the ultraviolet light irradiation device includes a plurality of ultraviolet light emitting elements; and positions of the suction holes formed in the outer circumferential surface of the drying drum with respect to the holding device arranged on the outer circumferential surface of the drying drum coincide with positions of the ultraviolet light emitting elements with respect to the holding device arranged on the outer circumferential surface of the fixing drum.

26. An inkjet recording apparatus, comprising:

an image formation unit including a liquid ejection head which ejects an aqueous ultraviolet-curable ink onto a recording surface of a recording medium;

a drying unit including: a drying drum which conveys the recording medium on which an image has been formed by the aqueous ultraviolet-curable ink ejected from the liquid ejection head, while holding a leading end of the recording medium by a holding device arranged on an outer circumferential surface of the drying drum, and holding a back surface side of the recording medium reverse to the recording surface by suction through suction holes formed in the outer circumferential surface of the drying drum; and a hot air flow drying device which is disposed to face the outer circumferential surface of the drying drum and dries the recording medium by applying a hot air flow to the recording medium;

a transfer conveyance unit which is arranged at a downstream side of the drying unit and conveys the recording medium while holding the leading end of the recording medium; and a fixing unit which is arranged at a downstream side of the transfer conveyance unit and includes: a fixing drum which conveys the recording medium while holding the leading end of the recording medium by a holding device arranged on an outer circumferential surface of the fixing drum, and holding the back surface side of the recording medium by suction through suction holes formed in the outer circumferential surface of the fixing drum; and an ultraviolet light irradiation device which is arranged to face the outer circumferential surface of the fixing drum and irradiates ultraviolet light to the image formed on the recording surface of the recording medium, wherein:

the ultraviolet light irradiation device includes a plurality of ultraviolet light emitting elements;

each of the suction holes formed in the outer circumferential surface of the fixing drum has a cross-sectional shape in which an end portion opening to the outer circumferential surface is a tapered shape broadening toward the outer circumferential surface;

a diameter of a broadest part of the tapered shape of each of the suction holes is larger than a diameter of each of the light emitting elements; and a diameter of a narrowest part of the tapered shape connecting to a straight part inside each of the suction holes is smaller than the diameter of each of the light emitting elements.

27. An inkjet recording apparatus, comprising:

an inkjet head which deposits droplets of ink onto a recording surface of a recording medium to form an image on the recording surface;

a conveyance device including: a holding device which holds the recording medium on which the droplets of ink have been deposited; a conveyance body which conveys the recording medium in a conveyance direction, the conveyance body having a suction surface in which a plurality of suction holes are formed; and a suction device which sucks air thorough the suction holes to attract the recording medium onto the suction surface; and a heating device which heats the conveyance body and the recording medium from a recording surface side of the recording medium, wherein intervals between the suction holes increase, whereby an opening ratio of the suction holes decreases, from a center part of a region of the suction surface corresponding to the recording medium, toward end parts of the region, wherein the intervals between the suction holes increase from the center part of the region of the suction surface corresponding to the recording medium, toward the end parts of the region in a width direction of the recording medium, and wherein edge portions of the suction holes have grooves of figures similar to the suction holes and larger than the suction holes.

28. The inkjet recording apparatus as defined in claim 27, wherein the intervals between the suction holes increase from the center part of the region of the suction surface corresponding to the recording medium, toward the end parts of the region in the conveyance direction of the recording medium.

29. The inkjet recording apparatus as defined in claim 27, wherein the opening ratio of the suction holes is the highest in the center part of the region of the suction surface corresponding to the recording medium.

30. The inkjet recording apparatus as defined in claim 27, wherein the suction holes are arranged in a hexagonal close packed configuration with forming prescribed intervals between the suction holes.

31. The inkjet recording apparatus as defined in claim 27, wherein each of the suction holes has one of a perfect circular shape and an elliptical shape.

32. The inkjet recording apparatus as defined in claim 27, wherein edge portions of the suction holes have curved surfaces.

33. The inkjet recording apparatus as defined in claim 27, further comprising a control device which controls suction pressure of the suction device in accordance with a type of the recording medium.

34. The inkjet recording apparatus as defined in claim 27, wherein the suction holes are arranged in such a manner that the opening ratio in the suction surface decreases linearly.

35. The inkjet recording apparatus as defined in claim 27, wherein the suction surface is divided into a plurality of regions, and the suction holes are arranged in such a manner that the opening ratio decreases stepwise for the divided regions.

36. The inkjet recording apparatus as defined in claim 35, wherein the opening ratio decreases linearly between the divided regions of the suction surface, and the opening ratio is uniform in each of the divided regions.

37. The inkjet recording apparatus as defined in claim 34, wherein the opening ratio is uniform in the center part of 10% to 70% of the suction surface.

38. The inkjet recording apparatus as defined in claim 27, further comprising a recording medium pressing device which presses the recording medium against a surface of the conveyance body from the recording surface side.

39. The inkjet recording apparatus as defined in claim 27, wherein the opening ratio in a part of the suction surface corresponding to a trailing end of the recording medium in the conveyance direction is equal to the opening ratio in the center part of the suction surface.

40. The inkjet recording apparatus as defined in claim 27, wherein the opening ratio in a part of the suction surface corresponding to a leading end of the recording medium in the conveyance direction is equal to the opening ratio in the center part of the suction surface.

* * * * *